US007758262B2

(12) United States Patent
Yamamoto et al.

(10) Patent No.: US 7,758,262 B2
(45) Date of Patent: Jul. 20, 2010

(54) INK RIBBON CARTRIDGE WITH FIRST AND SECOND GRIP PORTIONS

(75) Inventors: Hideki Yamamoto, Nagoya (JP); Yasutake Yamaguchi, Chiryu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 153 days.

(21) Appl. No.: 10/998,628

(22) Filed: Nov. 30, 2004

(65) Prior Publication Data

US 2005/0201803 A1 Sep. 15, 2005

(30) Foreign Application Priority Data

| | | |
|---|---|---|
| Mar. 15, 2004 | (JP) | 2004-072395 |
| Jun. 25, 2004 | (JP) | 2004-188430 |
| Jun. 25, 2004 | (JP) | 2004-188471 |
| Jun. 25, 2004 | (JP) | 2004-188498 |
| Jun. 25, 2004 | (JP) | 2004-188509 |

(51) Int. Cl.
*B41J 32/00* (2006.01)

(52) U.S. Cl. ..... 400/208; 347/214

(58) Field of Classification Search ..... 400/207, 400/208, 208.1, 246; 347/214; *B41J 32/00*
See application file for complete search history.

(56) References Cited

U.S. PATENT DOCUMENTS

| | | | | |
|---|---|---|---|---|
| 4,914,452 | A | 4/1990 | Fukawa | |
| 5,246,299 | A | 9/1993 | Kitsuki et al. | 242/343.2 |
| 5,584,587 | A | 12/1996 | Koike et al. | 400/246 |
| D425,545 | S * | 5/2000 | Ishida | D18/12 |
| 6,257,780 | B1 | 7/2001 | Ito et al. | |
| 6,307,581 | B1 | 10/2001 | Uchiyama et al. | |
| D453,179 | S * | 1/2002 | Neri et al. | D18/12 |
| 6,623,192 | B1 * | 9/2003 | Kameyama | 400/208 |
| 6,623,193 | B1 * | 9/2003 | Holland | 400/242 |
| D505,445 | S * | 5/2005 | Neri | D18/12 |

(Continued)

FOREIGN PATENT DOCUMENTS

| | | |
|---|---|---|
| CN | 1130130 A | 9/1996 |

(Continued)

OTHER PUBLICATIONS

Chinese Office Action mailed Dec. 4, 2009 for Chinese Patent Application No. 200810215721.9.

(Continued)

*Primary Examiner*—Leslie J Evanisko
(74) *Attorney, Agent, or Firm*—Oliff & Berridge, PLC

(57) ABSTRACT

An ink ribbon cartridge including a frame, supply shaft supporting members and take-up shaft supporting members is provided. The supply shaft supporting members support a supply shaft, and the take-up shaft supporting members support a take-up shaft. The frame includes a first bearing member, a second bearing member, a front connecting member, which connects front ends of the first and second bearing members together, and a back connecting member connects back ends of the first and second bearing members together. At least one of the front connecting member and the back connecting member has one of a groove or a hole capable of accommodating a portion of an image forming device in which the ink ribbon cartridge may be installed.

23 Claims, 36 Drawing Sheets

U.S. PATENT DOCUMENTS

| | | | |
|---|---|---|---|
| 2001/0046399 | A1 | 11/2001 | Hayashi |
| 2002/0008755 | A1 | 1/2002 | Hayashi |
| 2002/0024583 | A1 | 2/2002 | Hayashi |
| 2002/0186992 | A1 | 12/2002 | Hayashi |
| 2004/0136766 | A1 | 7/2004 | Hayashi |
| 2005/0063755 | A1 | 3/2005 | Hayashi |
| 2008/0181705 | A1 | 7/2008 | Hayashi |

FOREIGN PATENT DOCUMENTS

| | | | | |
|---|---|---|---|---|
| CN | 1321581 | A | | 11/2001 |
| EP | 0 330 235 | A2 | | 8/1989 |
| EP | 0 423 647 | B1 | | 4/1991 |
| EP | 1 000 765 | A2 | | 5/2000 |
| EP | 1 138 507 | A2 | | 10/2001 |
| EP | 1 334 835 | A2 | | 8/2003 |
| JP | A-63-276577 | | | 11/1988 |
| JP | 03292176 | A | * | 12/1991 |
| JP | U-6-20049 | | | 3/1994 |
| JP | A-07-314833 | | | 12/1995 |
| JP | A-9-86011 | | | 3/1997 |
| JP | A 9-109524 | | | 4/1997 |
| JP | A-11-138929 | | | 5/1999 |
| JP | A-11-208050 | | | 8/1999 |
| JP | A 2001-130075 | | | 5/2001 |
| JP | A-2002-248824 | | | 9/2002 |
| JP | A-2002-356032 | | | 12/2002 |
| JP | A 2003-182130 | | | 7/2003 |
| NZ | 198627 | | | 8/1984 |
| NZ | 201616 | | | 9/1985 |
| NZ | 201617 | | | 2/1986 |

OTHER PUBLICATIONS

Japanese Office Action, issued Jan. 19, 2010 in Japanese Patent Application No. 2004-188498.

* cited by examiner

INK RIBBON CARTRIDGE WITH FIRST AND SECOND GRIP PORTIONS

INCORPORATION BY REFERENCE

This application claims priority from Japanese Patent Application No. 2004-072395 filed on Mar. 15, 2004; and Japanese Patent Application Nos. 2004-188430, 2004-188509, 2004-188471, and 2004-188498, all filed on Jun. 25, 2004, the entire subject matter of the applications is incorporated herein by reference thereto.

BACKGROUND OF THE INVENTION

1. Field of Invention

The invention relates an ink ribbon cartridge and, more particularly, to an attachable/detachable ink ribbon cartridge.

2. Description of Related Art

Image forming devices, such as, printers and facsimile machines, which print images/data via a thermal transfer method generally employ an ink ribbon to form an image on an image recording medium. The ink ribbon is typically held by an ink ribbon cartridge that is detachably arranged in the image forming device. An ink ribbon cartridge generally includes a supply shaft, a take-up shaft and a cartridge frame. The supply shaft maintains thereon the unused portion of an ink ribbon sheet and generally, an unused portion of the ink ribbon sheet is maintained in the form of a roll thereon. The take-up shaft maintains thereon the used portion of the ink ribbon sheet and generally, the used portion of the ink ribbon sheet is maintained in the form of a roll thereon. To print an image on an image recording medium, the ink ribbon sheet, supplied by (e.g., rolled out from) the supply shaft, is overlapped with the recording medium (e.g., paper) and heated by a thermal head. The heat causes the color elements on the ink ribbon to be transferred to the image recording medium. The used portion of the ink ribbon is then taken up by (e.g., rolled onto) the take-up shaft.

One way to improve the quality of the image produced using such a thermal transfer method, is to subject the ink ribbon sheet to a sufficient amount of tension such that the portion of the ink ribbon sheet extending from the supply shaft to the take-up shaft is not loose and/or wrinkled to enable corresponding unwrinkled/stretched portions of the ink ribbon and the recording medium to consistently overlap each other. If the ink ribbon sheet is loose and/or wrinkled, for example, the color elements from the ink ribbon sheet may not be properly transferred to the image recording medium because some of the ink components may not be transferred to the recording medium at all and/or some of the ink components may be transferred to improper areas of the recording medium. In such a case, portions of the image may, for example, be smudged, missing, shifted, lighter, darker, etc. and thus, the quality of the formed image is sacrificed. One way to reduce, and preferably completely prevent, the loosening and/or wrinkling of the ink ribbon sheet is to apply a tension to the supply shaft in order to prevent over-rotation of the supply shaft in a direction which releases some of the ink ribbon sheet.

To reduce the occurrence of a loose or wrinkled ink ribbon sheet, JP 2001-130075 discloses a back tension mechanism which supplies a predetermined rotation resistance to the supply shaft of an ink ribbon cartridge. The back tension mechanism disclosed therein utilizes a resin spool, which is rotatably mounted on an end of the supply shaft, and a spring, which presses the resin spool against the resin cartridge frame. When a surface of the resin cartridge rubs against a surface of the resin supply spool, a frictional force is generated therebetween. Accordingly, a back tension (i.e., rotation resistance) is applied against the rotation of the resin spool with the unused ink ribbon thereon (i.e., against the release of the ink ribbon on the resin supply spool). The applied back tension helps keep the ink ribbon from rotating excessively (i.e., supplying more ink ribbon than needed) and thereby loosening and/or wrinkling thereof.

The back tension mechanism employed in JP 2001-130075, however, depends on the frictional force generated between a surface of the resin supply spool and a surface of the resin cartridge frame (i.e., two resin surfaces). The magnitude of the frictional force between two resin members is dependent on changes in the environment and thus, the magnitude of the frictional force between the surface of the resin supply spool and the corresponding surface of the resin cartridge frame may change based the surrounding temperature, for example. Thus, a consistent amount of back tension may not be applied to the supply spool because the tension applied to the resin supply spool is dependent, for example, on the surrounding temperature of the image forming apparatus employing such an ink ribbon cartridge. Therefore, due to environmental differences, the generated frictional force may not be consistently substantially equal to an intended predetermined amount. In such a case, the frictional force generated may not be sufficient to apply the necessary back tension against the rotation of the supply shaft and the quality of images being formed may be hindered as a result of a wrinkled/loose ink ribbon sheet.

JP 9-109524 discloses another back tension mechanism for a supply shaft of an ink ribbon cartridge. The back tension mechanism disclosed therein employs a felt member arranged between a disk portion and a round flat plate. A spring urges the disk portion against the felt member and the round flat plate, and a back tension is applied to the ink ribbon sheet by a frictional force generated between corresponding surfaces of the felt member and the disk portion. In the mechanism disclosed therein, the spring and the round flat plate, for example, are provided on an external circumference of the revolving shaft and are part of the printer. The spring is provided between a surface of the gear and a first surface of the disk portion, and one surface of the felt member is secured the round flat plate while the other surface of the felt member is urged by the spring to be in contact with the second surface of the disk portion. Thus, to employ the back tension mechanism disclosed therein, a space for at least the spring and the round flat plate of the back tension mechanism must be allocated in the main body of the printing device. Accordingly, a size of the image forming apparatus employing the back tension mechanism disclosed in JP 9-109524 may need to be increased in order to accommodate for the components of the back tension. Further, as a result of wear and tear, the felt member may, for example, deteriorate and the generated resistance may not be in substantially equal to the predetermined desired rotation resistance. However, in the back tension mechanism disclosed herein the back tension mechanism is secured (i.e., screwed) to the printer. Thus, if for example, the felt member needs to be replaced, disassembly of the back tension mechanism from the printer is required.

Another way to improve an attachable/detachable ink cartridge is to provide an ink cartridge frame which allows for easier handling and attachment/detachment thereof to/from the image forming device. Generally, as disclosed, for example, in JP 2003-182130, ink cartridges employ a structure in which the ink ribbon supporting shafts are rotatably connected by a frame member. The frame member disclosed in JP 2003-182130 employs a pair of side frame members, which are independent of each other. The right ends of the ink ribbon shafts are supported by support members which are rotatably attached to the right side frame and the left ends of the ink ribbon shafts are supported by support members which are rotatably attached to the left side frame. Further, all the support members are attachable to and detachable from the side frame members.

Attachment and detachment of such an ink cartridge can be difficult and time consuming because it is necessary to correctly install all the attachable/detachable components of the ink cartridge and, in some circumstances, for example, while assembling one group of attachable/detachable components another group of attachable/detachable components detach from the frame. Also, an ink cartridge having a frame consisting solely of two side members can be wobbly and unstable, making handling and attachment and detachment thereof more difficult.

Another way to improve an ink cartridge is to provide an ink cartridge that is an attachable/detachable ink cartridge having components which maintain their connection with corresponding components during attachment and detachment of the ink cartridge and/or during replacement of the ink ribbon sheet. An example of a known supporting member 100 is illustrated in FIG. 23. The known supporting member 100 includes a gear member 102, which is equipped with a drive gear 101 and a spool member 103. One end of the spool portion is inserted into a receiving portion of the take-up rotating shaft body and the other end of the spool portion has elastic pieces 104 projecting therefrom. The gear member 102 has engaging holes which receive the elastic pieces 104 of the spool portion. Engaging protrusions 104*a* on the elastic pieces 104 engage with the engaging holes 105 and the spool member and the gear member are thereby connected. However, when such a structure is tilted, due to an external force applied from a side of the spool member 103, such as, for example, during removal of a shaft to which it is connected, the elastic piece 104 receives a force which separates the elastic piece from the engaging hole 105. Therefore, in such a structure, the spool member 103 and the gear member are too easily separated.

SUMMARY OF THE INVENTION

One aspect of the invention provides a compact structure for applying a consistent back tension to a supply spool of an ink ribbon cartridge.

Another aspect of the invention provides an ink ribbon cartridge having unattachable/undetachable members to aid in quick and accurate assembly and attachment/detachment of an ink cartridge in an image forming device.

Another aspect of the invention provides an ink ribbon cartridge which is attachable to/detachable from an image forming device, and has an undetachable connecting member for connecting a shaft with ink ribbon thereon to the ink ribbon cartridge and the undetachable connecting member including a drive gear.

Another aspect of the invention provides a back tension applying mechanism on an ink ribbon cartridge.

According to one aspect of the invention, an ink ribbon cartridge including a frame, supply shaft supporting members and take-up shaft supporting members is provided. The supply shaft supporting members support a supply shaft, and the take-up shaft supporting members support a take-up shaft. The frame includes a first bearing member, a second bearing member, a front connecting member, which connects front ends of the first and second bearing members together, and a back connecting member connects back ends of the first and second bearing members together. At least one of the front connecting member and the back connecting member has one of a groove or a hole capable of accommodating a portion of an image forming device in which the ink ribbon cartridge can be installed.

According to another aspect of the invention, an ink ribbon cartridge, comprising a left bearing member, a right bearing member, a front connecting member and a back connecting member is provided. Ends of a take-up shaft and a supply shaft are rotatably supported by the left and right bearing members. The front connecting member connects the front ends of the left and right bearing members together; and the back connecting member connects back ends of the first and second bearing members together. The front connecting member includes at least one grip portion which projects substantially upward substantially from a level corresponding to at least one of an upper edge of each of the left and right bearing members where the front connecting member is connected thereto.

According to another aspect of the invention, an ink ribbon cartridge including a left bearing member, a right bearing member, a front connecting member, and a back connecting member is provided. The right bearing member is substantially parallel to the left bearing member and the front connecting member connects substantially front upper ends of the left and right bearing member. The back connecting member connecting substantially back upper ends of the left and right bearing member. Substantially center portions of the left and right bearing member have a distance therebetween which is larger than a distance between other facing portions of the left and right bearing member.

These and other optional features and possible advantages of various aspects of this invention are described in, or are apparent from, the following detailed description of exemplary embodiments of systems and methods which implement this invention.

BRIEF DESCRIPTION OF THE DRAWINGS

Exemplary embodiments of this invention will be described in detail, with reference to the following figures, in which.

DETAILED DESCRIPTION OF EXEMPLARY IMPLEMENTATIONS

Figure 1:
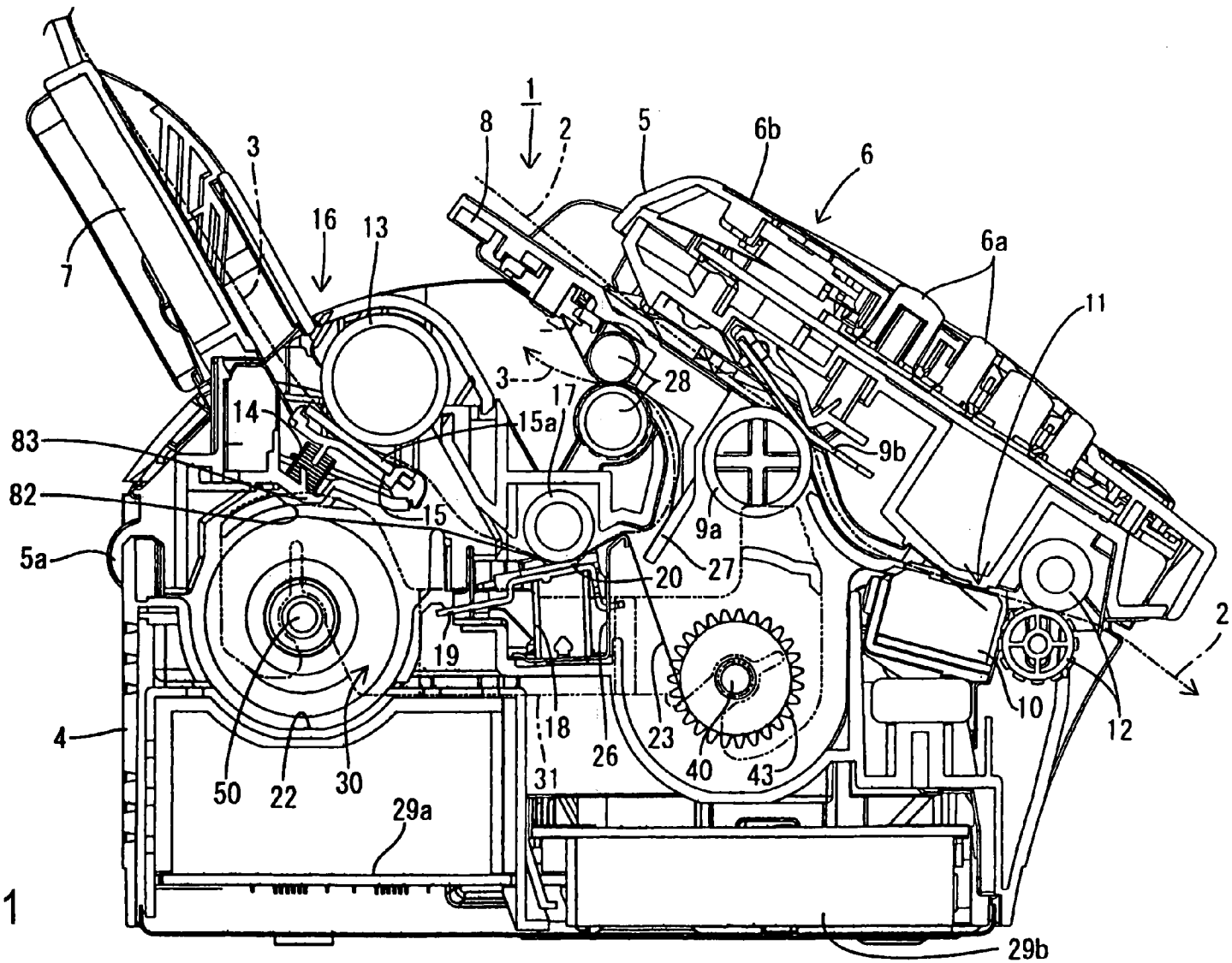
FIG. 1 is a general structural diagram of an exemplary facsimile device employing an ink ribbon cartridge according to one or more aspects of the invention.

Throughout the following description, numerous specific concepts and structures are set forth in order to provide a thorough understanding of the invention. The invention can be practiced without utilizing all of these specific concepts and structures. In other instances, well known elements have not been shown or described in detail, so that emphasis can be focused on the invention.

One or more aspects of the invention provide an ink ribbon cartridge with a supply shaft that is subjected to a substantially consistent back tension without substantially increasing, and preferably decreasing, a size of an ink ribbon cartridge. Another aspect of the invention provides an ink ribbon cartridge which may be easily handled during attachment/detachment thereof and during ribbon replacement. Another aspect of the invention provides an ink ribbon cartridge having a plurality of substantially undetachable spools (i.e., a spool which, if properly assembled, does not easily detach from the frame without effort, e.g., prying, intentionally detaching) which makes the attachment/detachment process easier by reducing the number of components that need to be assembled. Another aspect of the invention provides an ink ribbon cartridge which includes a take-up spool having an input gear securely attached thereto such that the input gear does not detach from the spool when the take-up spool is removed and/or tilted. These and other aspects of the invention will be described below and may be used individually and/or in any combination thereof.

In the following description, an exemplary ink ribbon cartridge is illustrated in relation to a facsimile device. However, various implementations of an ink cartridge according to the invention may be provided in other image forming devices, such as, printers, copiers or multi-function facsimile/printer/copier devices.

In the following description of the exemplary implementations of the invention, the side of the exemplary facsimile device 1 on which the image input medium output rollers 12 are provided will be referred to as the "front" or "front side" and the side substantially opposite the side on which the hinge 5*a* is arranged will be referred to as the "back" or "back side". With regard to various individual components of the facsimile device and/or an ink ribbon cartridge housed therein, sides of the individual components will be similarly identified based on the arranged/attached position of the component on/in the exemplary facsimile device. That is, a side will be considered to be the "left side" if it is on the left side when viewing the object from the front of the exemplary facsimile device while the object is arranged therein, and the "right side" if it is on the right side when viewing the object from the front of the exemplary facsimile device while the object is arranged therein.

Various implementations of the invention provide an ink ribbon cartridge which may include an attachable/detachable ink ribbon sheet 23. The ink ribbon cartridge is attachably/detachably mountable to a main body of an image forming device, such as a printer, a facsimile device and/or a copier, which prints an image via a thermal transfer method.

Generally, a facsimile device is capable of reading an image from a document and generating image data corresponding to the read image, transmitting the image data to another facsimile device via a communication line, such as a telephone line, receiving image data from another device, such as another facsimile device, and forming an image on the recording medium, such as paper, based on the image data. A facsimile device can also function as printer, which receives print data via, for example, radio transmission or a printer cable connected to a personal computer and the facsimile device, and forms an image on the recording medium based on the received image data.

FIG. 1 illustrates the general structure of an exemplary facsimile device employing an ink ribbon cartridge according to an exemplary implementation of one or more aspects of the invention. The exemplary facsimile device 1 illustrated in FIG. 1 includes a main body casing 4 which typically includes a telephone receiver (not shown) thereon. The facsimile device 1 may include an upper body cover 5. The upper body cover 5 may be opened (e.g., lifted up) and closed (e.g., shut down onto corresponding portions of the main body casing 4). In the exemplary facsimile device 1, a lower-back portion of the upper body cover 5 is connected to an upper-back portion of the main body casing 4 via a hinge 5*a* such that the upper body cover 5 may be opened and closed via the hinge 5*a*.

A control panel 6, which includes, for example, switches/buttons/keys 6*a*, and a liquid crystal display 6*b*, may be provided at a front-end portion of the upper body cover 5. A recording medium supply tray 7, which holds the recording medium 3 (e.g., paper) may be provided at a back-end portion of upper body cover 5. The recording medium supply tray 7 is arranged, for example, at angle such that a lower portion of the recording medium supply tray 7 is connected, for example, to the upper body cover 5 and an upper end of the recording medium supply tray 7 extends at an upward angle into the surrounding space. An input tray 8 may be provided, for example, in front of the recording medium supply tray 7 on the upper body cover 5. The input tray 8 supports an input image medium 2, such as a document having the image to be printed, copied and/or faxed thereon. The input tray 8 may also be arranged at an angle such that a lower portion of the input tray 8 is connected to the upper body cover 5 and an upper end of the input tray 8 extends at an upward angle into the surrounding space.

Within the main body casing 4 of the exemplary facsimile device 1, an input image medium transfer roller 9*a*, for transferring the input image medium 2 from the input tray 8, a pressing member 9*b*, contact-type image scanner (CIS) 10, an input image medium pressing member 11, and a pair of input image medium output rollers 12 may be included, for example, below the control panel 6. Below the recording medium supply tray 7, for example, a recording medium supply section 16 is provided. The recording medium supply section 16 may include, for example, a recording medium supply roller 13 and a separating member 15. The recording medium supply roller 13, with the help of the separating member 15, transfers the recording medium 3, one by one, from the recording medium supply tray 7 to the printing section of the facsimile device 1. The separating member 15 presses against the lower circumferential surface of the recording medium supply roller 13 by a compressed member, such as a spring 14, and helps separate one sheet of recording medium from the other sheets. In the exemplary embodiment, the separating member 15 extends at an angle relative to the bottom of the facsimile device 1 and the upper end thereof is pivotable about the lower end thereof. In the exemplary embodiment, a rubber member 15*a* is provided on a surface of the separating member 15 which faces the recording medium supply roller 13.

In the exemplary embodiment of a facsimile device 1 illustrated in FIG. 1, the printing section is provided substantially in the center of the facsimile device 1. The printing section includes, for example, a roller-shaped platen 17, a thermal head 20, a heat sink 19, a spring 18 and an ink cartridge receiving section 22. The thermal head 20 is arranged on the heat sink 19, and during printing, the heat sink 19 presses against the lower surface of the roller-shaped platen 17. When the ink ribbon cartridge 30 is arranged in the ink cartridge receiving section 22, the ink ribbon sheet 23 extends from the supply shaft 32 (FIG. 2) of the ink ribbon cartridge below the roller-shaped platen 17, above the thermal head 20 and further towards the front of the facsimile device before being taken-up by the take up shaft 33 (FIG. 2) of the ink ribbon cartridge 30.

Further, when the ink ribbon cartridge 30 is arranged in the ink cartridge receiving section 22, the ink ribbon cartridge 30 is slightly inclined such that the back end of the ink ribbon cartridge 30 is slightly higher than the front end of the ink ribbon cartridge 30, and the lowest portion of the front portion of the ink cartridge receiving section 22 is closer to the bottom surface of the facsimile device 1 than the lowest portion of the back portion of the ink cartridge receiving section 22. Therefore, the space between the lower surface of the back portion of the ink cartridge receiving section 22 and the bottom of the facsimile device 1 is greater than the space between the lower surface of the front portion of the ink cartridge receiving section 22 and the bottom of the facsimile device 1.

When the ink ribbon cartridge 30 is arranged in the ink cartridge receiving section 22, the left supply spool 50 and the right supply spool 39 are located substantially in the back of the facsimile device 1, while the left take-up spool 40 and the right take-up spool 38 are located substantially in a front-center of the facsimile device 1. In the exemplary embodiment of the facsimile device 1, when the ink cartridge 30 is arranged therein, the left supply spool 50 and the right supply spool 39 are at a level, which is slightly higher than the level of the left take-up spool 40 and the right take-up spool 38, relative to the bottom surface of the facsimile device 1.

In the spaces below the back and front portions of the ink ribbon cartridge 30, a first control board 29*a* and a second control board 29*b* may be respectively arranged. In view of larger amount of space below the back portion of the ink cartridge receiving section 22, the first control board 29*a* may be larger than the second control board 29.

When printing is to occur, the corresponding portion of the ink ribbon sheet 23 along with the recording medium 3 are sandwiched between the platen 17 and the thermal head 20, which presses up against the lower surface of the platen 17. The ink providing surface of the ink ribbon sheet 23 is the upper surface thereof and the ink ribbon sheet 23 may include one or a plurality of color pigments thereon. To print an image, the recording medium 3 is overlapped with the ink providing surface (upper surface) of the ink ribbon sheet 23 and the overlapping sheets are sandwiched between the platen 17 and the thermal head 20 in the printing section of the facsimile device 1. The printing occurs when the thermal head 20 heats the ink on the upper surface of the ink ribbon sheet 23 and causes the ink thereon to melt. The melted ink is pressed onto the recording medium 3 via platen 17, and the melted ink adheres to the recording medium 3.

After the image is printed on the recording medium 3, the recording medium 3 is transferred along an upper surface of a partition plate 27 and is output from a substantially upper-back-center portion of the main body casing 4 via a pair of recording medium output rollers 28. The partition plate 27 is located substantially above the take-up spools 38, 40 and functions as a transfer chute for transferring the printed recording medium out of the internal space of the facsimile device 1. The partition plate 27 guides the recording medium 3 to the pair of recording medium output rollers 28 which transfer the printed recording medium out of the internal space.

With regard to the ink ribbon sheet 23, in the exemplary facsimile device 1, after the image is printed on the recording medium 3, the ink ribbon sheet 23 is bent downward at the top front surface of a tension member 26, and passes by the partition plate 27 before being taken up along a lower back portion of the left and right take-up spools 40, 38. When the ink ribbon sheet 23 bends over the top front surface of the tension member 26 and is pulled by the take-up spools 38, 40, the corresponding portion ink ribbon sheet is separated from the corresponding portion of the recording medium 3.

According to one or more aspects of the invention an ink ribbon cartridge having a frame which, for example, does not require a size of a facsimile device 1, in which the ink ribbon cartridge is accommodated, to be increased because of the frame, while allowing for easier handling thereof, easier replacement attachment/detachment of ink ribbon sheet, and easier attachment/detachment of the ink ribbon cartridge to the image forming device is provided.

As shown in FIGS. 2-7, an exemplary ink ribbon cartridge 30 employing one or more aspects of the invention may include a cartridge frame 31, a supply shaft 32, on which substantially all of the unused portion of the ink ribbon sheet 23 is rolled, and a take-up shaft 33 onto which substantially all of the used portion of the ink ribbon sheet 2 is rolled. In the exemplary embodiment of a cartridge frame illustrated in FIG. 2, the frame 31 has a rectangular-like shape (at least based on substantially the 4 corners thereof). The frame 31 may, however, have another general shape depending on the number of frame members and how they connect together or the shape of each of the members of the frame.

The supply shaft 32 and the take-up shaft 33 are generally at least partially hollow members (e.g., tubular shafts or shafts with hollow ends), such that, at least some portions of the ink ribbon cartridge (e.g., spools, back tension mechanism) may be inserted/stored therein in order to connect the components and/or to reduce an amount of space required by the ink ribbon cartridge and/or image forming device. For example, as discussed below, the compressed spring 52 of the exemplary back tension mechanism is stored in the space within the tubular shaft of the supply shaft 32 in some implementations of one or more aspects of the invention. In other implementations, the compressed spring 52, or other urging member, may be provided inside the outer portion of the rotation member (i.e., shaft portion), such that the urging member or spring does not demand additional space inside the facsimile device.

However, for example, in some implementations of one or more aspects of the invention where the back tension mechanism is not provided or does not utilize an urging member, or in some implementations where an urging member of the back tension mechanism is provided elsewhere, for example, the supply shaft 32 and/or the take-up shaft 33 may be solid members which integrally include portions which are rotatably supported by the frame. Further, in some implementations, for example, instead of utilizing a compressed spring as an urging member, a stretched spring may, for example, be employed between the outer portion of the connecting member arranged substantially on the outside of the cartridge frame and the inner portion of the connecting member arranged substantially inside the area defined by the cartridge frame such that when the connecting member is arranged in a groove of the cartridge frame, the stretched spring pulls the outer portion and the inner portion of the connecting means toward each other.

The cartridge frame 31 includes a pair of bearing members 34*a*, 34*b* and a pair of connecting members 35*a*, 35*b*, which for purposes of description will be identified as left bearing member 34*a*, right bearing member 34*b*, front connecting member 35*a*, and back connecting member 35*b*. The front and back connecting members 35*a*, 35*b* connect the ends of the left bearing member 34*a* and the right bearing member 34*b* together. The front connecting member 35*a* connects the substantially front-end portions of the left and right bearing members 34*a*, 34*b* and the back connecting member 35*b* connects the substantially back-end portions of the left and right bearing members 34*a*, 34*b*. However, the connecting members may be arranged differently in other embodiments.

Further, although two connecting members are illustrated, it is possible to provide a single connecting member and/or more than two connecting members in various implementations of one or more aspects of the invention. In some implementations of an ink ribbon cartridge according to one or more aspects of the invention, a single connecting member along with the left and right bearing members 34*a*, 34*b* may, for example, be sufficient for maintaining the shape of the cartridge during the attachment/detachment process depending, for example, on the strength of the material used for the frame. Similarly, for example, in implementations where the front and back connecting members 35*a*, 35*b* are provided, one of the left or right bearing member 34*a* may include two independent portions (i.e., one portion for supporting the supply shaft and the other for supporting the take-up shaft and no intermediate connector therebetween).

In one exemplary implementation of one or more aspects of an ink ribbon cartridge 30 according the invention, ends of the connecting members 35*a*, 35*b* connect to upper edges of the bearing members 34*a*, 34*b* at substantially end portions thereof and the ink ribbon cartridge has a rectangular-like shape, as shown in FIGS. 2-7. In other implementations, for example, one or both of the connecting members 35*a*, 35*b* may connect, for example, the bottom edges of the bearing members 34*a*, 34*b*. In this exemplary embodiment, the connecting members 35*a*, 35*b* are integrally formed with the left and right bearing members 34*a*, 34*b*. The portions of the bearing members 34*a*, 34*b* which are attached to the connecting members 35*a*, 35*b* at least partially depend on the structures around the ink ribbon cartridge when the ink ribbon cartridge is arranged in the image forming device. In various embodiments of an ink ribbon cartridge according to one or more aspects of the invention, the connecting members 35*a*, 35*b* and the left and right bearing members 34*a*, 34*b* may be made of a resin, such as, polystyrene (PS).

Figure 2:
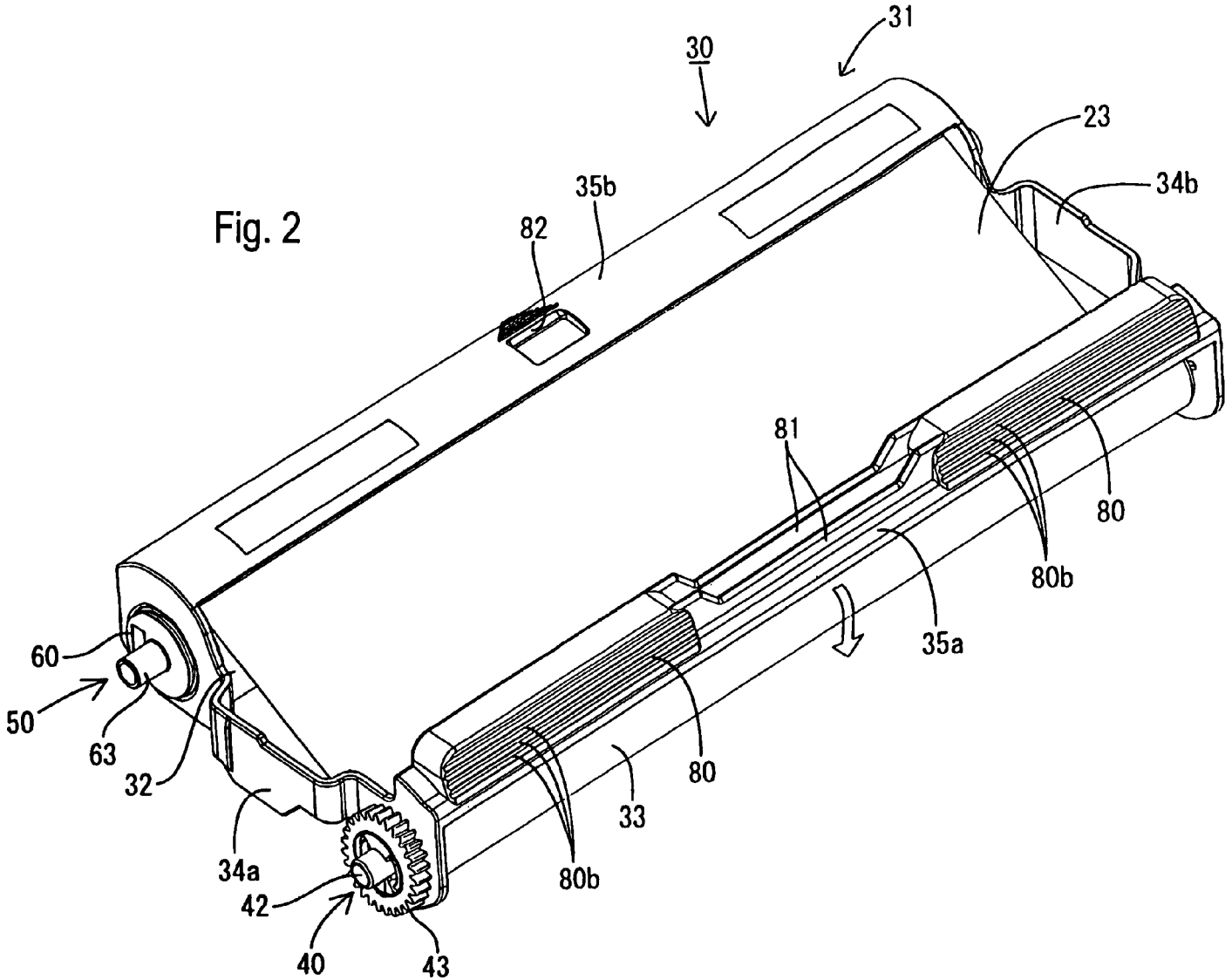
FIG. 2 is a perspective view of an exemplary ink ribbon cartridge employing one or more aspects of the invention.

In the exemplary ink ribbon cartridge illustrated in FIG. 2, the front connecting member 35*a* is supported by and connected to the front upper edges of the bearing members 34*a*, 34*b* and the front connecting portion is substantially above at least a portion of the take-up shaft 33. A pair of grips 80 is provided on the front connecting member 35*a*. The grips 80 project substantially upward from the upper surface of the front connecting member 35*a*. The grips 80 aid in the handling of the ink ribbon cartridge 30 during replacement of an ink ribbon sheet and/or during attachment/detachment of the ink ribbon cartridge 30 to the image forming device. Although two grips are provided in the exemplary embodiment illustrated in FIG. 5, the grips are one aspect of the invention and no grips or one, two or more than two, etc. may be provided in different embodiments of the invention. Further, in some implementations of an ink ribbon cartridge according to one or more aspects of the invention, a grip may be in the form of any generally projecting portion of the frame which is available to hold onto during attachment/detachment of the ink ribbon cartridge and/or during replacement of the ink ribbon sheet.

Figure 24:
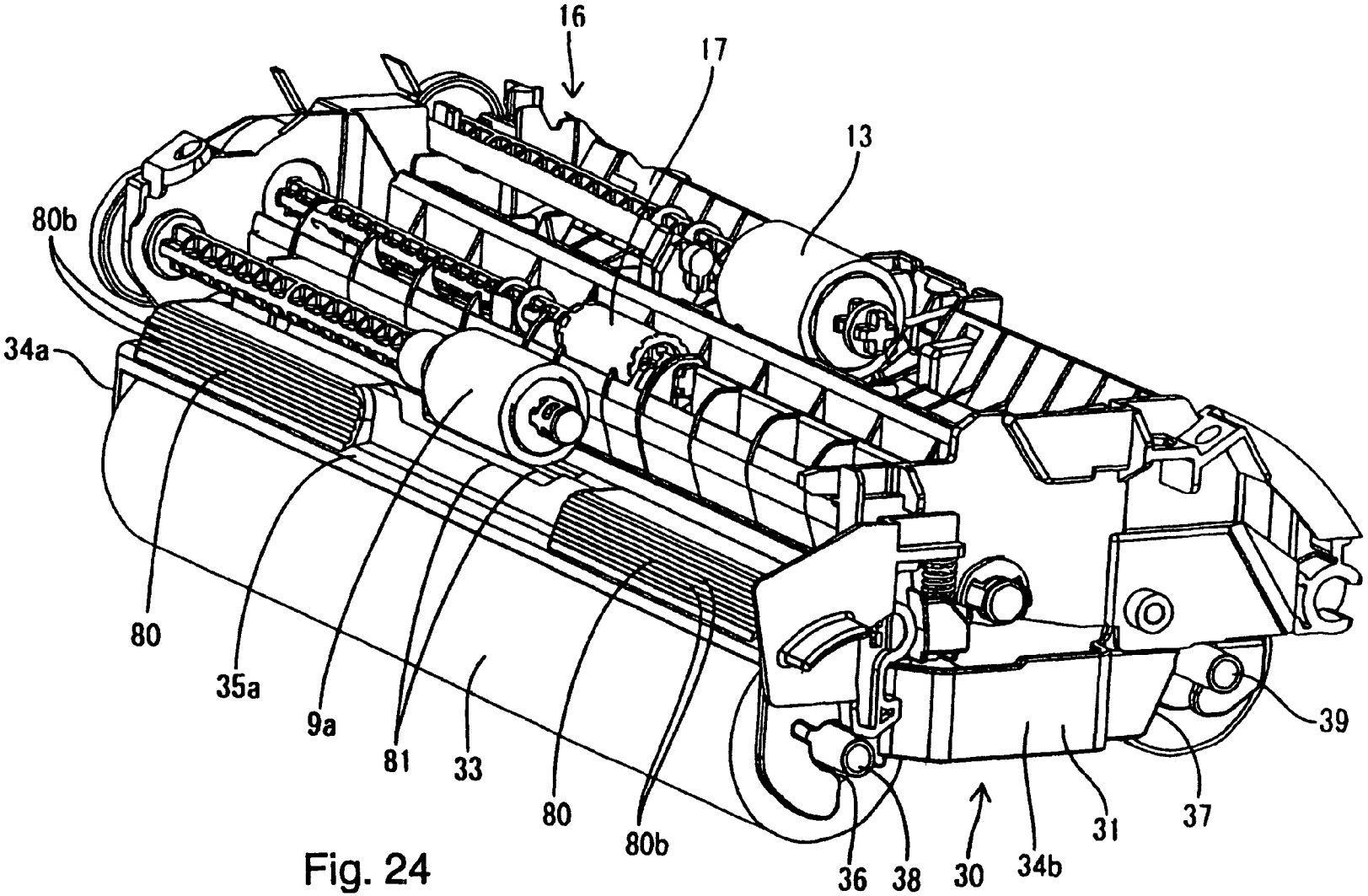
FIG. 24 is a partial cross-sectional view of a portion of an exemplary paper supplying section of an exemplary facsimile device and an exemplary ink ribbon cartridge employing one or more aspects of the invention.

As illustrated in FIGS. 1 and 24, when the ink ribbon cartridge is arranged in the facsimile device, the front connecting member 35*a* is substantially under the input image medium transfer roller 9*a* of the facsimile device 1. In such an exemplary implementation of one or more aspects of the invention, the grips 80 are provided on the sides of the upper surface of the front connecting member such that a center of the upper surface of the front connecting member 35*a* is at a lower level (i.e., a level closer to the bottom surface of the facsimile device). Accordingly, a portion of the input image medium transfer roller 9*a* can be accommodated between the grips 80 to help reduce a size of the facsimile device 1 in which the ink ribbon cartridge may be arranged, while providing a cartridge frame 31 which allows for easier handling of the ink ribbon cartridge 30.

Each grip 80 may be open along a back side thereof such that fingers, for example, may grip around into the open space and grab onto the bottom surface of the grips 80*a* during the attachment/detachment of the ink ribbon cartridge 30 and/or replacement of the ink ribbon sheet 23. Multiple ribs 80*b* may be formed on the front face of the grips 80 to help prevent slipping during of the cartridge during attachment/detachment. In some exemplary implementations, the ribs 80*b* may extend along a direction substantially parallel to the extension direction of the supply and take-up shafts 32, 33. In some exemplary implementations, a pair of support ribs 81 may be provided between the grips 80.

As discussed above, according to one or more aspects of the invention it is desired to provide a cartridge frame 31 which, if necessary, accommodates or works around portions of the image forming device(s) in which ink ribbon cartridge may be employed in order to provide a smaller overall device. Thus, for example, in the exemplary facsimile device 1 and ink ribbon cartridge 30, the cartridge frame 31 accommodates at least a portion of the image medium transfer roller 9*a* between the grips 80, so a maximum height of the support ribs 81 is dependent on the amount of space required by the image medium transfer roller 9*a*. The portion(s) of the upper surface of the front connecting member 35*a* along which the grips 80 are formed, for example, is at least partially dependent on the structures around the ink ribbon cartridge when the ink ribbon cartridge is arranged in the image forming device. Similarly, the shape and size of the other frame components (i.e., back connecting member, left bearing member and right bearing member) may also depend on the surrounding areas of the facsimile device such that efficient use of the internal space can be made and the size of the image forming device may be reduced.

Figure 3:
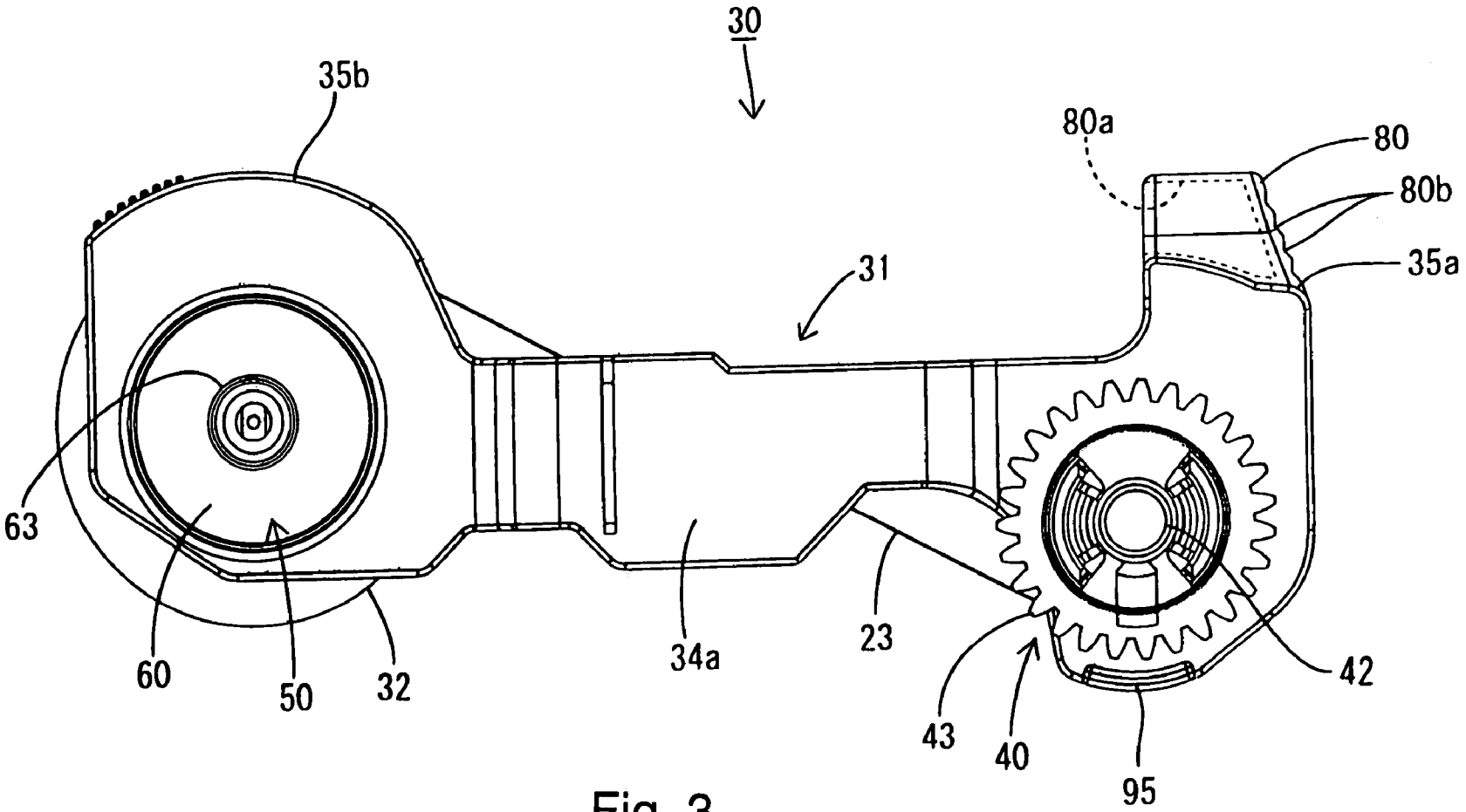
FIG. 3 is a perspective left-side view of the exemplary ink cartridge illustrated in FIG. 2.
Figure 4:
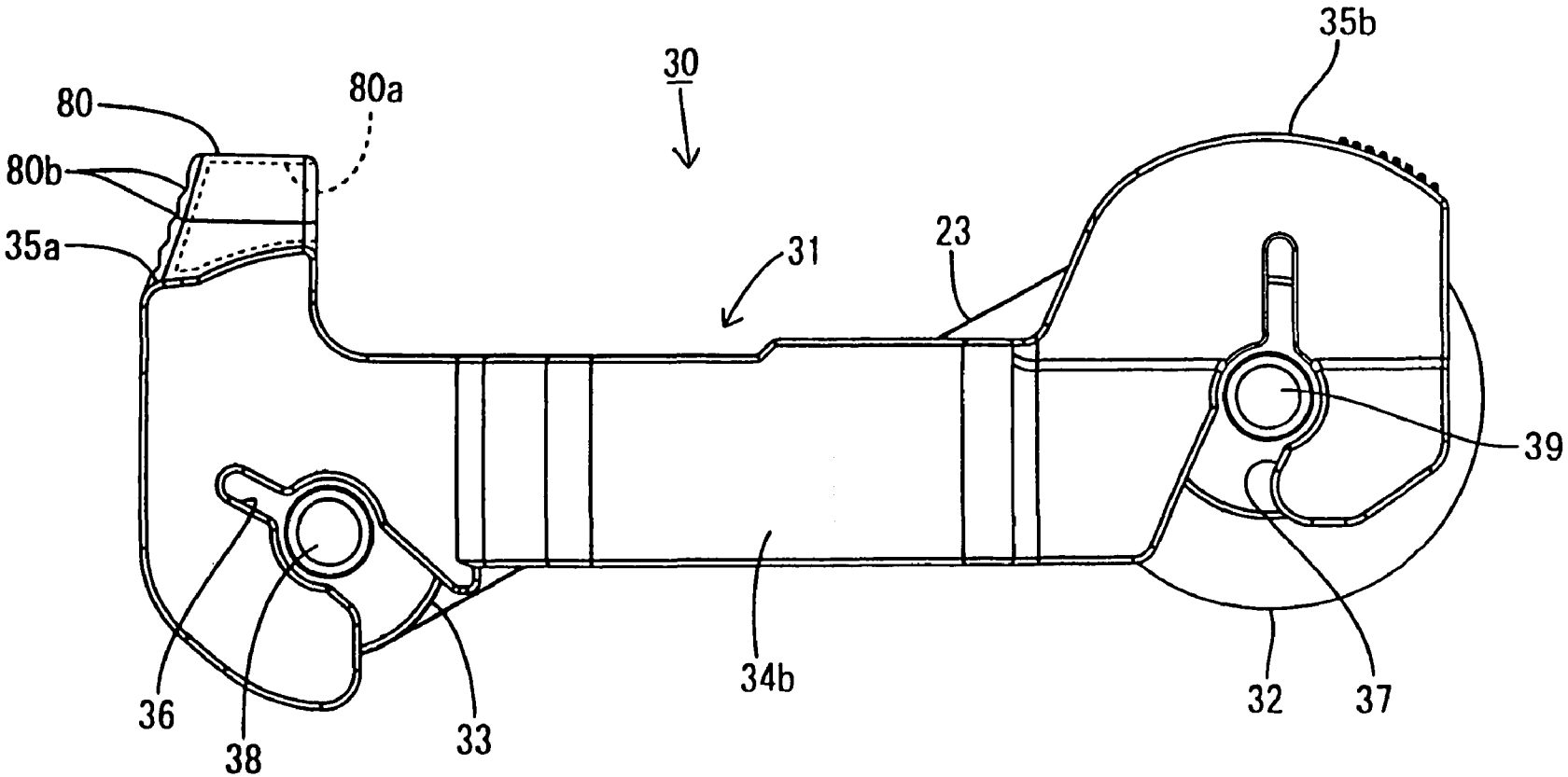
FIG. 4 is a perspective right-side view of the exemplary ink ribbon cartridge illustrated in FIG. 2.
Figure 25:
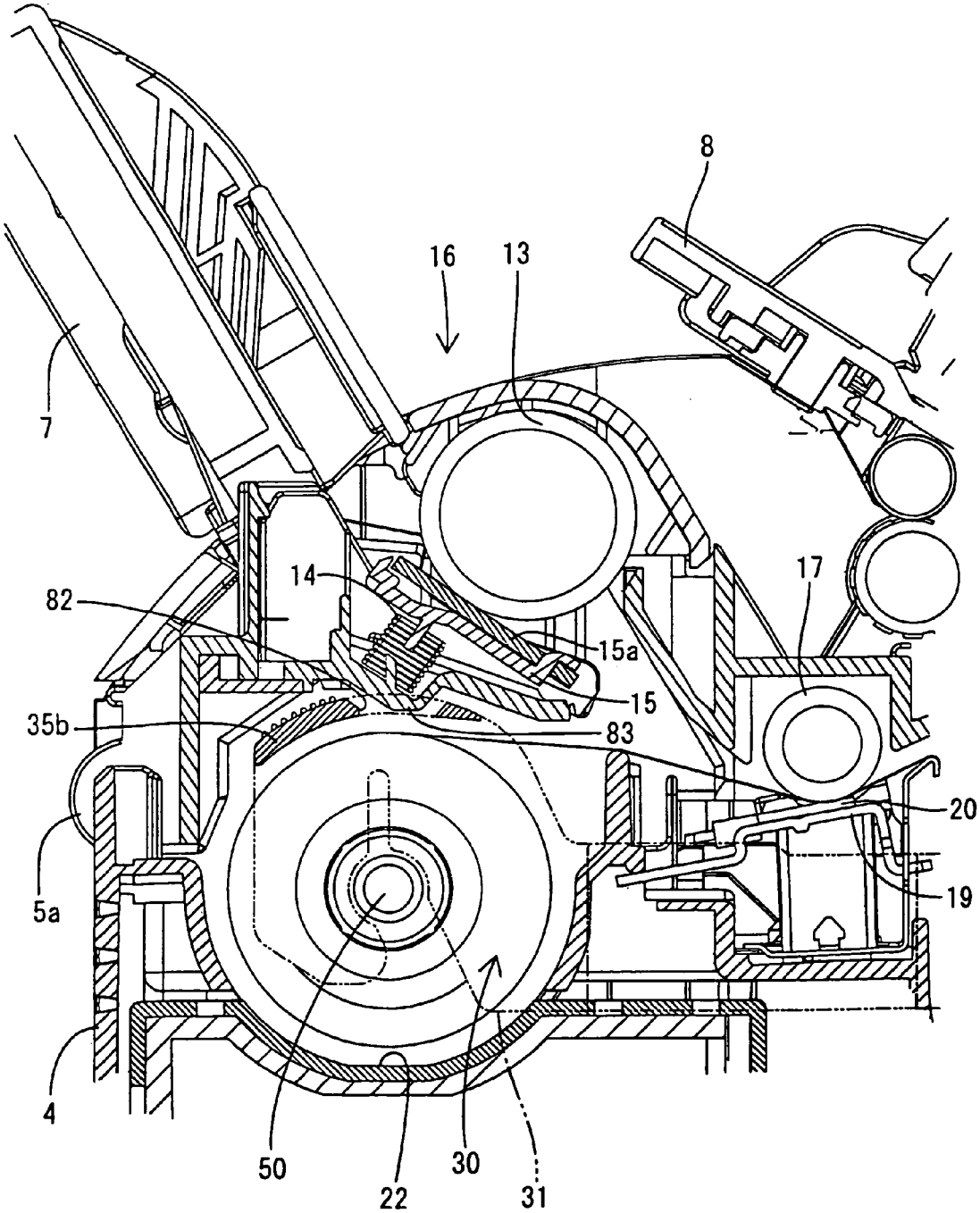
FIG. 25 is an enlarged partial cross-sectional view of the portion of the exemplary paper supplying section and the exemplary ink ribbon cartridge of the facsimile device shown in FIG. 24.

The back connecting member 35*b* is supported by and connected to the back upper edges of the bearing members 34*a*, 34*b* and the back connecting member is substantially above at least a portion of the supply shaft 32. As shown in FIGS. 3 and 4, a cross-section of the back connecting member 35*b* is substantially shaped like an arc and the curve substantially corresponds to the major diameter of the rotating supply shaft 32. The back connecting member 35*b* may include, for example, one or more penetrating holes 82. In the exemplary embodiment illustrated in FIGS. 2-7, the penetrating hole 82 is substantially in a center of the back connecting member 35*b* and is substantially rectangular in shape. As shown in FIG. 25, the penetrating hole 82 allows a portion of the supporting member 83, which supports the spring 14, to be accommodated below the upper surface of the back connecting member 35*b*. In such a case, the height of the facsimile device 1 may accordingly be reduced.

Figure 5:
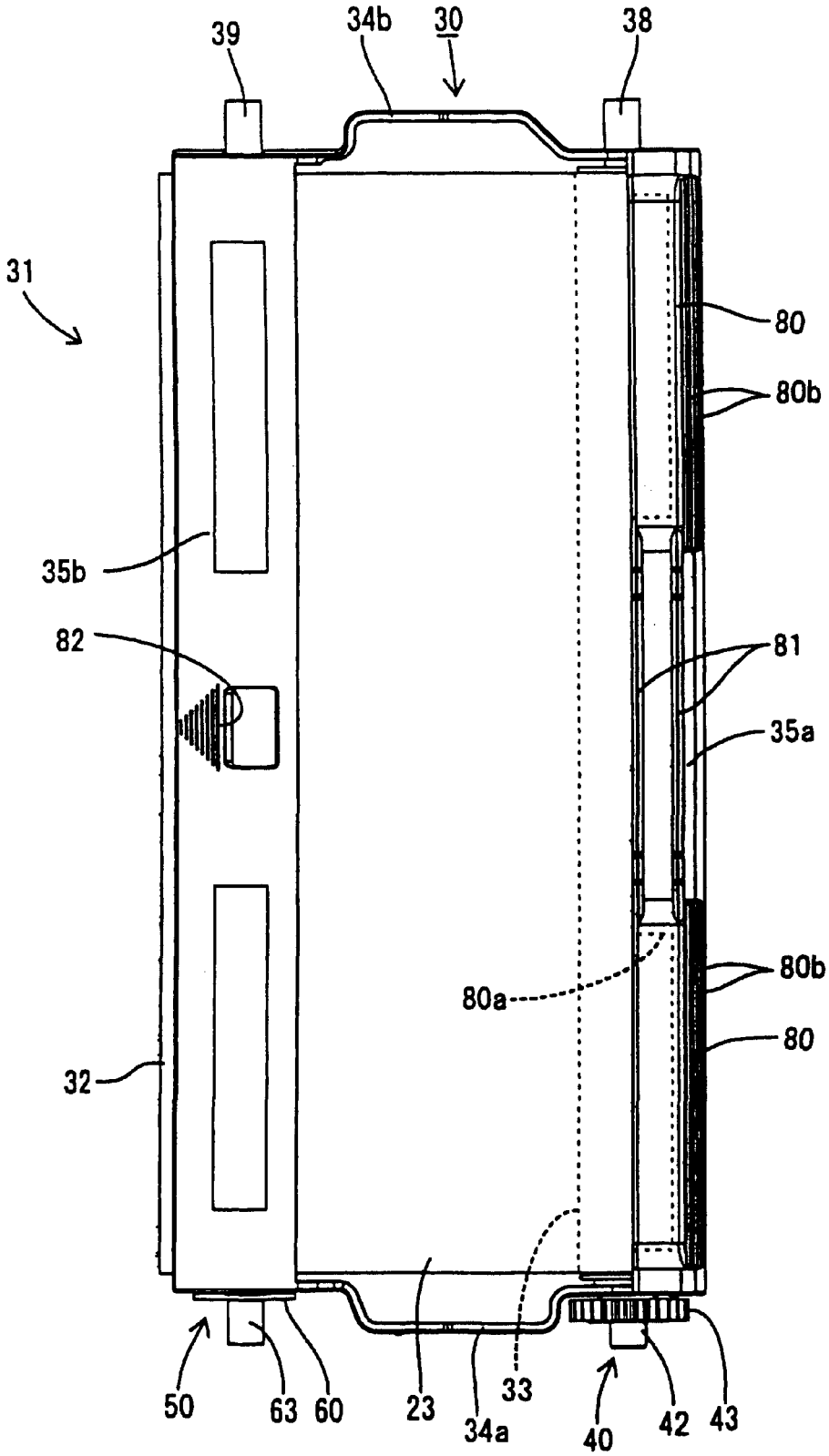
FIG. 5 is a top view of the exemplary ink ribbon cartridge illustrated in FIG. 2.
Figure 6:
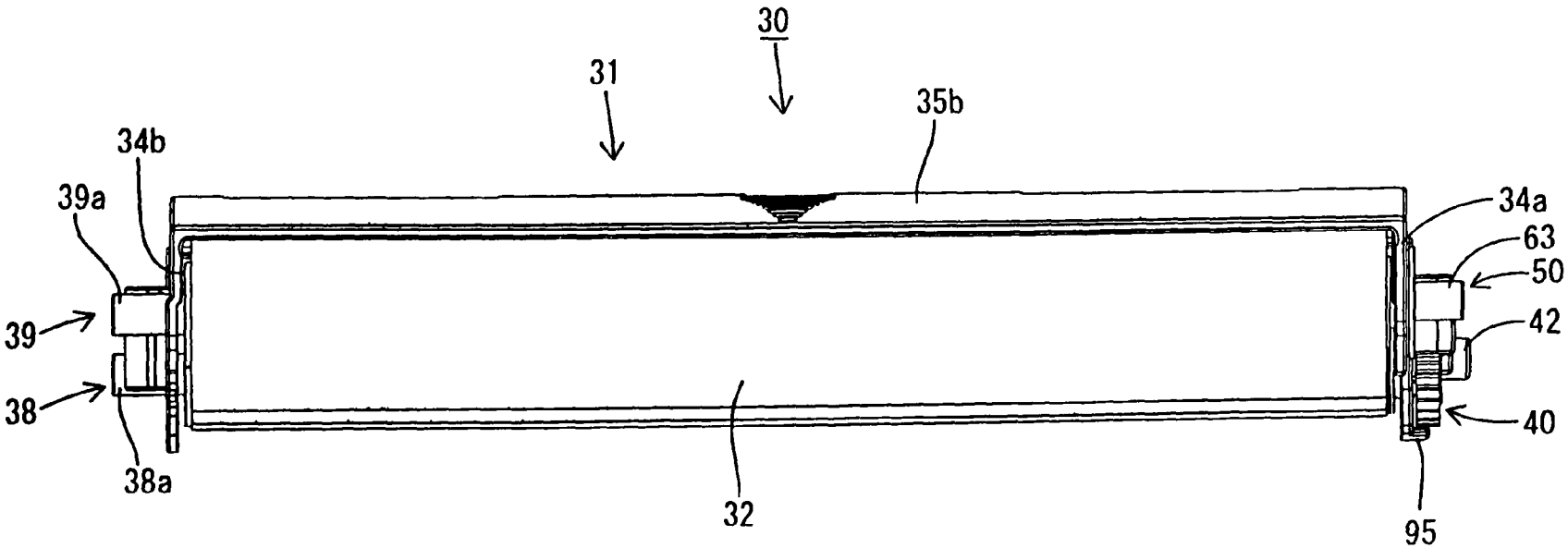
FIG. 6 is a rear view of the exemplary ink ribbon cartridge illustrated in FIG. 2.

In some exemplary implementations of one or more aspects of the invention, a plurality of penetrating holes and/or grooves may be provided along the cartridge frame 31 so as to allow various portions of the facsimile device 1 to be accommodated therein in order to reduce the overall size of the facsimile device so long as the member (e.g., front and back connecting members or left and right bearing members) is still sturdy enough to allow for a stable ink cartridge frame to allow for easier attachment/detachment of the ink cartridge and replacement of the ink ribbon. That is, for example, while a hole or opening 82 is illustrated in FIG. 5, a groove or cut-out portion may be provided along an edge of the member in order, for example, to accommodate a portion of the exemplary facsimile device 1.

As shown in FIGS. 2-8, in the exemplary ink ribbon cartridge frame 31, a portion of the ink ribbon extending between the supply shaft 32 and the take-up shaft 33 is exposed (i.e., not covered by the frame), as is the majority of the front, back and bottom sides thereof. The space between the front edge of the back connecting member 34*b* and the back edge of the front connecting member 35*a* exposes both the top and bottom surfaces of the ink ribbon sheet such that exposed ink ribbon extends across the heat sink 19 and thermal head 20 below the platen 17 during printing.

Figure 26A:
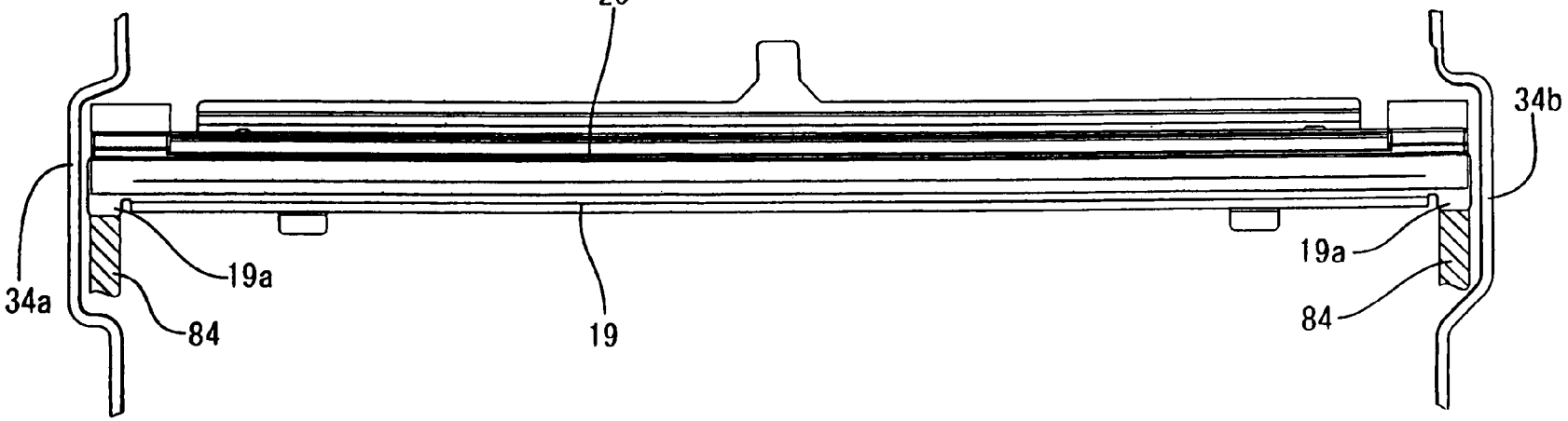
FIGS. 26A and 26B are perspective views of an exemplary heat sink and an exemplary thermal head, respectively, of the exemplary facsimile device shown in FIG. 1.
Figure 26B:
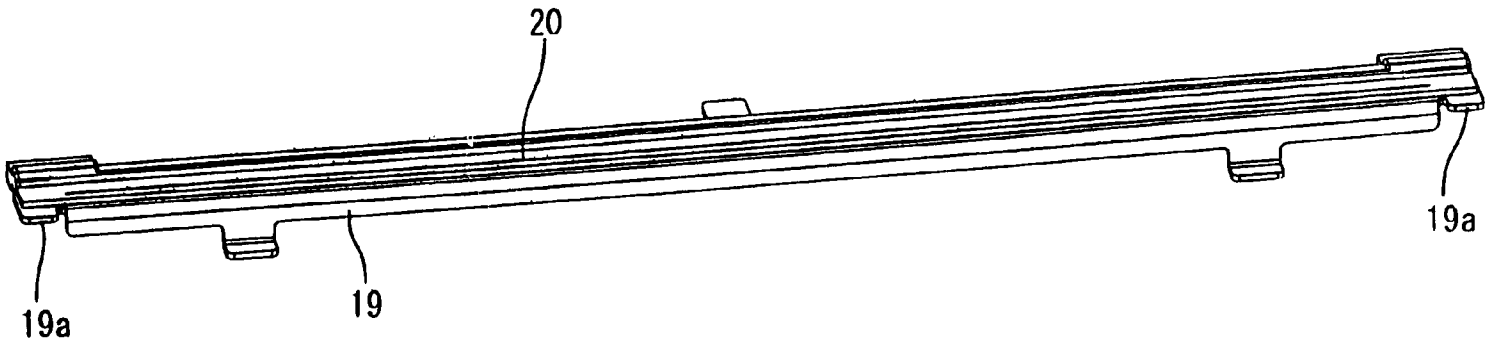
Figure 27:
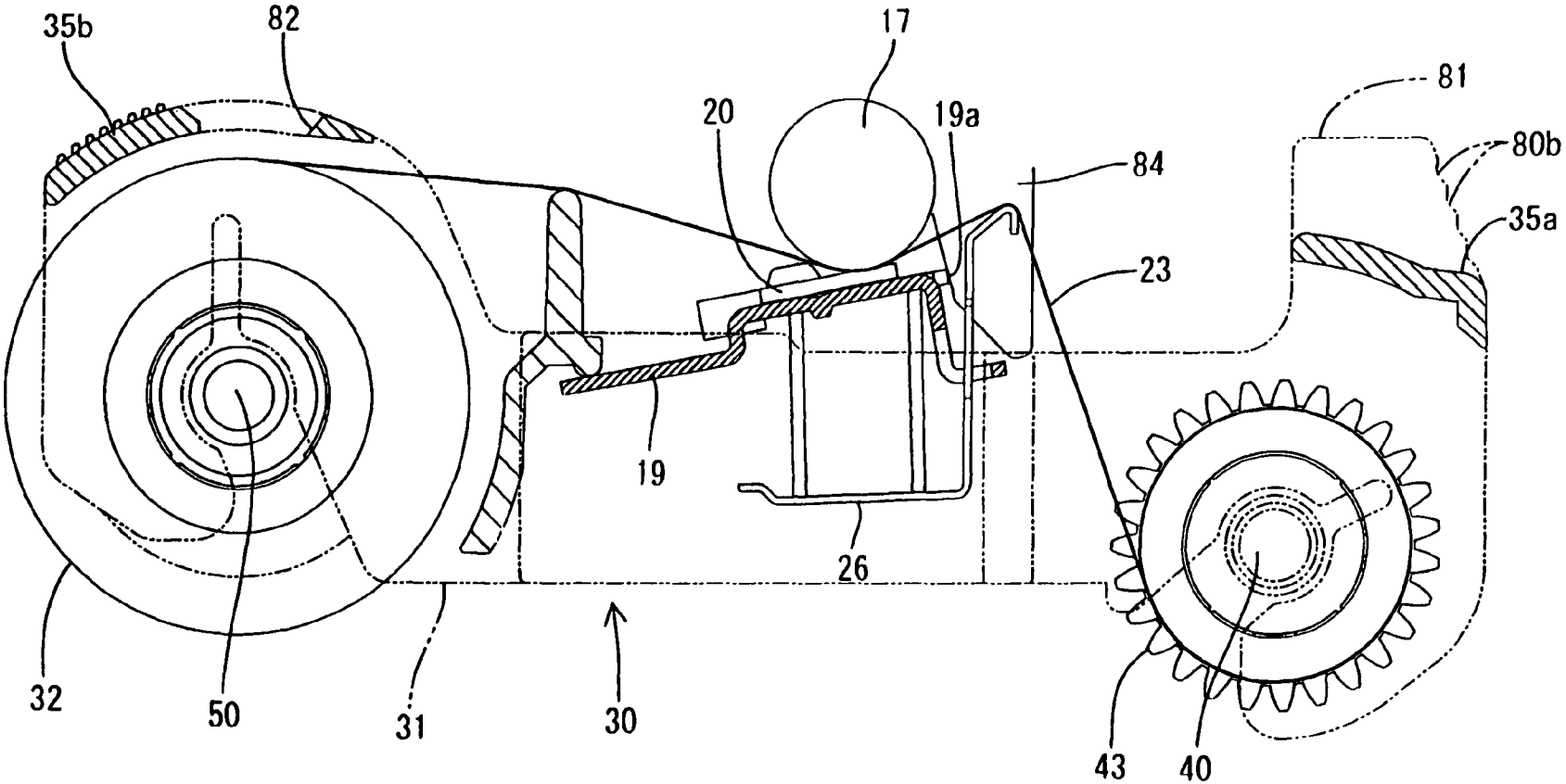
FIG. 27 is a general outline of a cross-section of a portion of a facsimile device and an ink ribbon cartridge employing one or more aspects of the invention.

In the exemplary facsimile device, the thermal head 20 is arranged on the heat sink 19, as illustrated in FIGS. 26A, 26B and 27. The heat sink 19 has approximately a same length as the thermal head 20. In the exemplary facsimile device, projecting sections 19*a* are provided on both ends of the front side of the heat sink 19 and the projecting sections connect to the back of retaining members 84 which are connected to the shaft of the platen 17. The retaining members 84 support the platen 17 over the heat sink 19.

As discussed above, one aspect of the invention provides a cartridge frame to aid in the handling of the ink cartridge without increasing, because of the frame, an overall size of an image forming device in which the ink cartridge is employed. Therefore, for example, in a case where the heat sink 19 and thermal head 20 of the facsimile device are longer than supply shaft 32 and/or take-up shaft 33, for example, a corresponding portion of one or both of the left and right bearing members 34*a*, 34*b* may project outward, as shown in FIG. 26A in order to occupy a portion of available internal space in the facsimile device while providing a substantially sturdy and easy to handle frame.

While the ink ribbon cartridge frame 31 may be extended more than necessary to accommodate for the components of the ink cartridge itself, in order to accommodate the ends of the heat sink 19 and thermal head 20 within the boundaries of the ink cartridge frame 31, the internal space of the facsimile device is more efficiently used and thus, a size of the image forming device employing such an ink ribbon cartridge frame may be reduced.

FIGS. 3, 4, 6 and 8 illustrate exemplary left and right bearing members 34*a*, 34*b* implementing one or more aspects of the invention. As shown in FIG. 4, the right bearing member 34*b* includes a front groove 36 and a back groove 37. The front groove 36 rotatably supports the shaft portion 38*a* of the right take-up spool 38, which is mounted on the right end of the take-up shaft 33, while the back groove 37 rotatably supports the shaft portion 39*a* of the right supply spool 39, which is mounted on the right end of the supply shaft 32.

The front groove 36 and the back groove 37 are formed, for example, by a cutout in the right bearing member 34*b* which corresponds to a portion substantially below the front connecting member 35*a* and the back connecting member 35*b* and the grooves 36, 37 allow the respective portions of the right spools 38, 39 to engage therein from a bottom of the cartridge frame 31. Although the exemplary embodiment of the ink cartridge includes grooves 36, 37 which open to the bottom of the ink cartridge, the grooves 36, 37 may open to the front, back, or upward depending on the other components of the frame (e.g., front and back connecting members 35, 35*b*, left and right bearing members 34*a*, 34*b*, etc.). As shown in FIG. 4, the exemplary right bearing member 34*b* includes a portion with back groove 37 which accommodates the supply shaft 32, a portion with front groove 36 which accommodates the take-up shaft 33, and a projecting portion which, as discussed above, accommodates room for thermal head 20 and the heat sink 19.

Figure 8:
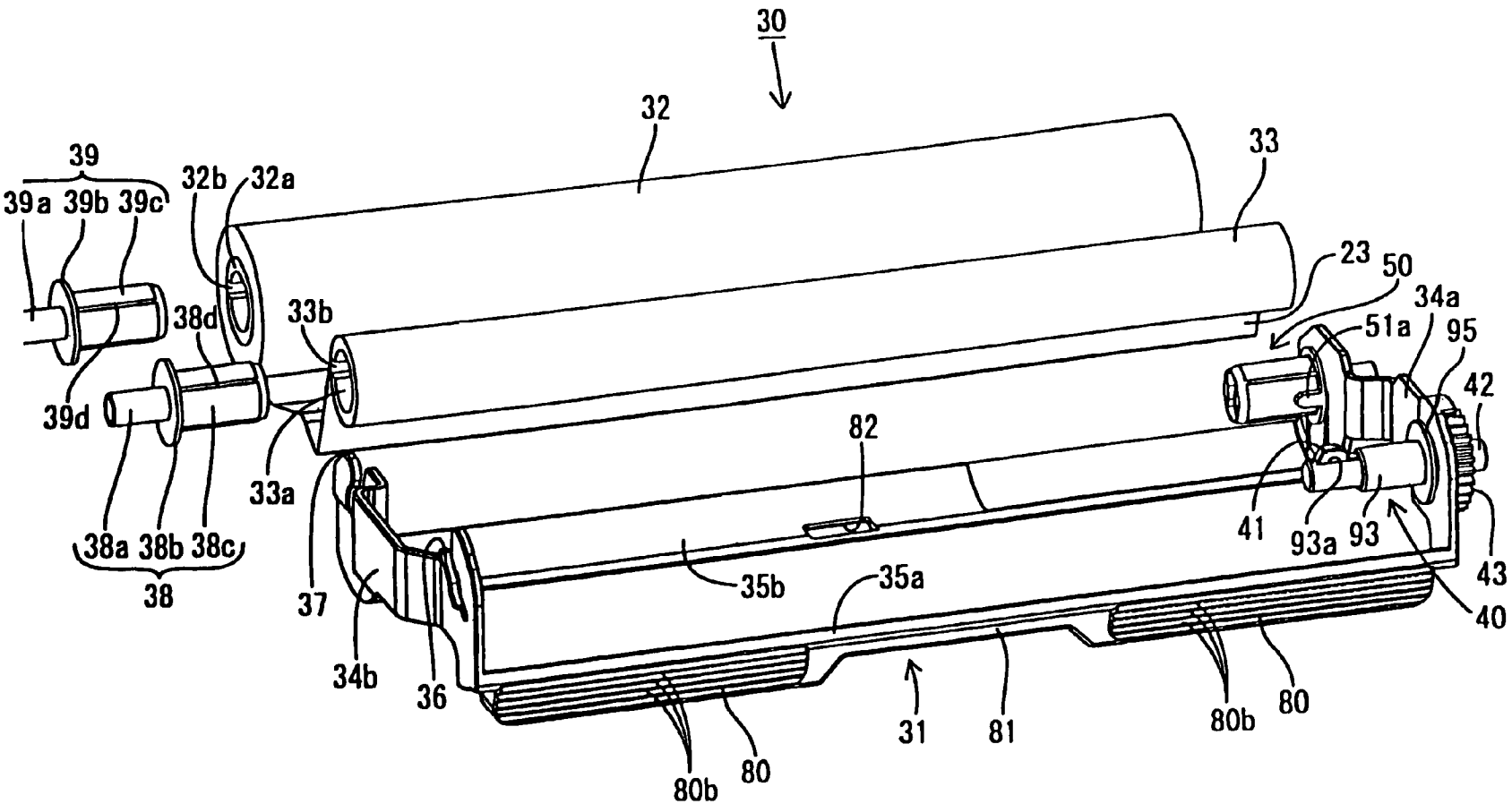
FIG. 8 is a perspective view from the bottom of the exemplary ink ribbon cartridge illustrated in FIG. 2 with an exploded view of an exemplary embodiment of a supply spool employing one or more aspects of the invention.
Figure 9:
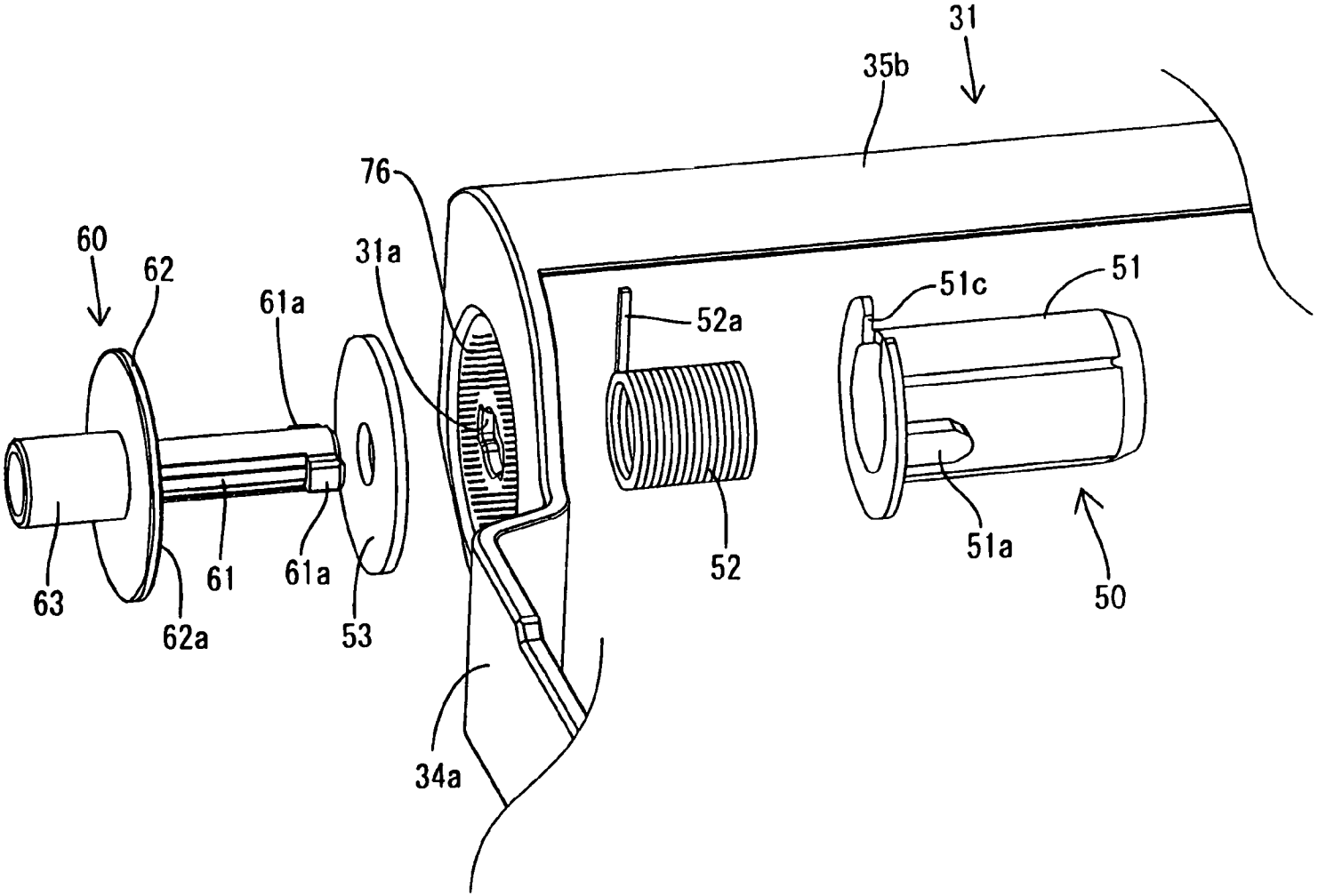
FIG. 9 is an exploded view of the exemplary supply spool illustrated in FIG. 8.
Figure 19:
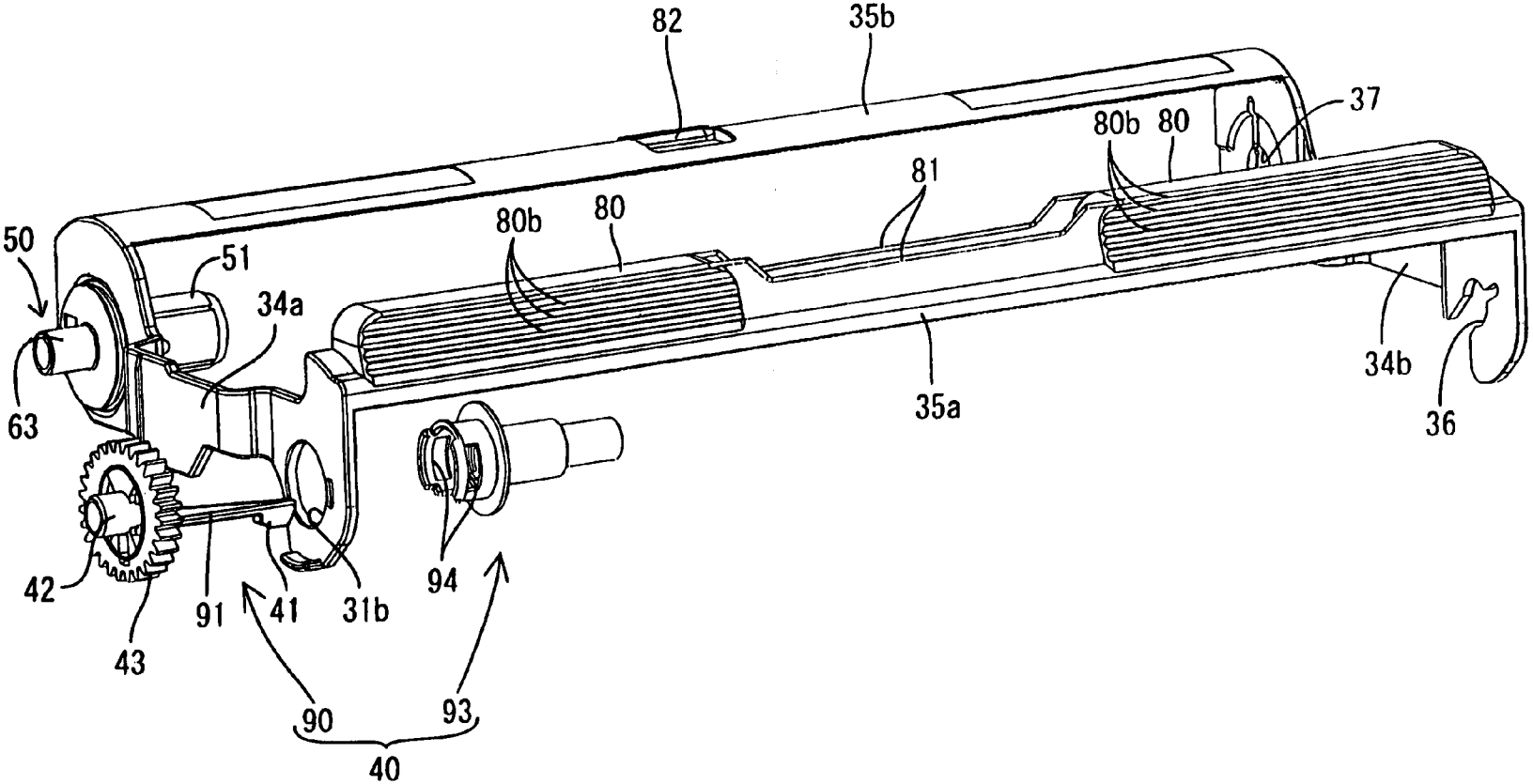
FIG. 19 is a perspective view from a position in front of and slightly to the left of the portion of the exemplary ink ribbon cartridge illustrated in FIG. 18.

An exemplary embodiment of a left bearing member 34*a* will be described with reference to FIGS. 2, 3, 8 and 9. In the exemplary embodiment, the left bearing member 34*a* is arranged substantially parallel to the right bearing member 34*b* at an opposite end of the supply shaft 32 and take-up shaft 33. As shown in FIG. 8, at positions substantially opposite to the front-groove and the back groove 37 of the right bearing member 34*b*, the opposite ends of the supply shaft 32 and take-up shaft 33 are connected to the left bearing member 34*a*. As shown in FIGS. 9 and 19, holes 31*a* and 31*b* are provided in the left bearing member. Although holes are illustrated in the exemplary left bearing member, grooves may be provided instead and/or a combination of grooves and holes, for example, may be provided. The exemplary left bearing member 34*a* includes a portion with back hole 31*a* which accommodates the supply shaft 32, a portion with front hole 31*b* which accommodates the take-up shaft 33, and a projecting portion which, as discussed above, accommodates room for thermal head 20 and the heat sink 19.

The projecting portion of both the left and right bearing members 34*a*, 34*b* may extend outward in a substantially "u"-like manner with a relatively flat base, as shown in FIG. 2, for example. In some embodiments, the projecting portion may not have a substantially "u" like shape as the projecting portion may bend downward, upward and/or outward to make efficient use of the internal space of the facsimile device in which the ink cartridge is accommodated while providing an improved ink cartridge. Further, the projecting portion of the left and right bearing members 34*a*, 34*b* may have different heights and/or widths depending on the required strength of the member and/or the shape of the internal space of the facsimile device in which it is accommodated.

Figure 7:
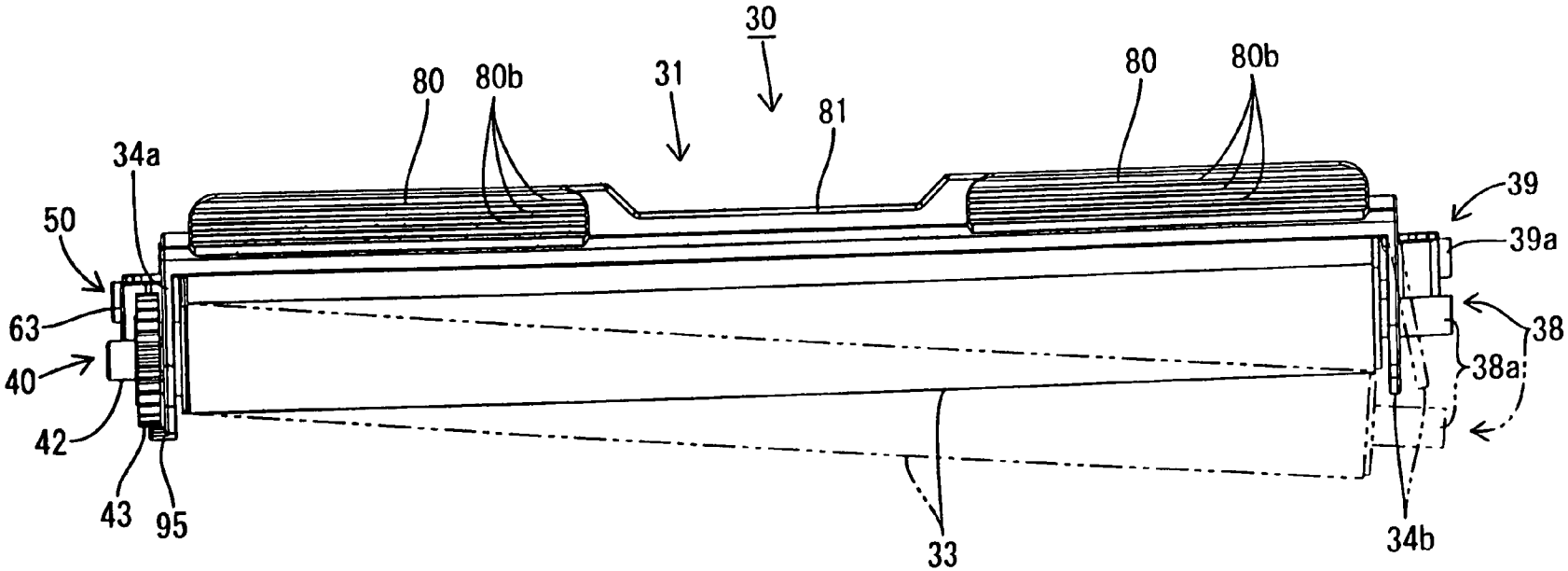
FIG. 7 is front view of the exemplary ink ribbon cartridge illustrated in FIG. 2.

As shown in FIG. 7, the right take-up spool 38 and right the supply spool 39 may be attached and detached to the cartridge frame 31 via the front groove 36 and back groove 37. In the exemplary right take-up and supply spools, the right take-up and supply spools 38, 39 are one-piece members. However, the right take-up and supply spools 38, 39 may be formed of multiple connected pieces, as long as their connections are secure enough not to unintentionally separate. When the right take-up and supply spools 38, 39 of the exemplary implementation of one or more aspects of the invention are disengaged from the respective groove 36, 37, the take-up shaft 33 and/or the supply shaft 32 may be removed from a bottom side of the cartridge frame 31.

As illustrated in FIG. 8, a right take-up spool 38 and a right supply spool 39 connect to the right ends of the take-up spool 33 and supply shaft 32, respectively. In the exemplary embodiment illustrated, the right take-up spool 38 is substantially identical to the left take-up spool 39 and thus, the right take-up spool 38 and the right supply spool 39 may be interchanged and/or positioned at opposite ends of the ink ribbon cartridge, for example. The right take-up spool 38 and the right take-up spool 39 include shaft portions 38*a*, 39*a*, and substantially disk-shaped portions 38*b*, 39*b*, and spool portions 38*c*, 39*c* which are inserted into the right ends of take-up shaft and supply shaft, respectively. The shaft portions 38*a*, 39*a* and the spool portions 38*c*, 39*c* lie along a substantially same axis as the axis of rotation of the take-up shaft 33 and supply shaft 32, respectively. In the exemplary embodiment, the shaft portions 38*a*, 39*a* are the portions of the right take-up spool 38 and right supply spool 39 which are inserted into the front and back grooves 36, 37, respectively. The shaft portions 38*a*, 39*a* are rotatably supported by the right bearing member 34*b*, via the front and back grooves 36, 37, respectively. The disk-like portions 38*d*, 39*d* lie along a plane substantially parallel to portions of right bearing member 34*b* which include front and back grooves 36, 37. When the spool portions 38*c*, 39*c* are inserted into the corresponding tubes 33*a*, 32*a* of take-up and supply shafts 33, 32, respectively, the disk-like portions 38*b*, 39*b* which have a diameter larger than an internal diameter of the tubes 33*a*, 32*a*, serve to block the rest of the spools 38, 39 from going into the tubes 33*a*, 32*a*.

Engaging projections or rib-like members 38*d*, 39*d* are provided on an outer circumferential surface of the spool portion 38*c*, 39*c* of the right take-up spool 38 and right supply spool 39, respectively. These engaging projections 38*d*, 39*d* contact the inner surface of the corresponding shaft tubes 32*a*, 33*a*. The supply shaft tube 32*a* and the take-up shaft tube 33*a* are each capable of expanding a little to grip the spools 38, 39. That is, the take-up shaft tube 33*a* and the supply shaft tube 32*a* are capable of expanding a little in view of the corresponding slits 32*b*, 33*b*, for example, on corresponding portions of the take-up shaft 33 and supply shaft 32 when the take-up spool 38 and the supply spool 39 are inserted into the right end of the take-up shaft 33 and supply shaft 32, respectively. The outer diameter of the spool portion along these engaging projections 38*d*, 39*d* is slightly larger than the inner diameter of the take-up shaft 33 and supply shaft 32.

When the spool portions 38*c*, 39*c* are inserted into the right ends of the shaft tubes 32*a*, 33*a*, the right take-up spool 38 and the right supply spool 39 are connected with the take-up shaft 33 and supply shaft 32 such that each of the spool portions 38*c*, 39*c* rotates along with the corresponding shaft 33, 32, respectively. That is, the engagement of the take-up spool 38 with the take-up shaft 33 via the engaging projections 38*d* of the take-up spool 38*c* causes the take-up shaft 33 and the take-up spool to be attached such that they rotate together and do not rotate independently of each other. Similarly, the engagement of the right supply spool 39 with the supply shaft 32 via the engaging projections 39*d* of the supply spool 39*c* causes the supply shaft 32 and the supply spool to be attached such that they rotate together and do not rotate independently of each other. In this exemplary implementation of one or more aspects of the invention, the right take-up spool 38 and the right supply spool 39 are attachable/detachable to the respective shafts 33, 32.

The left ends of the supply shaft 32 and take-up shaft 33 are connected to the left bearing member 34*a* via the left supply spool 50 and the left take-up spool 40, respectively. As discussed below, respective spool portions 93, 51 of the left take-up spool 40 and left supply spool 50 are inserted into and connect with the respective tubes 33*a*, 32*a* of the supply shaft 33 and take-up shaft 32 such that the spools 50, 40, which are rotatably supported by the holes 31*a*, 31*b* of the left bearing member 34*a*, are connected to the supply shaft 32 and take-up shaft 33, respectively. When connected to the supply shaft 32 and take-up shaft 33, the supply and take-up spools 50, 40 rotate with their corresponding shafts such that the supply spool 50 does not rotate independently of the supply shaft 32 and the take-up spool 40 does not rotate independently of the take-up shaft 33.

The take-up shaft, including right and left take-up spools 38, 40 and the supply shaft, including right and left supply spools 39, 50 are rotatably supported by the right and left bearing members 34*b*, 34*a*, respectively. As shown in FIG. 8, an input gear 43 is provided with the left take-up spool 40. An output gear (not shown), which is driven by a driving force of a drive motor (not shown) of the facsimile device 1, meshes with the input gear 43. The take-up shaft 33, along with the right and left take-up spools 38, 40 rotate together when a driving force is supplied to the input gear 43 on the left take-up spool 40. The right and left supply spools 39, 50 are also driven by the driving force applied to the take-up shaft (i.e., when the take-up shaft rotates and pulls the ink ribbon sheet 23, the supply shaft also rotates another portion of the unused ink sheet).

Next, an exemplary embodiment of the left supply spool 50 including a relatively compact back tension mechanism according to one or more aspects of the invention will be described. The left supply spool 50 includes, for example, a rotation member 60, an intermediate member 53 (e.g., felt member, rubber member), a compressed spring 52, and a spool portion 51. The rotation member 60 includes, for example, a shaft portion 63, a disk portion 62, a shaft insert portion 61 and a pair of engaging projections 61*a*. As shown in FIGS. 5 and 9, at a position substantially opposite to the back groove 37 of the right bearing member 34*b*, the shaft insert portion 61 of the rotation member 60 of the left supply spool 50 is inserted into and rotatably held by the left bearing member 34*a*. In the exemplary embodiment, the spool portion 51 is substantially cylindrical in shape.

Figure 10:
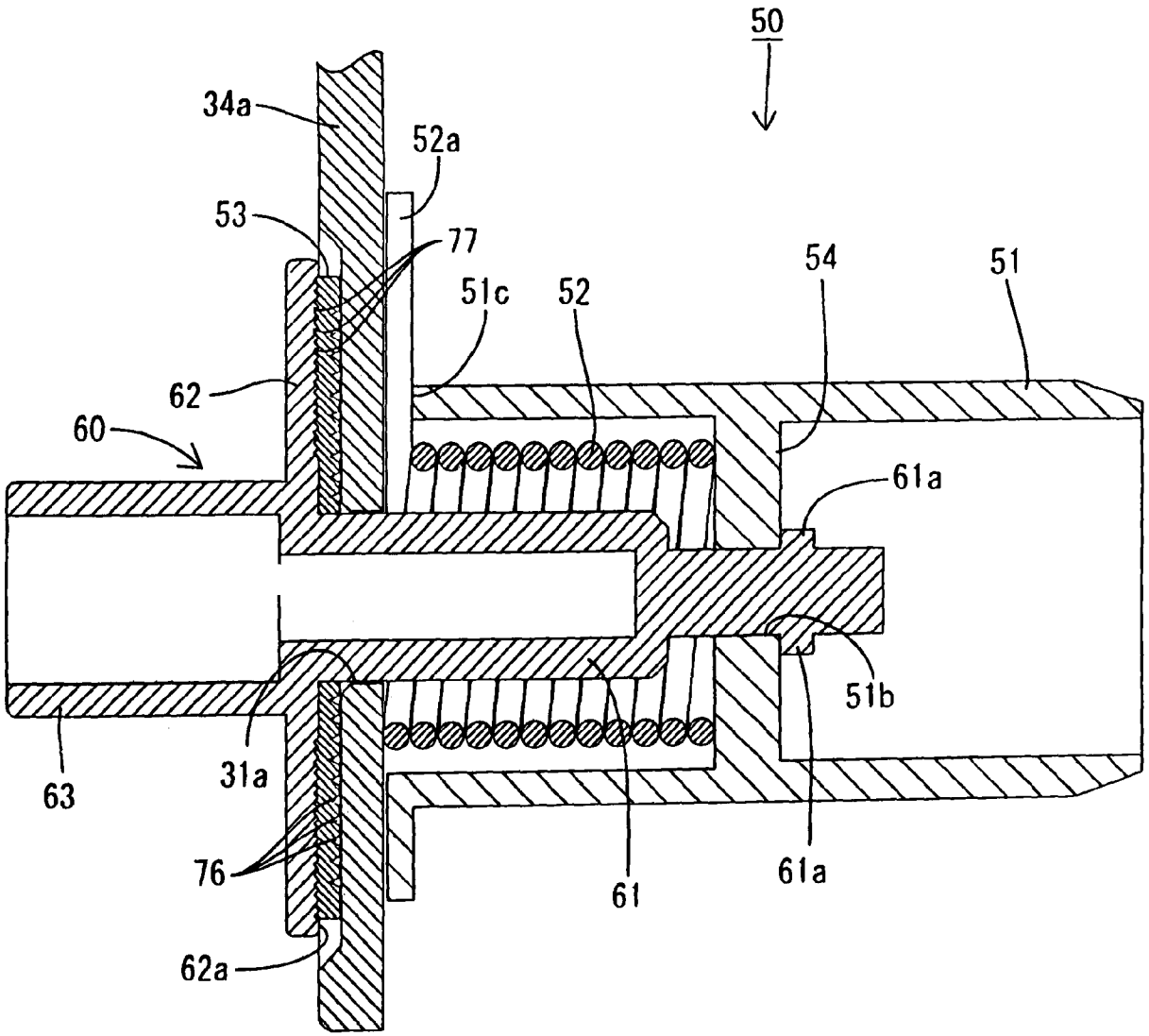
FIG. 10 is a cross-sectional view of the exemplary supply spool illustrated in FIG. 8.

In one exemplary implementation of one or more aspects of the invention, the compressed spring 52 is stored in the spool portion 51, as shown in FIG. 10, and the spool portion 51, including the compressed spring 52. In the exemplary implementation, the spool portion 51 and the compressed spring 52 are arranged on the inner side (i.e., side facing right bearing member 34*b*) of the left bearing member 34*a*, while the intermediate member 53 and a majority of the rotation member 60 are respectively arranged from the outer surface of the left bearing member 34*a*. By storing the compressed spring 52, as an urging means for pressing the corresponding surfaces of the left bearing member 34*a* and the inner surface 60*a* of the rotation member 60 together, the size of the ink ribbon cartridge and/or the image forming device employing the ink ribbon cartridge can be reduced.

Figure 11:
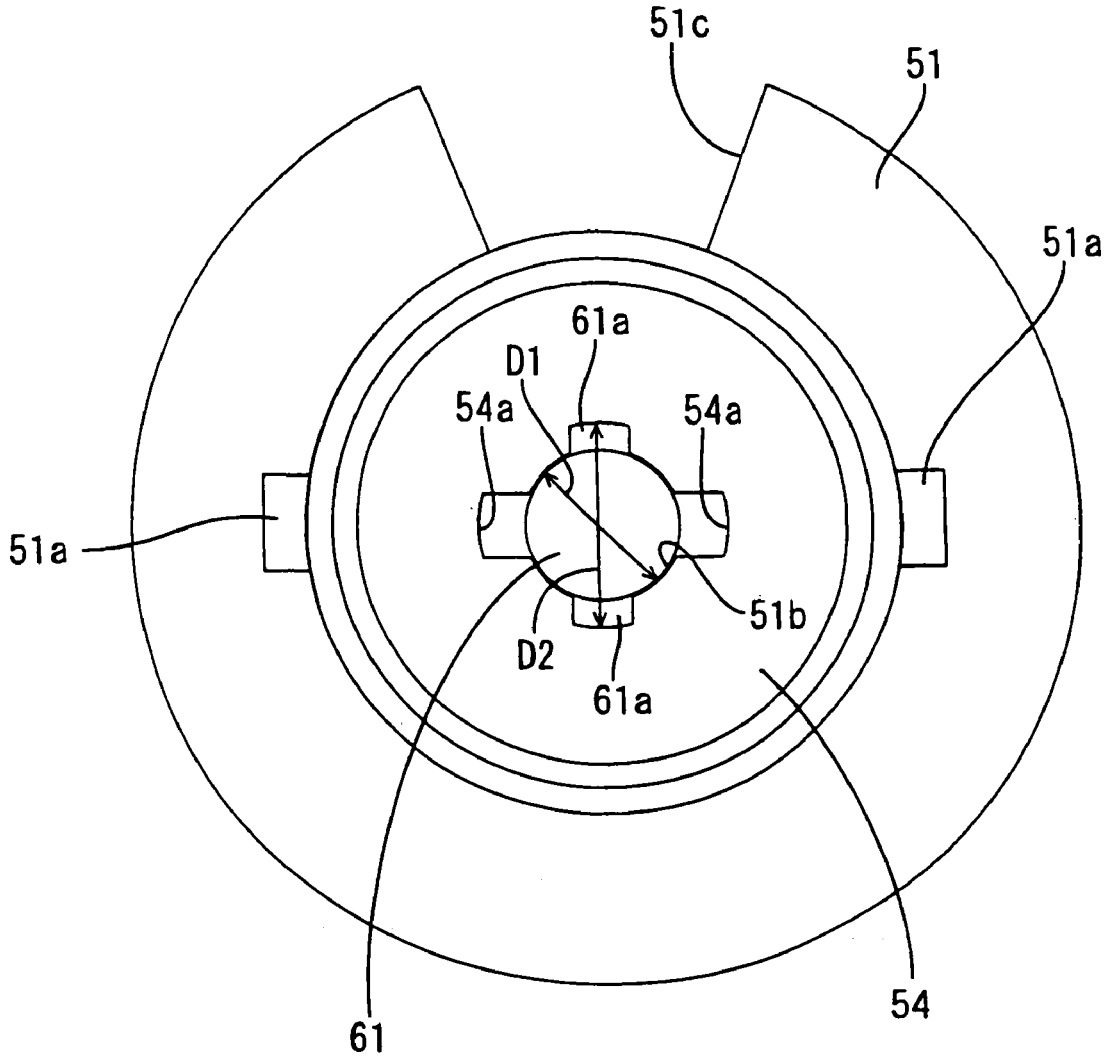
FIG. 11 is a side view of the exemplary supply spool illustrated in FIG. 8.

FIG. 10 shows a cross-sectional side view of an exemplary embodiment of the left supply spool 50. As discussed above, the back tension mechanism applies a back tension to the ink ribbon sheet 23 in order to help reduce wrinkling/loosening of the ink ribbon sheet 23. The exemplary spool portion 51 includes a partition wall 54, an insert port 51*b*, engaging projections 61*a*, engaging groove 51*c*, and slots 54*a* (FIG. 11). The interior space of the spool portion 51 is partially divided by the partition wall 54 which extends substantially at a center portion of the spool portion 51 along a direction substantially perpendicular to the insert direction such that two substantially cylindrical internal portions are defined. The partition wall defines an insert port 51*b* and slots 54*a*, and extends from the inner circumference of the spool portion 51 into the inner space of the spool portion. The ends of the partition wall define a substantially circular opening (i.e., insert port 51*b*) in substantially a center of the inner space of the spool portion 51. Portions of the partition wall extend into the inner space of the spool portion 51 a shorter amount and define the slots 54*a* along the outer circumference of the insert portion 51*b*.

The shaft insert portion 61 of the rotation member 60 is inserted into the insert port 51*b* and the engaging projections 61*a*, which are provided close to the end of the shaft insert portion 61, are inserted into corresponding slots 54*a* of the spool portion 51. When the shaft insert portion 61 is inserted into the insert port 51*b*, if the engaging projections are aligned with the corresponding slots 54*a*, the engaging projections 61*a* pass through the corresponding slots 54*a*. After the engaging projections pass through the slots and the intermediate member is sandwiched between the inner surface 62*a* of disk portion 62 and the outer surface of the corresponding portion (e.g., portion of left bearing member around the opening 31*a*) of the left bearing member 34*a*, the rotation member is rotated such that the engaging projections 61*a* are not in alignment with the corresponding slots 54*a* and the rotation member 60 is attached to the spool portion 51, because the engaging projections 61*a* are blocked by the partition wall 54. Further, the above mentioned compressed spring 52 exerts a force which pushes the partition wall 54 towards the engaging projections 61*a* and away from the inner surface of the left bearing member 34*a*. As shown in FIG. 10, the compressed spring 52 is arranged inside the internal space of the spool portion 51 between the partition wall 54 and the left bearing member 34*a*. Thus, in the exemplary implementation of one or more aspects of the invention, by providing the compressed spring 52 in the internal space of the spool portion 51, a size of the ink ribbon cartridge 30 may be reduced.

As shown in FIGS. 9 and 11, engaging projections 51*a* are provided on an outer surface of the spool portion 51. These engaging projections 51*a* engage with corresponding slits 32*b* formed in the supply shaft 32 and thus, the supply shaft 32 and the spool 51 portion are connected such that they rotate together and neither can rotate without the other.

The spool portion 51 includes a groove 51*c* along a flange-like collar which projects from the external surface of the spool potion 51 at an end thereof which is substantially adjacent to the inner surface of the left bearing member 34*a* when the spool portion is arranged, as illustrated in FIG. 10. The outer surface of the collar-like portion substantially abuts the inner surface of the left bearing member 34*a* when the left supply spool 50 is arranged in the ink ribbon cartridge 30. The collar-like portion includes an engaging groove 51*c* which engages with a protruding end portion 52*a* of the compressed spring 52 and thus, the compressed spring 52 rotates along with the spool portion 51 and neither rotates without the other.

In the exemplary implementation of one or more aspects of the invention illustrated, the rotation member 60 includes a disk portion 62, a shaft insert portion 61 and a shaft portion 63, which is substantially cylindrical. As discussed above, an inner surface 62*a* of the disk portion 62 faces the left bearing member 34*a* when the shaft insert portion 61 is inserted into the spool portion 51. The shaft insert portion 61 protrudes from substantially the center of the disk portion surface 62*a* in a direction substantially perpendicular to the plane of the disk portion 62. The exemplary shaft portion 63 protrudes from substantially the center of the outer surface of disk portion 62 in an outward direction relative to the ink ribbon cartridge 30, and has a substantially hollow inner cylindrical space. When the ink ribbon cartridge 30 is arranged in the facsimile device 1, a shaft portion (not shown) from another component of the facsimile device 1 is inserted into the space inside the shaft portion 63 such that the shaft portion 63 is engagingly supported therewith.

In some exemplary implementations of one or more aspects of the invention, it may be desired to provide a rotation member 60 made, for example, of a resin which is harder than the resin material from which the cartridge frame 30 is made. In other implementations, it may be desired to provide a rotation member 60 made, for example, of a resin which is softer than the resin material from which the cartridge frame 30 is made. Thus, in such cases, for example, polyacetal (POM) may be used for the member which is desired to be harder (e.g. cartridge frame or rotation member) while a softer resin, such as polystyrene (PS) may be used for the other. Of course, the same resin material may be used, as well, depending on the cost, etc.

As discussed above, the shaft insert portion 61 of the rotation member 60 is inserted into a back bearing hole 31*a* in the left bearing member 34*a* portion of the cartridge frame 30 and the end of the shaft insert portion 61 is inserted into the insert port 51*b* of the spool portion 51. As discussed above, the exemplary shaft insert portion 61 includes a pair of engaging projections 61*a* which are arranged on the outer surface thereof substantially close to the inner tip. As shown in FIG. 11, the shaft insert portion 61 has a central diameter which is slightly smaller than an internal diameter D1 of the insert port 51*b* such that the shaft insert portion 61 may be inserted into the insert port 51*b*. The distance D2 between the opposing ends of opposing slots 61*a* is larger than the internal diameter D1 of the insert port 51*b*. As discussed above, after the shaft insert portion 61 of the rotation member 60 is inserted into the insert port 51*b* of the spool portion 51, the shaft insert port 61 and the spool portion 51 are rotated relative to one another such that the engaging projections 61*a* engage with the partition wall 54 which defines the insert port 51*b*. The position of the rotation member 60 relative to the spool portion 51 is thereby regulated.

The compressed spring 52 is compressed and deformed when it is arranged in the spool portion 51 and, as discussed above, the protruding end portion 52*a* of the compressed spring 52 engages with the engaging groove 51*c* of the spool portion 51 and the other end of the compressed spring 52 is in contact with the partition wall 54. Due to the force of the spring, the spool portion 51 receives a force that urges the spool portion to separate from the internal surface of the left bearing member 34*a* and thus, the disk portion 62 of the rotating member 60 is pressed against the external surface of the left bearing member 34*a*.

Figure 12:
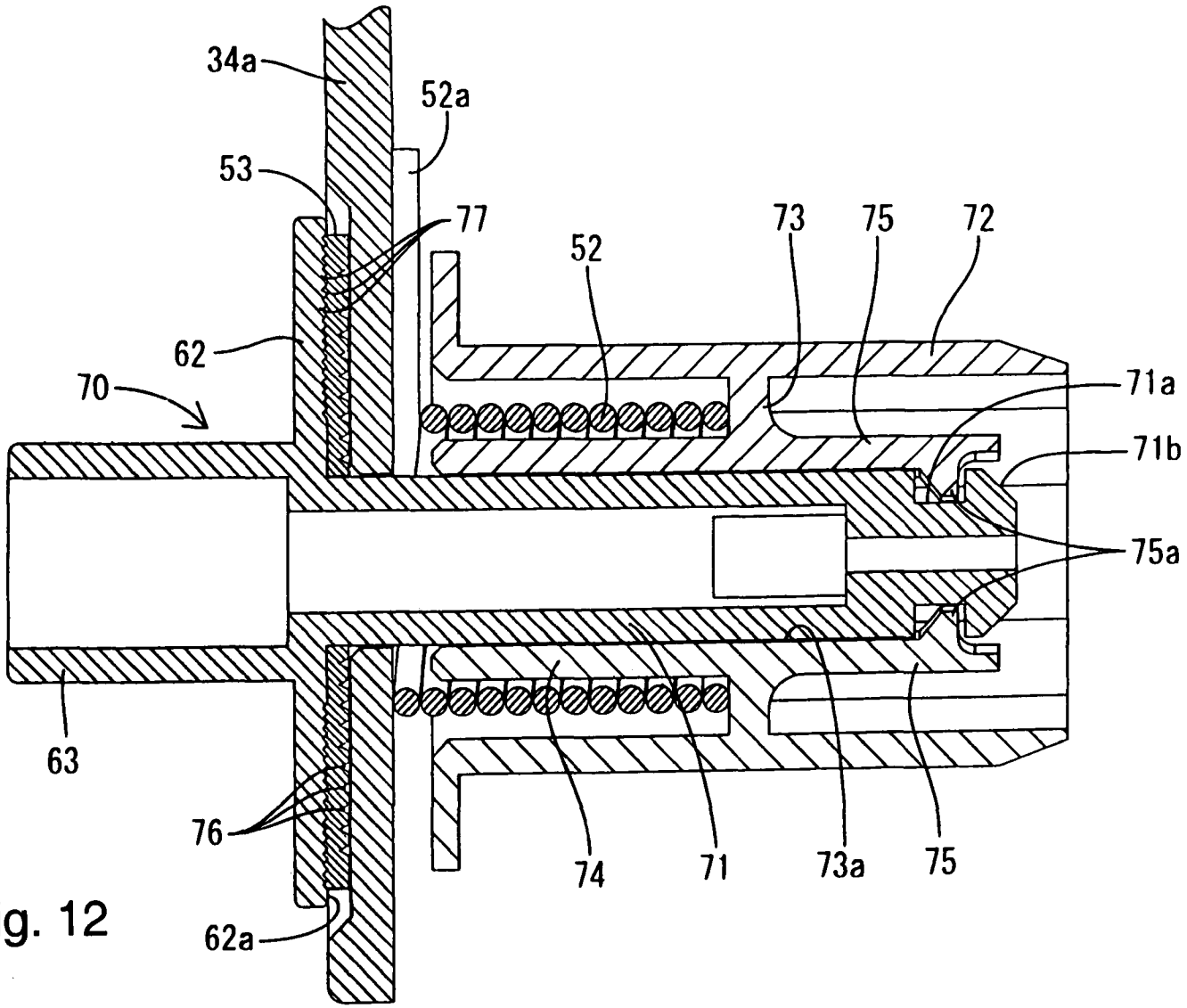
FIG. 12 is a cross-sectional view of another exemplary supply spool employing one or more aspects of the invention.

FIG. 12 illustrates another exemplary structure for engaging the rotation member 60 with the spool portion 51. Only the differences between the exemplary structure shown in FIG. 10 and discussed above will be discussed below. As shown in FIG. 12, in this exemplary structure for a rotation member according to one or more aspects of the invention, a rotation member 70 includes engaging grooves 71*a* close to an end of the shaft insert portion 71 along an outer surface thereof. The shaft insert portion 71 has, for example, a substantially cylindrical shape. The tip portion of the shaft insert portion 71 of this exemplary embodiment may have a tapered surface 71*b*. The other portions of the rotation member 70 correspond to the rotation member 60, discussed above.

As shown in FIG. 12, the internal space of the spool portion 72 is partially divided by a partition wall 73 which is arranged substantially at a center of the spool portion 72. The partition wall 73 extends into the inner space of the spool portion 72 along a direction substantially perpendicular to the insertion direction of the shaft insert portion 71 and defines an insert port 73*a* into which the shaft insert portion 71 of the rotation member 70 is inserted. An inner substantially cylindrical-shaped portion 74 protrudes from the ends of the partition wall and extends substantially parallel to the insertion direction of the shaft insert portion 71 towards the inner wall of the left bearing member 34*a*. When the shaft insert portion 71 is inserted into the spool portion 72, the cylindrical-shaped portion 74 borders the outer circumferential surface of the shaft insert portion 71. In this exemplary implementation, the compressed spring 52 is arranged in the space between the outer wall of the cylindrical-shaped portion 74 and the inner wall of the spool portion 72. The space within which the compressed spring 52 is arranged has a height substantially equal to the corresponding partition wall 73 section.

Flexible members 75 extend, for example, from the ends of the partition wall 73 in a direction substantially opposite to the extension direction of the inner cylindrical shaped portion 74 and these flexible members 75 include engaging projections 75*a* which engage with the corresponding engaging grooves 71*a* of the shaft insert portion 71. When the shaft insert portion is inserted into spool portion 72, the flexible members 75 flex outward when a portion of the shaft insert portion 72, other than the engaging grooves 71*a*, is in contact with the engaging projections 75*a*. When the engaging projections 75*a* align with and fit into the engaging grooves 71*a*, the flexible members are substantially parallel to the insertion direction of the shaft insert portion 71. As shown in FIG. 12, the tip of the shaft insert portion 71 may have a tapered surface 71*b* and the inner sides of the engaging projections 75*a* may be tapered to help reduce the flexing of the flexible members 75. When the engaging projections 75*a* of the flexible members 75 of the rotation body 70 are inserted into their respective engaging groove 71*a*, the rotation body 70 is engaged with the spool portion 72 and thus, both rotate together and neither can rotate independently.

Various exemplary fixing grooves/projections and rotation resistance grooves/projections of the disk portion 62 and corresponding outer surface portion of the left bearing member 34*a* will be described below with reference to FIGS. 13-17. As shown in FIG. 9, and as discussed above, when the rotation member is inserted into the back opening 31*a* of the left bearing member 34*a*, the portion of the outer surface of the left bearing member 34*a* around the back opening 31*a* is substantially opposite to the inner surface 62*a* of the disk portion 62. The intermediate member 53 is arranged therebetween.

Figure 13:
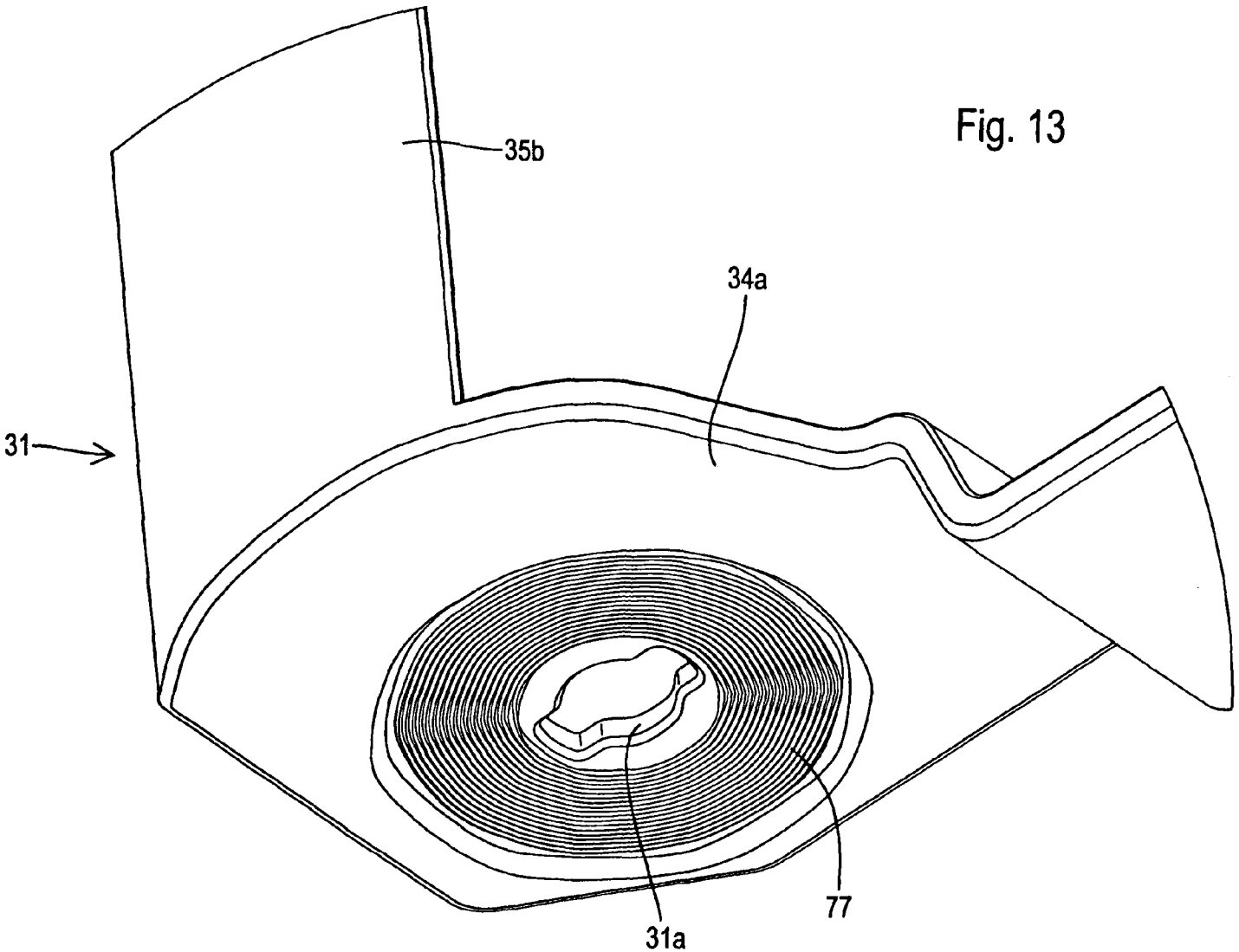
FIG. 13 is a view of exemplary fixing or rotation resistance grooves formed on a portion of an exemplary ink cartridge frame employing one or more aspects of the invention.
Figure 14:
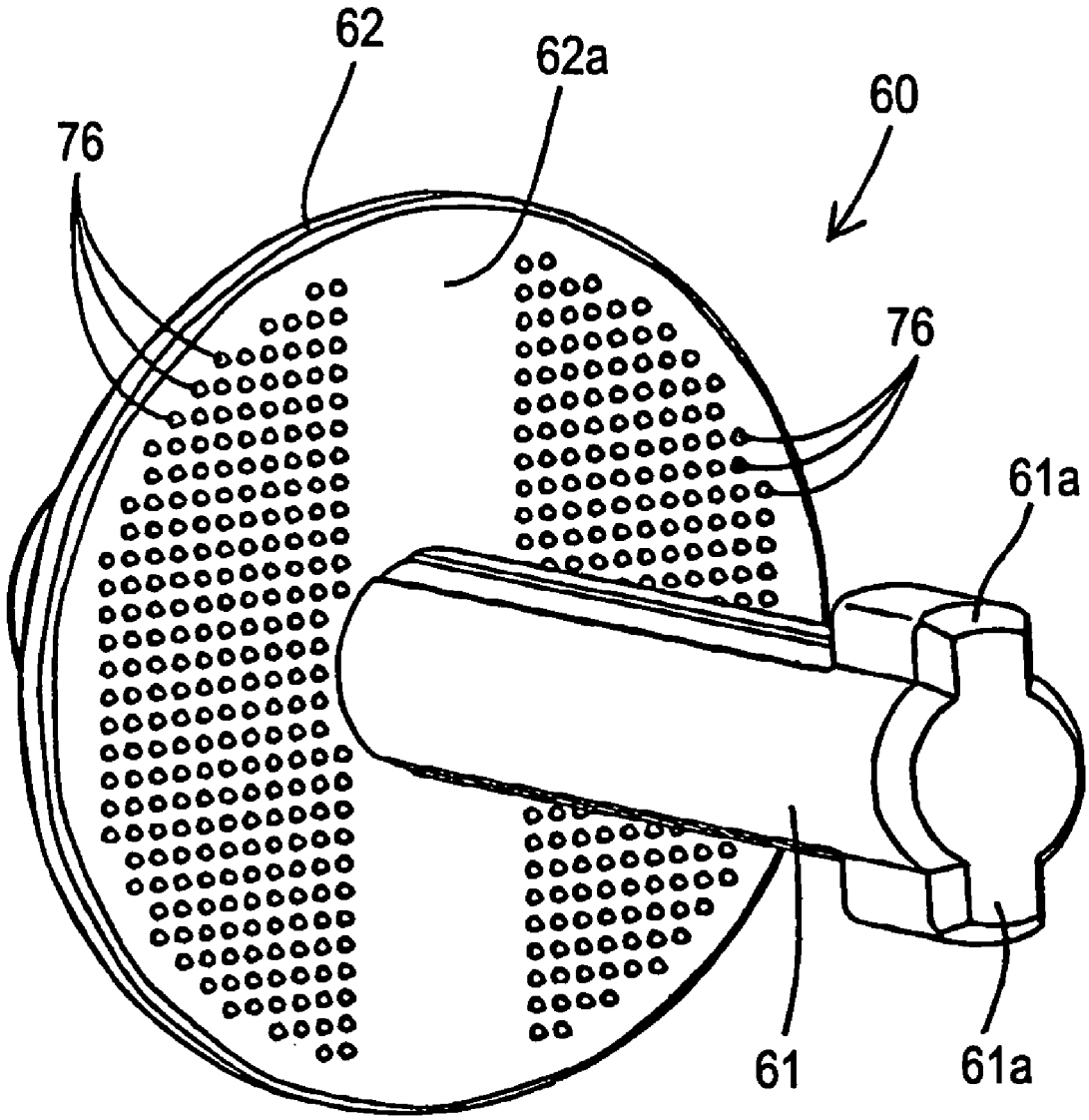
FIG. 14 is a perspective view of exemplary fixing or rotation resistance projections formed on an inner surface of the rotation member employing one or more aspects of the invention.

In some implementations of one or more aspects of the invention, a plurality of substantially concentric partial and/or complete circular annular grooves 77 (i.e., rotation resistance projections/grooves) may be formed on the left bearing member 34*a* around the bearing hole 31*a*, as shown, for example, in FIG. 13. In such implementations, on the corresponding inner surface 62*a* of the rotation member, a plurality of projections 76 (i.e., fixing projections/grooves) may be formed. The fixing projections/grooves may be formed on portions of or across the entire surface of the inner surface 62*a* of the rotation member 62. The projections 76 may be, for example, tapered protrusions with substantially narrow tips which grab onto the intermediate body 53 (e.g., felt, rubber). On the inner surface 62*a* of disk portion 62 of the rotation body 60 illustrated in FIG. 14, a plurality of protrusions 76 are formed in, for example, substantially semi-circular shaped areas thereof and the semi-circular shaped areas sandwich the substantially linear protrusion free region in the center area. In this exemplary implementation, the substantially linear-protrusion-free region includes the area of the disk portion 62 through which the shaft insert portion 61 is inserted.

The intermediate member 53 in these exemplary implementations, has a substantially annular shape, for example, which corresponds to the shape of the disk portion 62 of the rotation member 60. As discussed above, the pressing force of the compressed spring 52 is received between the external surface of the left bearing member 34*a* and the inner surface 62*a* of the disk portion 62. Thus, the intermediate member 53 which is sandwiched between the inner surface 62*a* of the disk portion 62 and the outer surface of the left bearing member 34*a* is in contact with both surfaces (i.e., inner surface 62*a* and outer surface of left bearing member 34*a*).

When the take-up shaft 33 is rotated by the driving motor and the take-up of the ink ribbon sheet 23 begins, the supply shaft 32 rotates. Thus, the spool portion 51 of the left supply spool 50 and the rotation member 60 also rotate. As discussed above, the intermediate member 53 is subjected to a pressing force between the external surface of the left bearing member 34*a* and the internal surface 62*a* of the disk portion 62. Thus, the projections 76 cut into the surface of the intermediate member 53 and a strong frictional force is generated.

A frictional force is also generated between the substantially annular grooves 77, formed on the external surface of the left bearing member 34*a*, which are in contact with the inner surface of the intermediate member 53. However, the frictional force generated between the annular grooves 77 and the corresponding surface of the intermediate member 53 is relatively weaker than the frictional force generated between the projections 76 and the corresponding surface of the intermediate member 53. Since the frictional force between the outer surface of the left bearing member 34*a* and the inner surface of the intermediate member 53 is weaker than the frictional force between the outer surface of the intermediate member 53 and the inner surface 62*a* of the disk 62, when the spool portion 51 is rotated, the intermediate member rotates with the rotation member 60 and slides along the outer surface of the left bearing member 34*a*. A frictional force is generated between the outer surface of the left bearing member 34*a* and the inner surface of the intermediate member 53 (e.g., felt or rubber), and this frictional force (rotation resistance) is sufficient as a back tension for the supply shaft 32. By using an intermediate body 53 made, for example, of felt, rubber or cork, the frictional force is not as dependent on the surrounding environment as compared to a case where the intermediate body 53 is made of a resin, for example.

It should be understood that while the above description refers to annular grooves and cylindrical members, various other shapes may be employed for various components of the cartridge. Further, while the exemplary implementations described above utilize fixing grooves/projections, in other exemplary implementations of one or more aspects of the invention, the corresponding surface of the intermediate member may be fixed to the corresponding surface of the rotation member or the cartridge frame with, for example, an adhesive. Further, while the exemplary embodiments described above utilize rotation resistance grooves/projections, other means of generating rotation resistance, such as, for example, an abrasive surface, may be employed in other exemplary implementations of one or more aspects of the invention.

Figure 15:
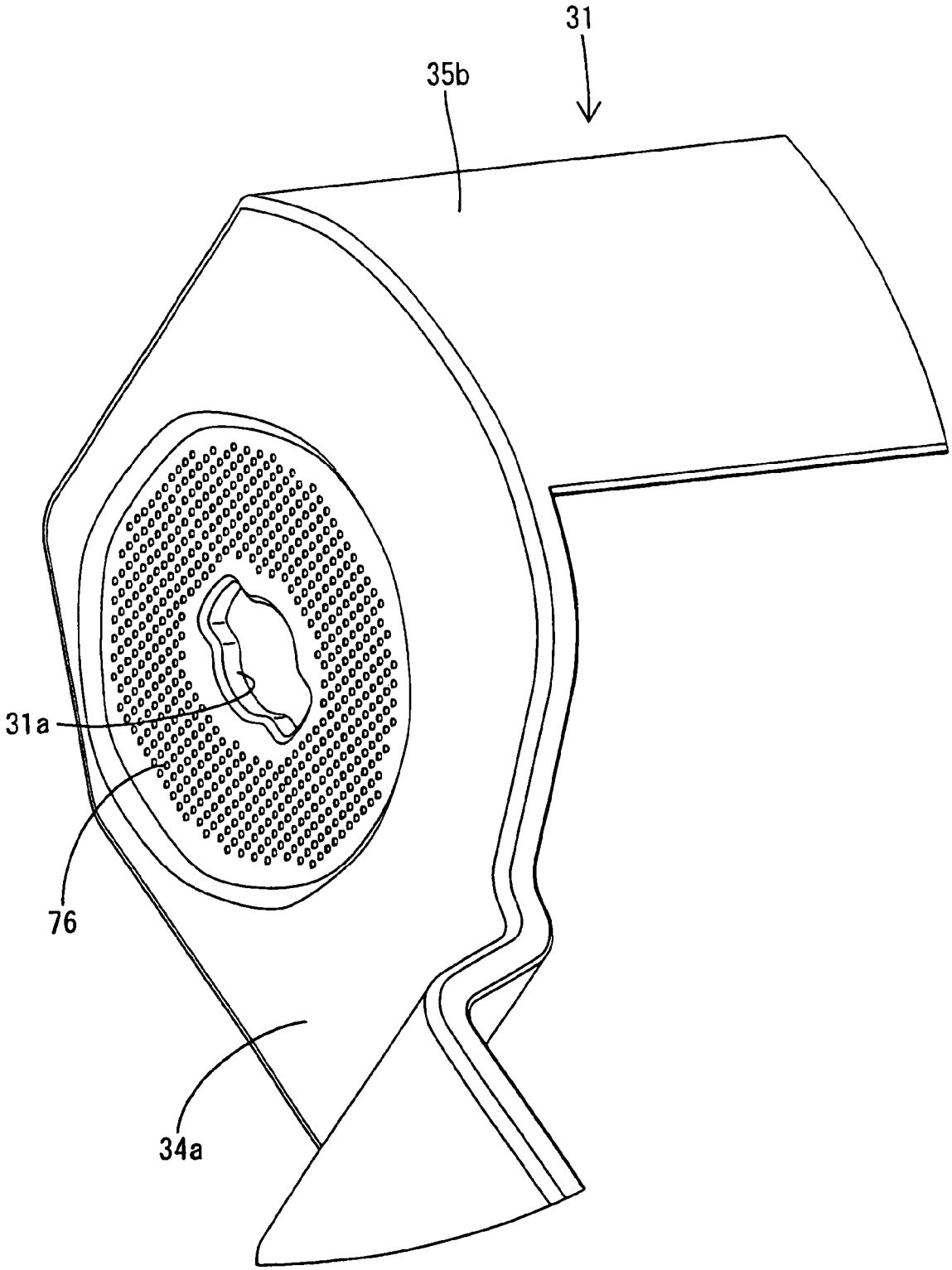
FIG. 15 is a perspective view of other exemplary fixing or rotation resistance projections formed on an outer surface of an ink cartridge frame employing one or more aspects of the invention.
Figure 16:
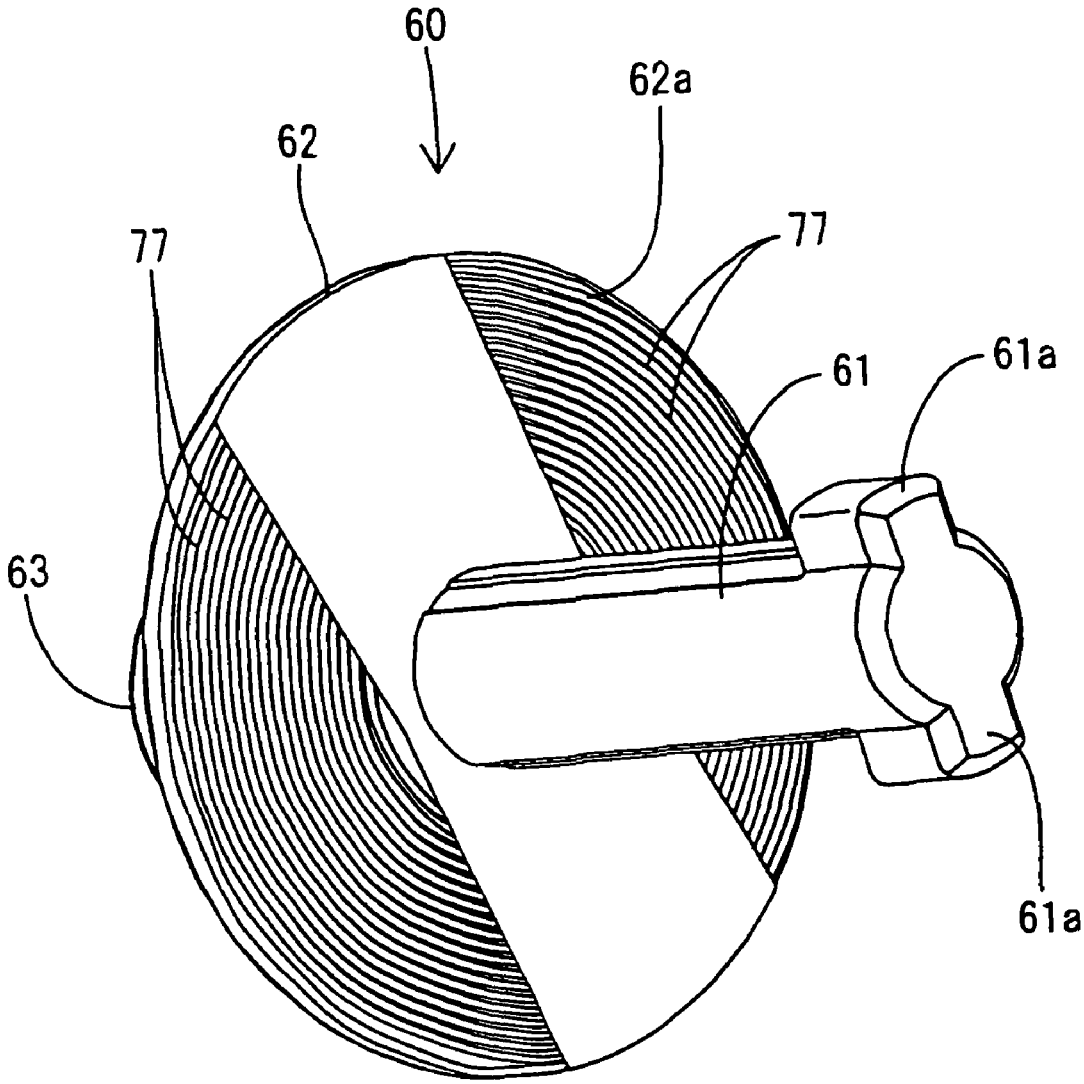
FIG. 16 is a perspective view showing exemplary fixing or rotation resistance grooves formed on an inner surface of an exemplary rotation member employing one or more aspects of the invention.
Figure 17:
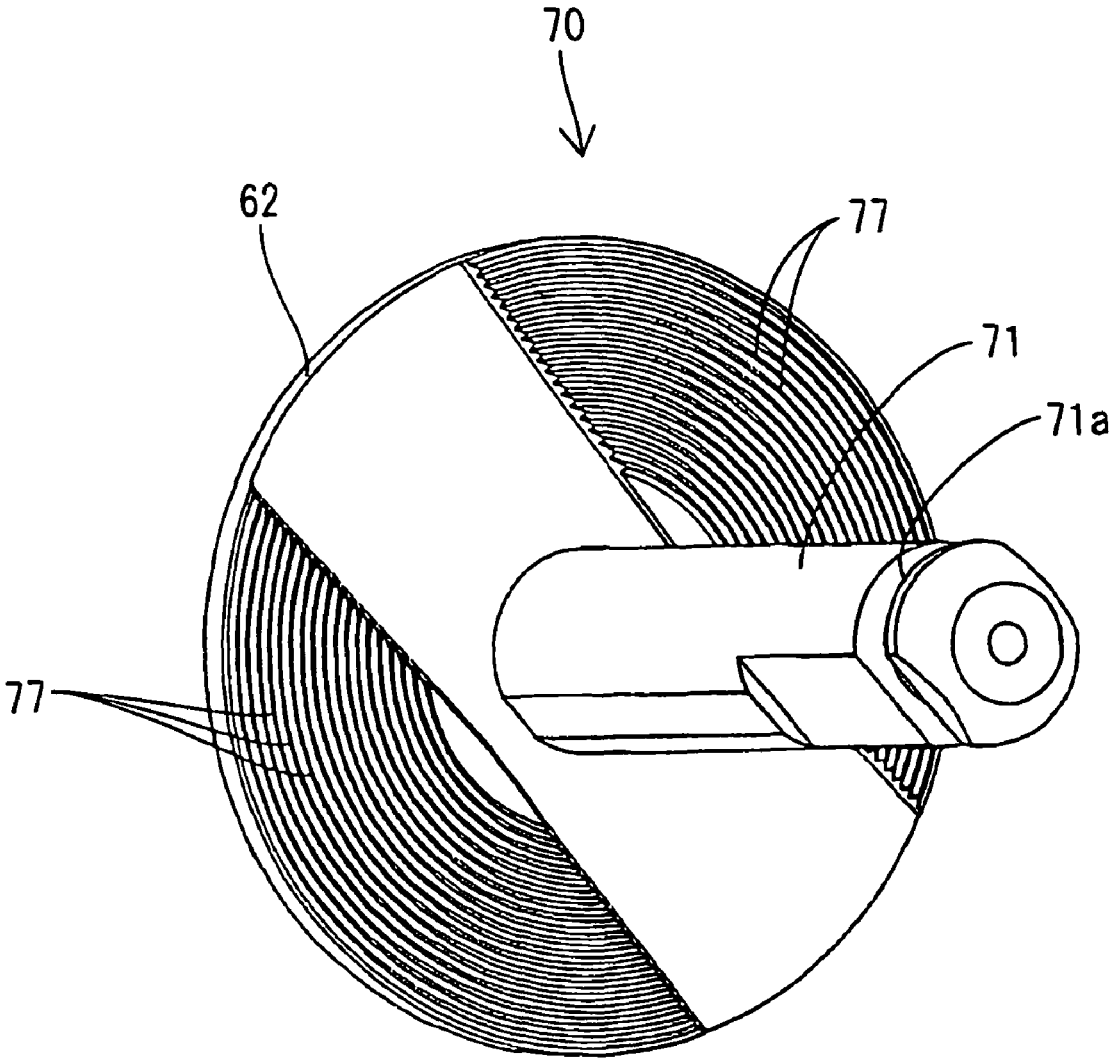
FIG. 17 is a perspective view showing other exemplary fixing or rotation resistance grooves on an inner surface of an exemplary rotation member employing one or more aspects of the invention.

FIGS. 15-17 illustrate another exemplary embodiment of rotation resistance projections/grooves and fixing projections/grooves which may be implemented according to one or more aspects of the invention. In this exemplary implementation, the rotation resistance projections/grooves are provided on the outer surface of the left bearing member 34*a* and the fixing resistance projections/grooves are provided the inner surface 62*a* of the disk portion 62 of the rotation member 60.

As shown in FIGS. 15-17, in this exemplary implementation of one or more aspects of the invention, the fixing grooves/projections are formed on the outer surface of the left bearing member 34*a* around the back opening 31 while the rotation resistance grooves/projections are formed on the inner surface 62*a* of the rotation member 62. For example, as shown in FIG. 15, a plurality of tapered projections 76 may be formed on the outer surface of the left bearing member 34*a* while a plurality of substantially concentric-partial-annular-like grooves 77 are formed on the corresponding inner surface 62*a* of the disk portion 62. FIGS. 16 and 17 illustrate different exemplary shaft insert portions 61, 71 and rotation members 60, 70, as discussed above, which have substantially concentric partial annular grooves as the rotation resistance grooves/projections on the inner surface 62*a*.

In the exemplary implementation of one or more aspects of the invention illustrated in FIGS. 15-17, when the take-up shaft 33 is rotated by the driving motor and the take-up of the ink ribbon sheet 23 begins, the supply shaft 32 rotates and thus, the spool portion 51 of the supply spool 50 and the rotation member 60 also rotate. As discussed above, the intermediate member 53 is subjected to a pressing force between the external surface of the left bearing member 34*a* and the internal surface 62*a* of the disk portion 62. Thus, the projections 76 of the outer surface of the left bearing member 34*a* cut into the surface of the intermediate member 53 and a strong frictional force is generated. A frictional force (i.e., rotation resistance) is also generated between the substantially annular-like grooves 77 which are formed on the external surface of the inner surface 62*a* of the rotation member 60, 70 and are in contact with the outer-side of the intermediate member 53.

However, the frictional force generated between the partial annular grooves 77 and the intermediate member 53 is relatively weaker than the frictional force generated between the projections 76 and the intermediate member 53. Since, in this exemplary implementation, the frictional force (i.e., fixing force) generated between the outer surface of the intermediate member 53 and the inner surface of the disk 62*a* is weaker than the frictional force (rotation resistance) generated between the outer surface of the left bearing member 34*a* and the inner surface of the intermediate member 53, the intermediate member 53 is kept in place (i.e., does not rotate with the spool portion 51) by the greater frictional force between the projections 76 and the inner surface of the intermediate member (e.g., felt or rubber), and the inner surface 62*a* of the rotation member 60, 70 slides thereon.

Thus, in this exemplary implementation, the intermediate member 53 (e.g., felt or rubber) is fixed on the outer surface of the cartridge frame 30 and does not rotate with the rotation member 60. The frictional force generated between the partial annular grooves 77 and the outer surface of the intermediate member (e.g., felt or rubber) is sufficient, however, as a back tension for the supply shaft 32.

Various implementations of one or more aspects of this invention provide a back tension (rotation resistance) on the supply shaft 32 using an intermediate member, having characteristics which are substantially independent of the surrounding environment, based on a frictional force generated between the intermediate member 53 and the annular grooves 77 on the left bearing member 34*a* of the cartridge frame 30, for example. In contrast to a structure in which a back tension is provided by a resin-on-resin frictional force, irrespective of environmental changes, various implementations of the invention provide a structure via which a substantially stable/consistent back tension is applied to the supply shaft.

By forming the fixing and rotation resistance grooves/projections on an external surface of the cartridge frame or on a surface of a component located outside of the cartridge frame, as provided in the various exemplary implementations of one or more aspects of the invention, instead of on an internal surface of the cartridge frame, the molding process for the formation of the cartridge frame is simplified. In particular, the formed cartridge frame with either annular grooves or projections on an outer surface thereof can more easily be separated from a mold than an image cartridge frame with either annular grooves or projections on an inner surface thereof.

As discussed above, while one aspect of the invention provides a compact structure for applying a consistent back tension to the supply spool of an ink cartridge, another aspect of the invention provides an attachable/detachable cartridge frame having at least one undetachable spool or shaft to frame connecting member, for example, to aid in quick and accurate assembly and attachment/detachment of the ink cartridge in the image forming device. The exemplary supply spool described above addresses, for example, both of these exemplary aspects of the invention as well as other others. That is, the exemplary embodiment of the left supply spool 50 discussed above is not easily attachable/detachable from the cartridge frame 30 once it is connected to the bearing wall because, for example, the internal compressed spring 52 urges the engaging projections of the shaft insert portion against the partition wall of the supply spool. Further, by providing the compressed spring 52, for example, in the internal space of the spool portion 51, 71, a size of the image cartridge having such a substantially consistent back tension mechanism is maintained compact. Further, in other exemplary embodiments, it is possible to provide a spool, such as the exemplary supply spool 50, via a groove in the cartridge frame such that the end of the supply shaft to which the exemplary supply spool is attached may be slid out via the groove. In such an exemplary implementation of one or more aspects of the invention, the ink ribbon and shaft may be replaced without having to connect the components of the spool while providing a back tension to the supply shaft when the supply shaft is inserted into the corresponding groove in the cartridge frame.

As discussed above, another aspect of the invention provides an ink cartridge which is attachable/detachable to an image forming device and having a holding member equipped with a drive gear. The exemplary take-up shaft described below is an exemplary substantially undetachable holding member which may be provided to allow for quicker and accurate attachment and detachment of the ink cartridge in the image forming device. The exemplary take-up shaft described below also provides a holding member equipped with a drive gear which does not easily separate undesirably.

Figure 18:
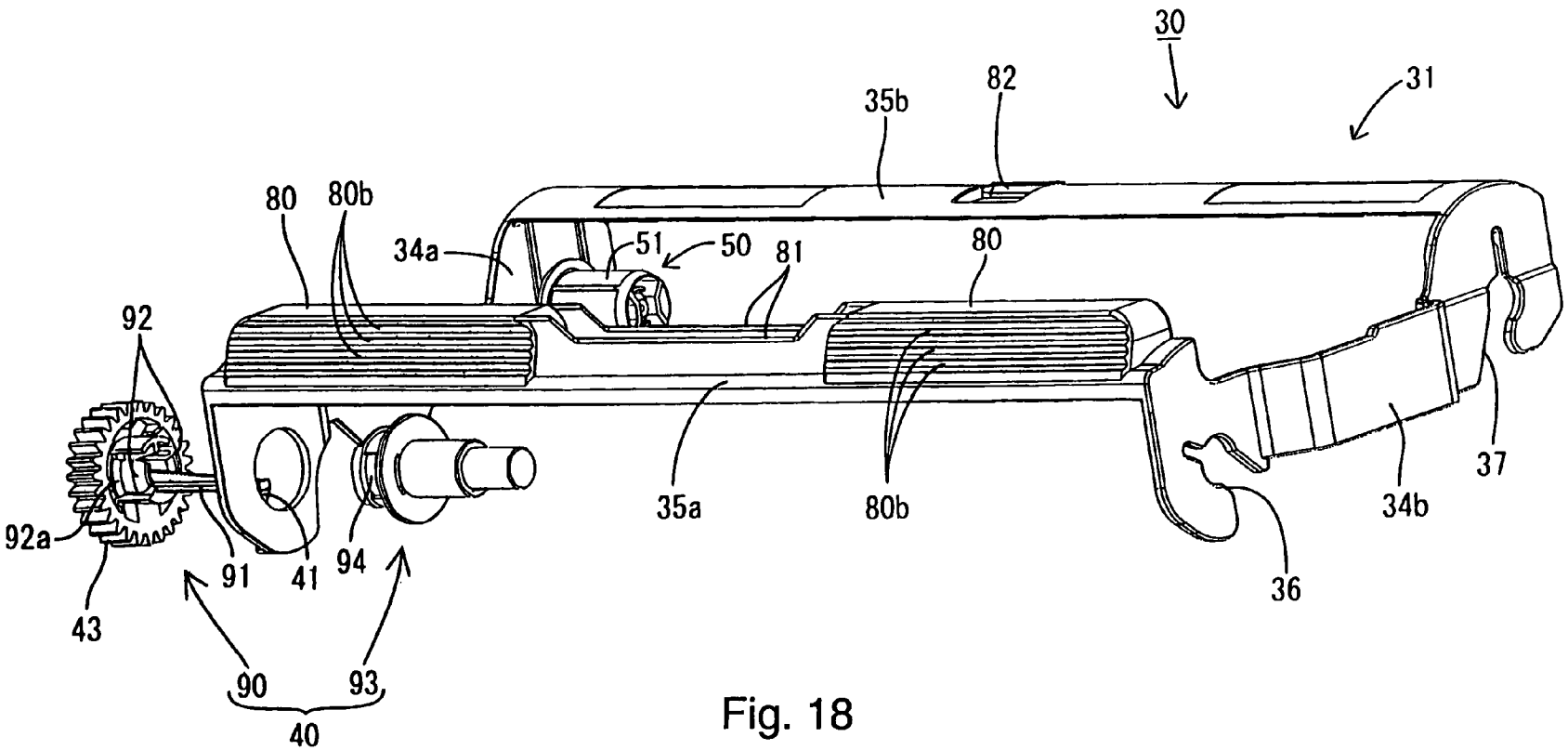
FIG. 18 is a perspective view from a position in front of and slightly to the right of a portion of the exemplary ink ribbon cartridge illustrated in FIG. 2 with an exploded view of an exemplary take-up spool employing one or more aspects of the invention.

FIGS. 18 and 19 are exploded views of a take-up spool and the ink ribbon cartridge 30 according to an exemplary implementation of one or more aspects of the invention. The take-up spool 40 rotatably supports the left end of the take-up shaft 33 and is rotatably held by a portion of the left bearing member 34*a* which, as discussed above, is substantially opposite to the front groove 36 on the right bearing member 34*b*.

As shown in FIGS. 18 and 19, the exemplary take-up spool 40 includes a gear member 90 and a spool member 93. The gear member 90 of the exemplary left take-up spool includes a drive gear 43, a shaft portion 42, connecting portions 43*a*, an arm portion 91, an engaging portion 41, flexible portions 92, protrusions 92*a*, bent-back portions 92*b*, tapered surface 92*c* and tapered surface 92*d*.

The engaging portion 41 projects from the end of the arm portion 91 and connects to the spool portion 93 of the take-up spool 40. The engaging projection 41 engages with a slit (not shown) formed by a cutout on the take-up shaft tube 33*a*. When the engaging portion 41 is inserted into the spool portion 93, the engaging portion 41 passes through the front opening 31*b*, the inside of the spool portion and projects outward via the insert slot 93*a* and a slit (not shown) in the take-up shaft tube 33*a*. Thus, in the exemplary implementation of one or more aspects of the invention illustrated, the engaging projection 41 engages with opening 93*a* of an inner most end of the spool portion 93, as shown in FIG. 8. The take-up shaft 33 and the take-up spool 40 are integrally connected via the engaging projection 41 and thus, rotate together and neither can rotate without the other. After the engaging projection 41 projects from the insertion hole 93*a* of the spool portion 93, the spool portion 93 and the gear member 90 are not easily separated unless the engaging projection is pressed into the spool portion 93 and while the gear member is pulled out from the spool portion. Thus, the gear member 90 which is located one side of the left bearing wall 34*a* and the spool portion located on the other side of the left bearing wall connect together such that the left take-up spool is not easily detachable from the ink cartridge frame 31.

The shaft portion 42 of the gear member 90 projects outward beyond the ink cartridge frame 30 and the drive gear 43 connects to an output gear (not shown) to which a drive force may be applied via a drive motor (not shown) of the main body. The gear member includes the shaft portion 42 and the drive gear 43. The spool member 93 is substantially inserted into the take-up shaft tube 33*a* of the take-up shaft 33 and thereby supports the take-up shaft 33 and any ink ribbon rolled thereon.

Figure 20A:
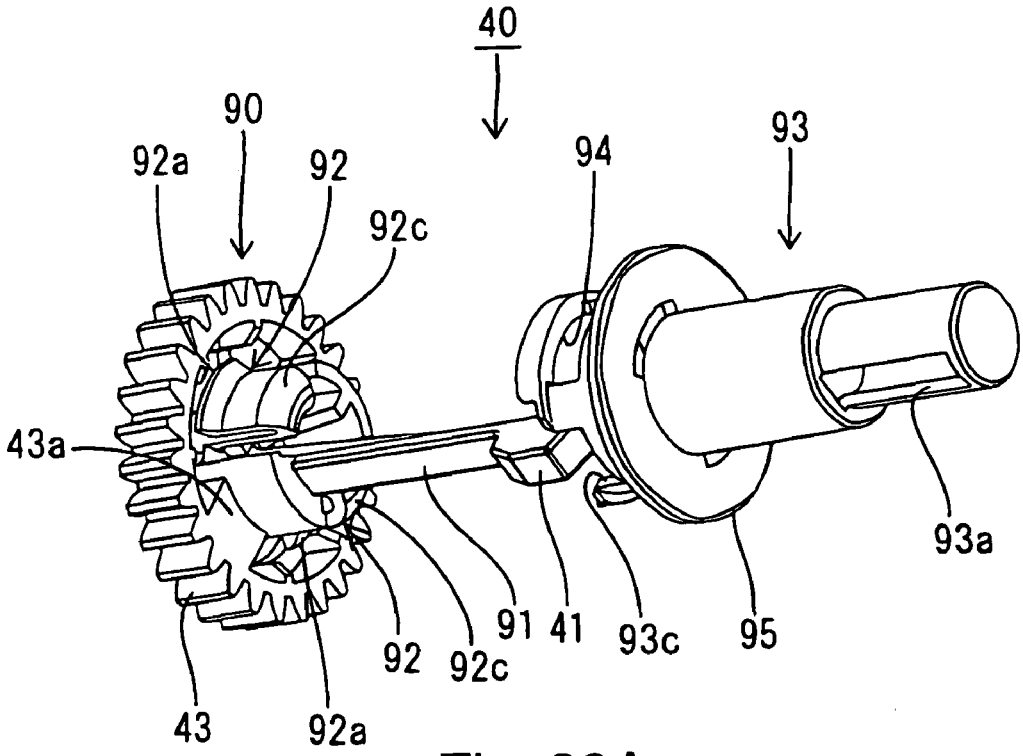
FIGS. 20A and 20B are perspective views showing an exemplary spool with a gear employing one or more aspects of the invention.
Figure 20B:
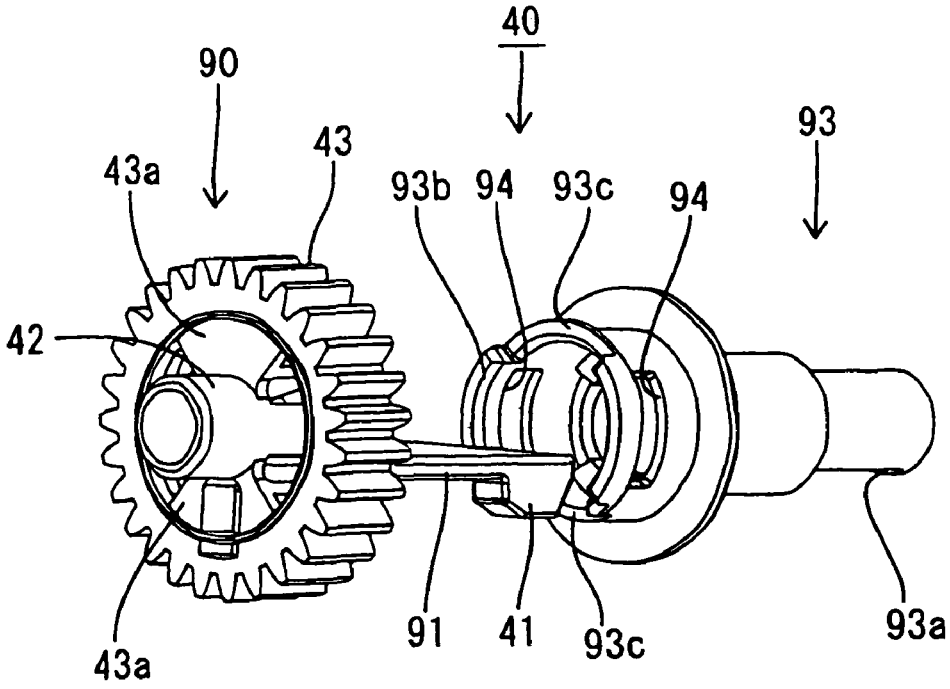

The exemplary spool portion 93 has a substantially cylindrical shape, including portions with different diameters, and a substantially open side for receiving corresponding portions of the gear member 90. As illustrated in FIGS. 20A and 20B, the exemplary spool portion 93 includes a receiving portion including tapered surfaces 93*b*, cut out portions 93*c*, and engaging holes 94, a flange portion 95, a first substantially cylindrical portion and a second substantially cylindrical portion having the insertion hole 93*a*.

As discussed above, the engaging portion 41 is inserted into the spool portion 93 and projects from the insertion hole 93*a* in order to engage the spool portion 93 and the gear member 90. The flange portion 95 projects substantially radially about the rotation axis and has a diameter which is larger than the diameter of the other portions of the spool portion 93. The first substantially cylindrical portion is connected to the flange portion 95 on one end and the second substantially cylindrical portion on the other end. The first substantially cylindrical portion has a diameter which is smaller than the diameter of the flange portion 95 and the diameter of the receiving portion, but is larger than the diameter of the second substantially cylindrical portion. The engaging holes 94 receive engaging projections 92*a* of the flexible member 92 of the gear member 90. The engaging holes 94 are provided at substantially symmetrical positions about the outer circumference of the receiving portion of the spool portion 93. The other end of the flange portion 95 (i.e., the side of the flange facing the gear member 90) is connected to the receiving portion of the spool portion 93. The receiving portion includes tapered surfaces 93*b*, cut out portions 93*c*, and the engaging holes 94 and the receiving portion extends from the corresponding side of the flange portion 95 to the end of the spool portion which connects with the gear member 90. Other exemplary spool portions may have an angled one-piece spool portion such that a diameter of the spool portion next to the flange portion is larger than the diameter of the spool portion at an innermost end thereof. Further, other exemplary spool portions may include more than two different sized spool portions.

Referring to FIGS. 20A and 20B, when the gear member 90 is inserted into the spool portion 93, the tapered surface 93*b* of the spool member 93 bends outward to allow for the flexible portions 92 of the gear member to pass therein. In the exemplary embodiment, a pair of flexible portions 92 is provided at substantially a base end of the arm 91 at the input gear 43. The flexible portions 92 are symmetrically arranged about the axis of rotation of the take-up spool 40 and have a shape similar to the shape of the open side of the spool member 93. The outermost diameter of the flexible portions 92 is slightly larger than the innermost diameter defined by the tapered surfaces 93*b* and thus, the tapered surfaces 93*b* flex outward to allow the flexible portions to more easily pass therein. The flexible portions 92 extend outward from the input gear portion 43 towards the insertion direction and have bent-back portion 92*b* which has a substantially "u"-like shape wherein the opening of the "u" faces the input gear 43 and the base of the "u" faces the insertion direction. Thus, the outer surface of each bent-back portion 92*b* contacts the inner surface of the receiving portion of the spool member 93 when the gear member 90 and the spool member 93 are connected.

Figure 21:
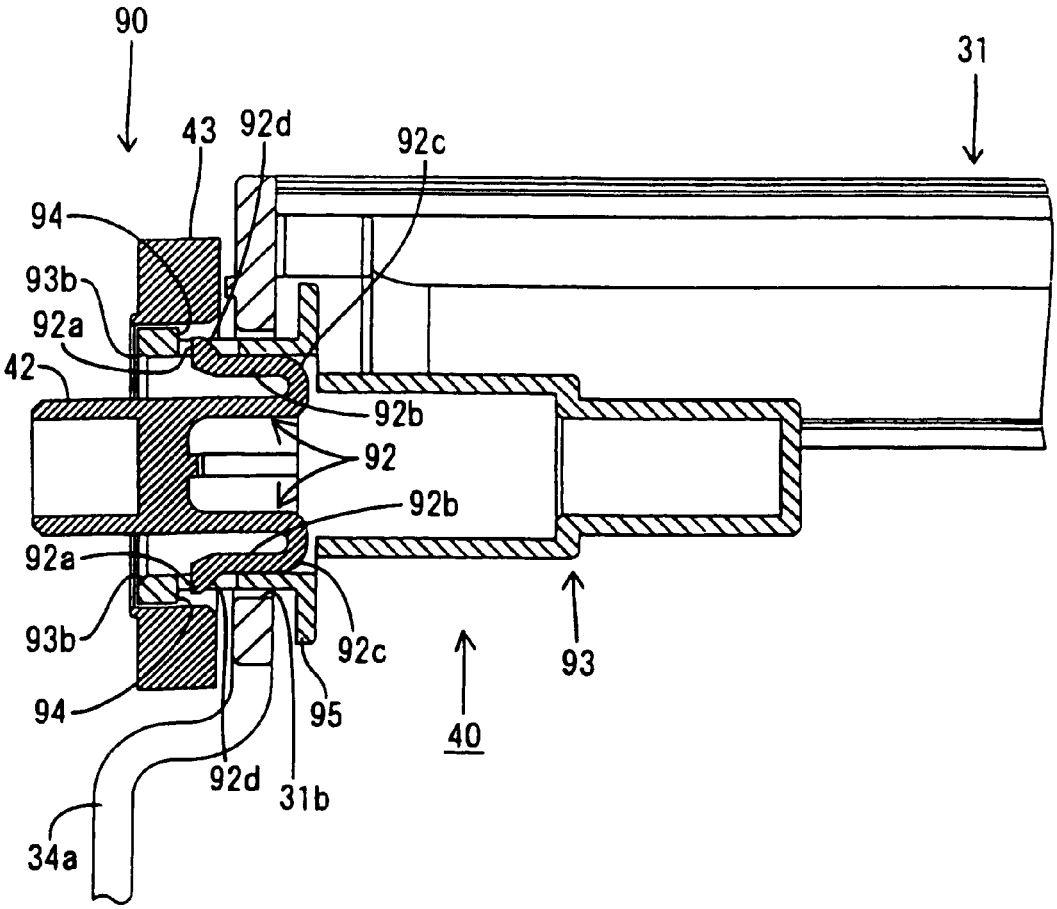
FIG. 21 is a cross-sectional diagram from a bottom of an exemplary spool with gear assembly employing one or more aspects of the invention.

As shown in FIG. 21, each bent-back portion 92*b* forms a tapered surface 92*c* around the outer surface of the base of the "u" where the surface is bent back. The tapered surfaces 92*c* make the insertion of the gear member 90 into the spool member 93 easier. The flexible portions 92 also include engaging protrusions 92*a* which engage with the corresponding engaging holes 94 of the spool portion 93. The engagement protrusions 92*a* have a tapered outer surface 92*d* such that the diameter of the engaging protrusions 92*a* gradually becomes larger towards the base of the protrusions (i.e., outer surface of bent-back portion). The tapered surface 92*d* is guided by the tapered surface 93*b* of the spool portion when the gear member 90 is connected with the spool portion 93. By pressing the spool member 93 and the gear member 90 together, each flexible portion 92 engages with the corresponding engaging hole 94 and the spool 40 is connected to the cartridge frame 31 in a manner in which it is not easily detachable. When the engaging protrusions 92*a* of the ends of the flexible portions 92 are engaged with the corresponding engaging holes 94, an "S"-like shape is formed by their corresponding surfaces.

Further, when the gear member 90 and the spool member 93 are assembled, the connecting portion 43*a* of the gear portion 43 of the gear member 90 fits into the cut-out portions 93*c* along the outer surface thereof, as can be seen based on FIG. 20B.

A take-up spool and gear structure according to one or more aspects of the invention, as described above, provides a take-up shaft supporting member which rotatably supports the take-up shaft and rotates the take-up shaft to take-up used portions of the ink ribbon in accordance with a drive force applied by the drive motor to the gear of the gear member of the take-up shaft spool.

Figure 22:
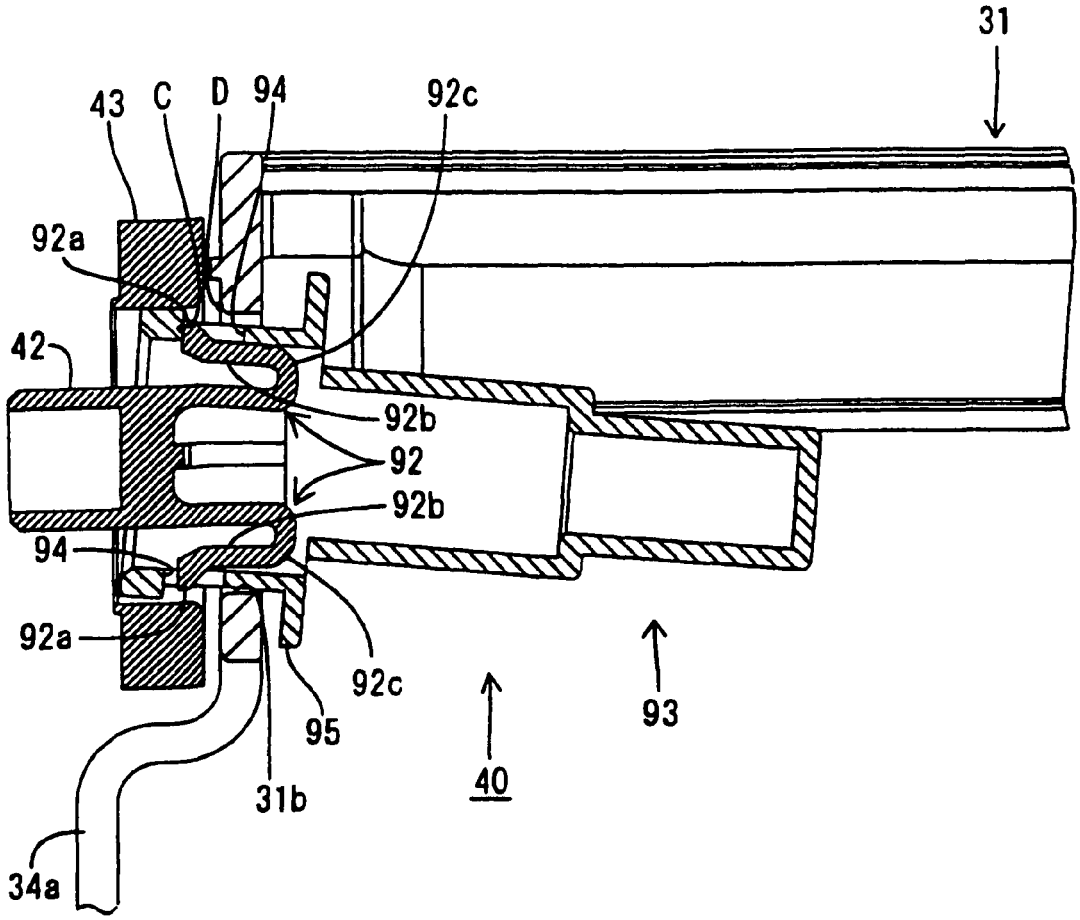
FIG. 22 is another cross-sectional diagram of the spool with gear assembly illustrated in FIG. 21.
Figure 23A:
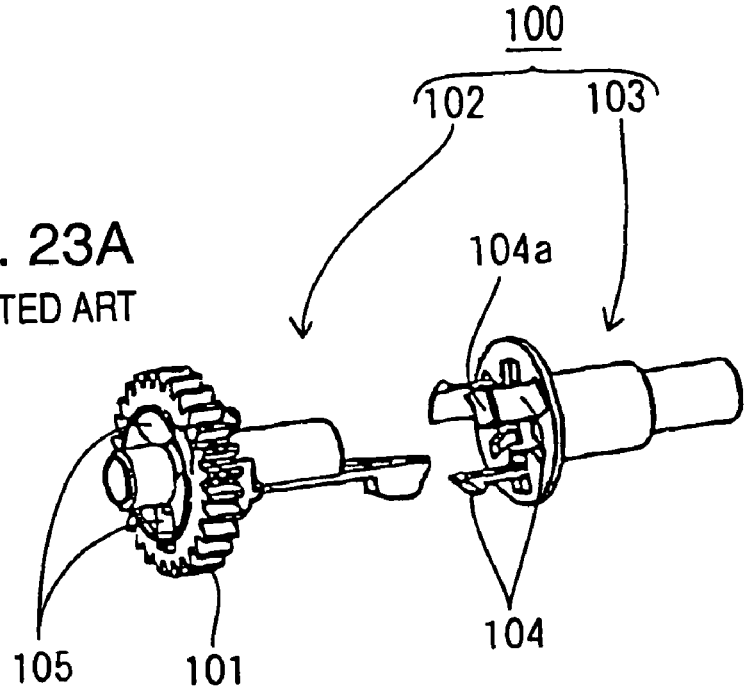
Fig. 23A RELATED ART
FIGS. 23A and 23B are perspective views of a known spool with gear.
Figure 23B:
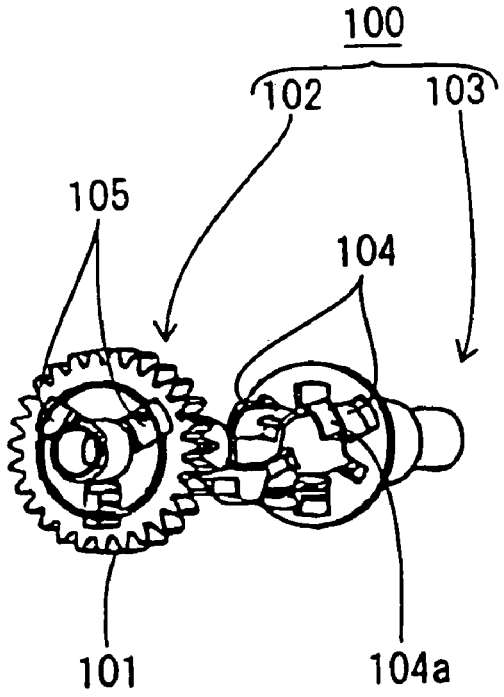
Fig. 23B RELATED ART

Various implementations of a take-up spool according to one or more aspects of the invention provide a take-up spool which cannot easily be separated from the ink cartridge frame to aid in the attachment/detachment of the ink cartridge. Also, as shown in FIG. 22, if the exemplary spool member 40 is tilted with a strong force, the engaging protrusions 92*a* are sandwiched between the inner wall C of the engaging hole 94 and the circumferential edge portion D of the front bearing hole 31*b* in the left bearing member 34*a* portion of the cartridge frame 30.

The above-described exemplary supply and take-up spools according to one or more aspects of the invention, which are not easily attachable/detachable from the ink cartridge allow for easier attachment/detachment of the ink ribbon to the ink ribbon cartridge and well as attachment/detachment of ink ribbon cartridge to the image forming member.

In the above description, a component is referred to as being attachable/detachable if the component can be easily attached/detached to another component without requiring, for example, excessive assembly or disassembly of the components in order to attach/detach the component from the other component. Thus, while a component may be referred to as being undetachable, the component may be detached if, for example, it is intentionally pried open or if screws, etc. are removed. Similarly, while a component may be referred to as being detachable, the component is meant to be easily detachable such as, for example, by simply being pulled out or being capable of being pulled out after a releasing means, for example, is engaged.

As there is a constant need for smaller, lighter and more portable image forming devices, another aspect of the invention is provide a compact ink ribbon cartridge which has the essential features of an ink cartridge while being compact such that the internal space of the facsimile device may be used efficiently. According to another aspect of the invention, approximate sizes of various exemplary components and features of an ink cartridge implementing one or more aspects of the invention, will be provided below in connection with FIGS. 28-38. The exemplary sizes of the various components allow for efficient use of the internal space of an image forming device employing the ink ribbon cartridge according to one or more aspects of the invention.

Figure 28:
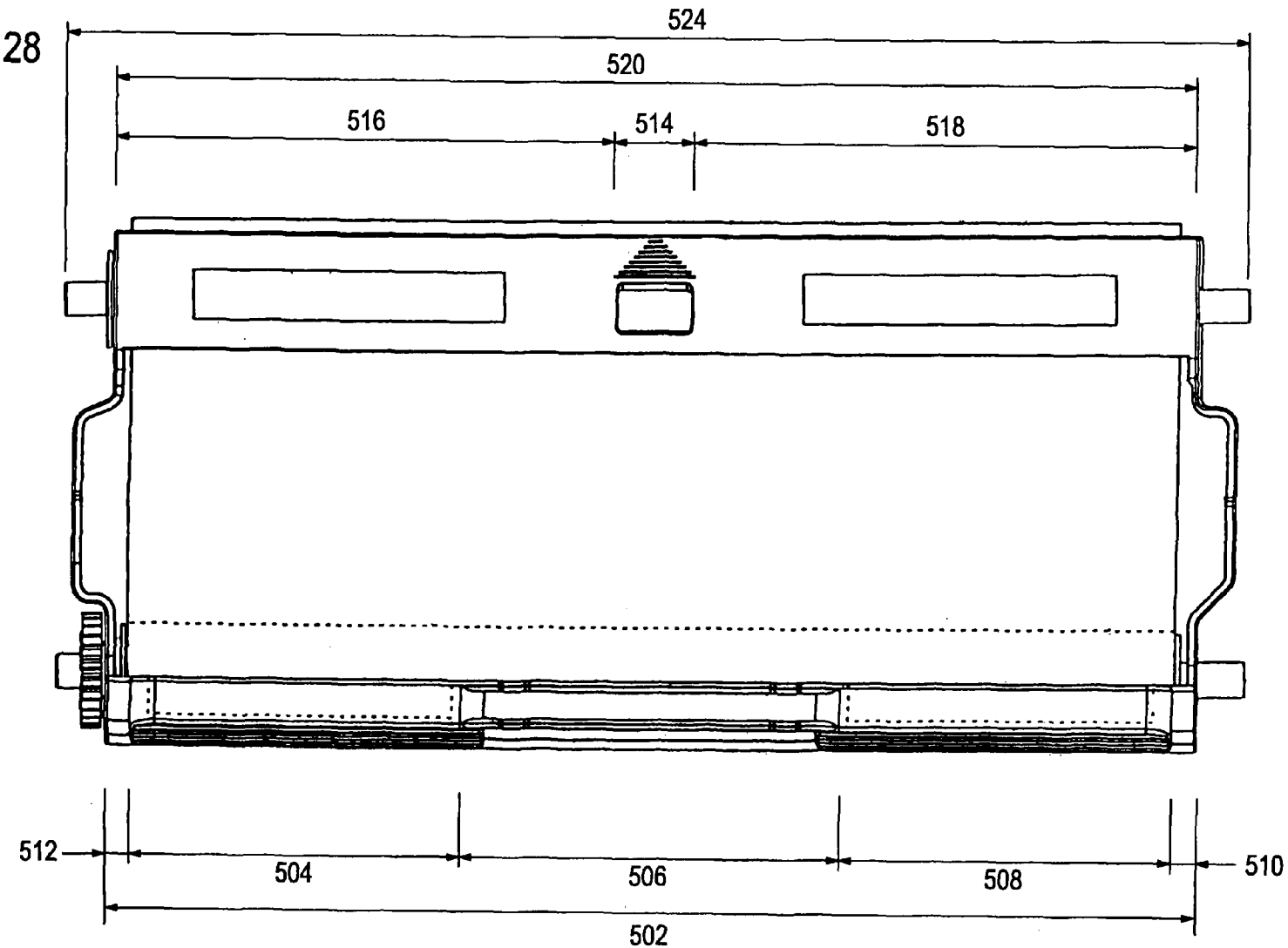
FIG. 28 is a top view, including reference bars, of the exemplary ink ribbon cartridge illustrated in FIG. 2.
Figure 29:
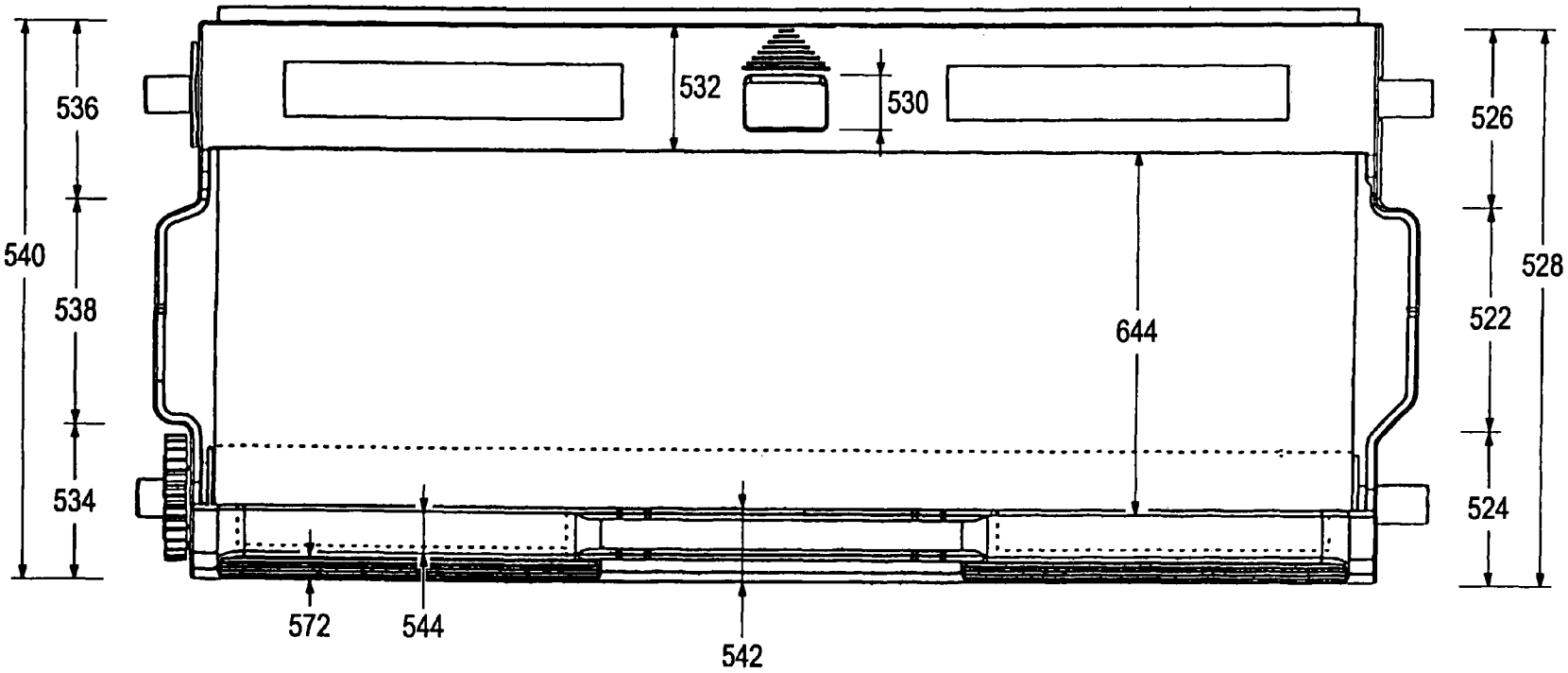
FIG. 29 is a top view, including reference bars, of the exemplary ink ribbon cartridge illustrated in FIG. 2.

FIGS. 28 and 29 illustrate a top view of the exemplary ink ribbon cartridge illustrated in FIG. 2. A length 502 of the front connecting member 35*a*, between the left and right bearing members 34*a*, 34*b* of the ink cartridge 31 is about 225.0 mm and not greater than about 226.5 mm such that the front connecting member connects the left and right bearing members to provide a more stable ink ribbon cartridge which can more easily be handled without increasing a size of the corresponding image forming device. In the exemplary ink ribbon cartridge illustrated in FIG. 28, the front connecting member extends between the left and right bearing members and connects the front upper edges thereof. However, if the front connecting member extends beyond (i.e., projects beyond the outer edge of the left and/or right bearing member), the length of the front bearing member may be larger.

The thickness of the frame members is generally as thin as possible in order to maintain a small ink cartridge (i.e., not demand more internal space than already available) and image forming device while being strong enough to provide a sufficiently stable frame which allows for easier attachment/detachment thereof. Specifically, the frame is made of resin (PS: Polystyrene) and the thickness thereof is 1.5 mm at the thinnest according to a standard. Therefore, according to the embodiment, the thickness of the resin frame is preferably within a range of 1.5 mm through 3.0 mm. More preferably, the thickness of the frame is 2.0 mm. However, in other implementations of one or more aspects of the invention, the weight of the image forming device may be as important or more important than the size, and thus, with a lighter material the thickness of the member may actually be larger, for example. Further, in the following description, the word about is used to refer to the provided value which follows the word about, as well as values appropriately close to the provided value in view of, for example, changes made to the sizes of the other portions based, for example, on the provided range of possible sizes for some of the components. Further, not all of the aspects of the invention may be implemented in various exemplary embodiments of the invention.

Referring to FIG. 29, a length 528 of the right side of the ink cartridge is about 102.0 mm and not greater than about 107.0 mm. A length 540 of the left side is about 102.0 mm and not greater than about 107.0 mm.

As illustrated in FIG. 29, an ink ribbon sheet having a width of approximately 216.0 mm, can be accommodated in the exemplary ink cartridge. The maximum thickness of the roll of the ink ribbon sheet depends on the thickness of the supply and take-up shafts as well as the space between the supply and take-up shafts and the back or front connecting member, if included in the frame, or the space between the supply and take-up shafts and the components which surround/are close to the shafts when the ink ribbon cartridge is installed in the image forming device.

Figure 30:
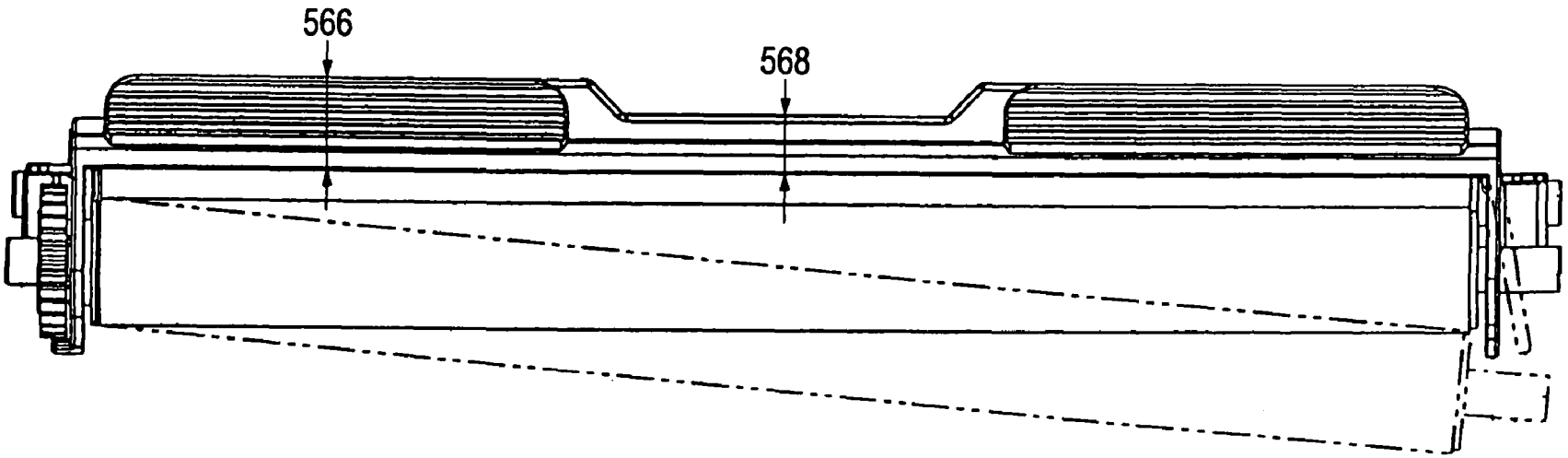
FIG. 30 is front view, including reference bars, of the exemplary ink ribbon cartridge illustrated in FIG. 2.

To aid in the handling of the ink cartridge, grips may be provided on the front connecting member and, as illustrated in FIG. 28, a length 504 of a left-side grip 80 is about 73.2 mm and not greater than about 91.0 mm. A length 508 of the right-side grip 80 is about 72.5 mm and not greater than about 91.0 mm. Depending on the amount of available space within the facsimile device which can be allocated for a grip or grips 80, the grips may be wide enough to allow one or a plurality of fingers to wrap around them in order to aid in the handling thereof. The length 504 and the length 508 of the grip 80 is generally as large as possible in order to provide sufficient room for the one or a plurality of fingers. However, the rib 81 should be wide enough to provide a clearance for the roller 9*a* of the facsimile device, while the entire length 502 of the ink ribbon cartridge 30 should be as short as possible to downsize the cartridge 30, the lengths 504 and 508 are restricted to certain degrees. Referring to FIG. 29, in the exemplary embodiment illustrated in FIG. 29, a height 572 of the angled ribbed portion of the grip 80 is about 10.5 mm from the top-front edge connecting cover and the angled ribbed grip portion of the grip 80 is angled such that the angled portion extends back about 4.2 mm (i.e., a projection of the top edge of the angled ribbed portion is about 4.2 mm behind the front edge of the front-most edge of the front connecting member), and the top-most-edge of the front cover is about 18.5 mm from an axis of rotation of the take-up shaft. A width 544 of the top surface of the grip 80 is about 9.7 mm and not greater than about 11.5 mm. Referring to FIG. 30, a height 566 from a front edge of the front connecting member to a top surface of the grip is about 15.0 mm. A height 568 from a front edge of the front connecting member to a top surface of the front connecting member is about 9.0 mm.

As illustrated in FIG. 28, a length 506 of the front connecting member 35*a* surface between the grips 80 is about 69.0 mm and is not less than about 42.0 mm in order to accommodate portions of the facsimile device. In the exemplary embodiment illustrated in FIG. 29, a width 542 of the portion of the front connecting member between the grips 80 is about 14.1 mm. The portion of the front connecting member between the grips 80, has an upper surface which is about 23.4 mm from an axis of rotation of the take-up shaft and not greater than about 26.9 mm in order to accommodate the roller 9*a* of the exemplary facsimile device 1.

Referring to FIG. 28, a distance 524 between the inner surfaces of the outermost projecting surfaces of the left and right bearing members, which accommodate the heat sink 19 and thermal head 20, is about 240.0 mm, not less than about 216.0 mm (i.e., width of the ink ribbon) and not greater than about 245.0 mm. Referring to FIG. 29, a distance 538 of the portion of the left bearing member accommodating the heat sink 19 and thermal head 20 is about 41.6 mm and not greater than about 53.0 mm and not less than about 36.0 mm (i.e., substantially the width of the thermal head 20, a heat sink 19, a spring 18 and an ink cartridge receiving section 22. The projecting portion includes side projecting portions (i.e., the arms of the substantially "u"-like projecting portion) having overall lengths in the extension direction (i.e., length of projection from base of bearing member). The projecting portion along the left bearing member projects outward from the base of the left bearing member (see first reference line at end of arrow relating to 510 in FIG. 28) a distance between about 4.5 mm and 13.4 mm. The projecting portion along the right bearing member projects outward from the base of the right bearing member (see first reference line at end of arrow relating to 512 in FIG. 28)) a distance between about 5.5 mm and 11.8 mm.

As shown in FIG. 29, a distance 536 of the exemplary left bearing member from a back edge thereof to the back end of the left outward projecting portion of the left bearing member (i.e., portion substantially corresponding to left end of supply shaft) is about 32.0 mm and not less than about 30.0 mm. A distance 534 from a front edge of the left bearing member to the front edge of the projecting portion of the left bearing member (i.e., portion substantially corresponding to left end of take-up shaft) is about 27.0 mm and not greater than about 30.0 mm.

Still referring to FIG. 29, a distance 526 between the back edge of the left bearing member and the back edge of the right projecting portion of the right bearing member is about 33.3 mm and not less than about 30.0 mm. A distance 522 from the back edge of the projecting portion and the front edge of the projecting portion of the right bearing member is about 42.8 mm and not greater than about 47 mm and not less than about 30.0 mm. A distance 524 from a front edge of the front connecting member to a back front edge of the projecting portion of the right bearing member is about 26.3 mm and not greater than about 28.0 mm.

Still referring to FIG. 29, distance 530 between edges of the penetrating hole is about 9.0 mm in order to accommodate portions of the facsimile device in which the ink cartridge is arranged. Referring to FIG. 28, a distance 514 between another pair of facing edges of the penetrating hole of the back connecting member is about 15.8 mm and at least about 12.0 mm to accommodate for a portion of the facsimile device which may project into the space when the ink ribbon cartridge is attached to the facsimile device. A distance 516 from the left edge of the back connecting member to the left edge of the penetrating hole is about 103.0 mm and not greater than about 110.0 mm. A distance 518 of the right edge of the back connecting member to the right edge of the penetrating hole is about 103.5 mm and not greater than about 106.0 mm. A length 520 of the back connecting member between the left and right bearing members is about 224.0 mm and not greater than about 226.5 mm. A distance 512 of the left edge of the exemplary front connecting member to the left edge of the left grip portion 80 is about 4.8 mm. A distance 510 from the right edge of the front connecting member to the right edge of the right grip portion is about 5.2 mm.

Referring to FIG. 29, a distance 532 between the back edge of the top surface of the back connecting member to the front edge of the top surface of the back connecting member about 23.0 mm and not greater than about 30.0 mm in order to expose a sufficient amount of the ink ribbon sheet. A distance 644 between the front edge of the back supporting member and the back edge of the front supporting member is about 64.0 mm and not less than about 37.0 mm such that a sufficient amount of the ink ribbon sheet is exposed in the printing section of the facsimile device.

Figure 31:
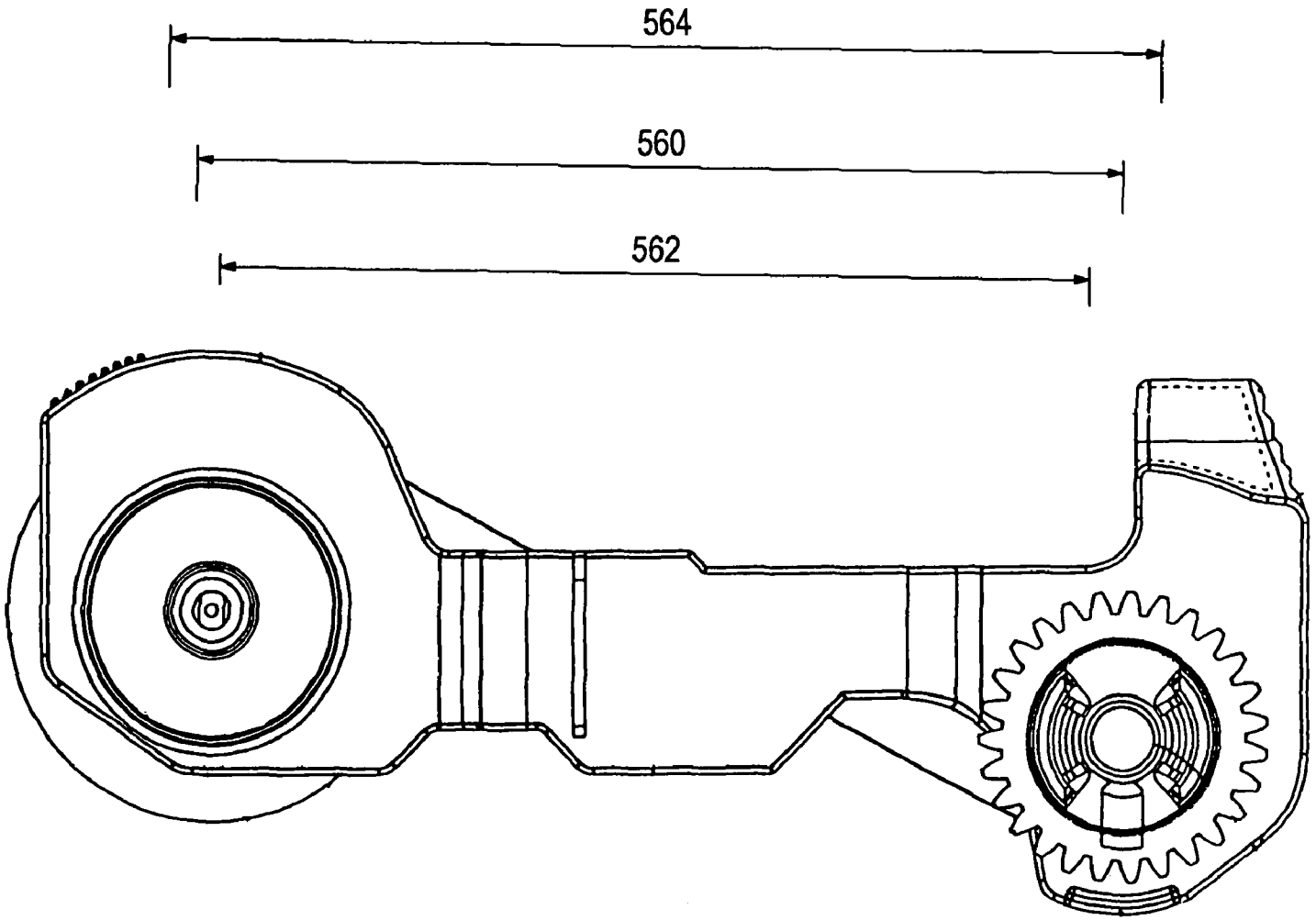
FIG. 31 is a perspective left-side view, including reference bars, of the exemplary ink ribbon cartridge of illustrated in FIG. 2.

Referring now to FIG. 31, a distance 562 between an inside edge of the take up spindle to an inside edge of the supply spindle is about 68.0 mm. A distance 564 between an outside edge of the take up spindle to an outside edge of the supply spindle is about 82.0 mm. A distance 560 between substantially the center of the take up spindle to substantially the center of the supply spindle is about 75.5 mm such that a sufficient distance exists between the take-up shaft and the supply shaft so that a sufficient portion of the ink ribbon sheet exposed therebetween is available for the printing section of the facsimile device.

Figure 32:
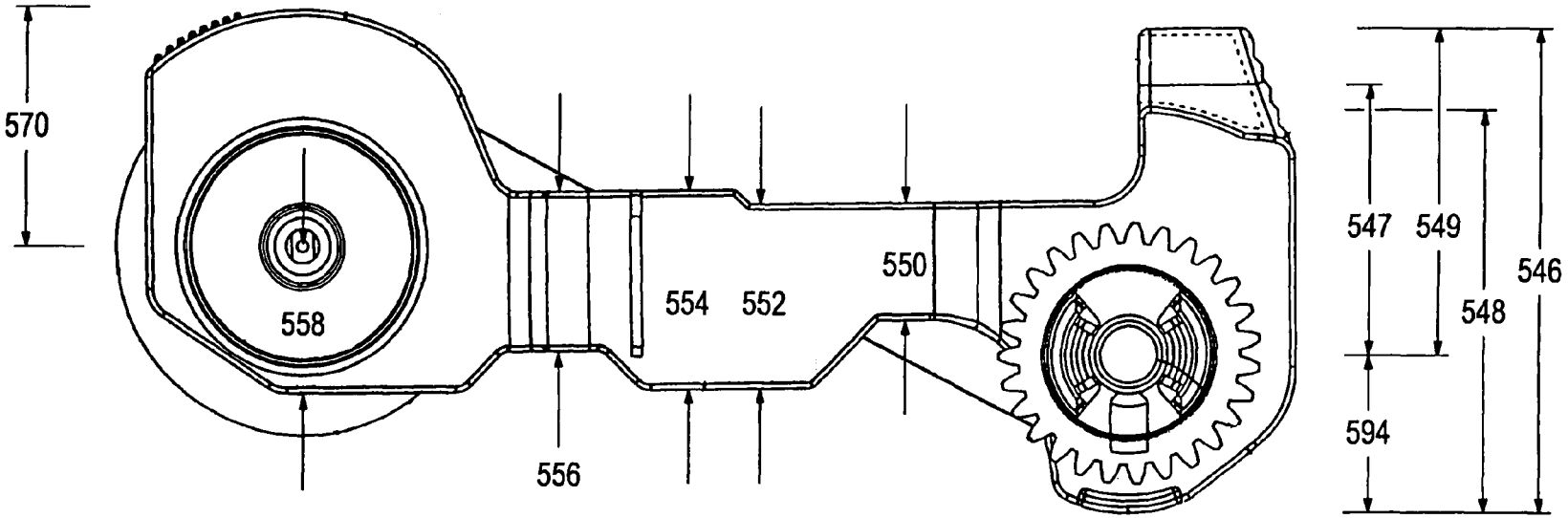
FIG. 32 is a perspective left-side view, including other reference bars, of the exemplary ink ribbon cartridge of illustrated in FIG. 2.

As discussed above, the left bearing member may have different portions having different heights, widths, thicknesses, etc., based on the amount of space provided therefore in the facsimile device and/or the necessary strength of the member. Referring now to FIG. 32, a distance 558 from a center of the supply spindle to the bottom surface of the back connecting member is about 12.4 mm and not greater than about 16.0 mm. A distance 570 between an axis of rotation of the supply shaft and the uppermost surface of the back connecting member is about 20.5 mm, and not greater than about 22.0 mm. A distance 546 from a bottom surface of the left bearing member to a top surface of the front connecting member is about 42.0 mm. A distance 548 from the bottom surface to the top surface of the left bearing member beneath the front connecting member is about 35.9 mm. A distance 547 between an axis of rotation of the take-up shaft to the uppermost portion of the portion of the front-connecting member between the grips 80 (or the uppermost surface of the front-connecting member) is about 23.4 mm, not greater than about 26.9 mm from an axis of rotation of the take-up shaft. A distance 549 between an axis of rotation of the take-up shaft to the uppermost surface of the grip(s) 80 is about 28.7 mm, and not greater than about 34.7 mm.

In the exemplary embodiment of the ink cartridge frame, a height 550 of a first portion of the left bearing member is about 10.0 mm. A height 552 of a second portion of the left bearing member is about 16.0 mm. A height 554 of a third portion of the left bearing member is about 17.3 mm. A height 556 of a fourth portion of the left bearing member is about 13.7 mm. The heights of the various portions may however be different in various embodiments and/or the substantially u-shaped portion may have a single height throughout, for example.

Figure 33:
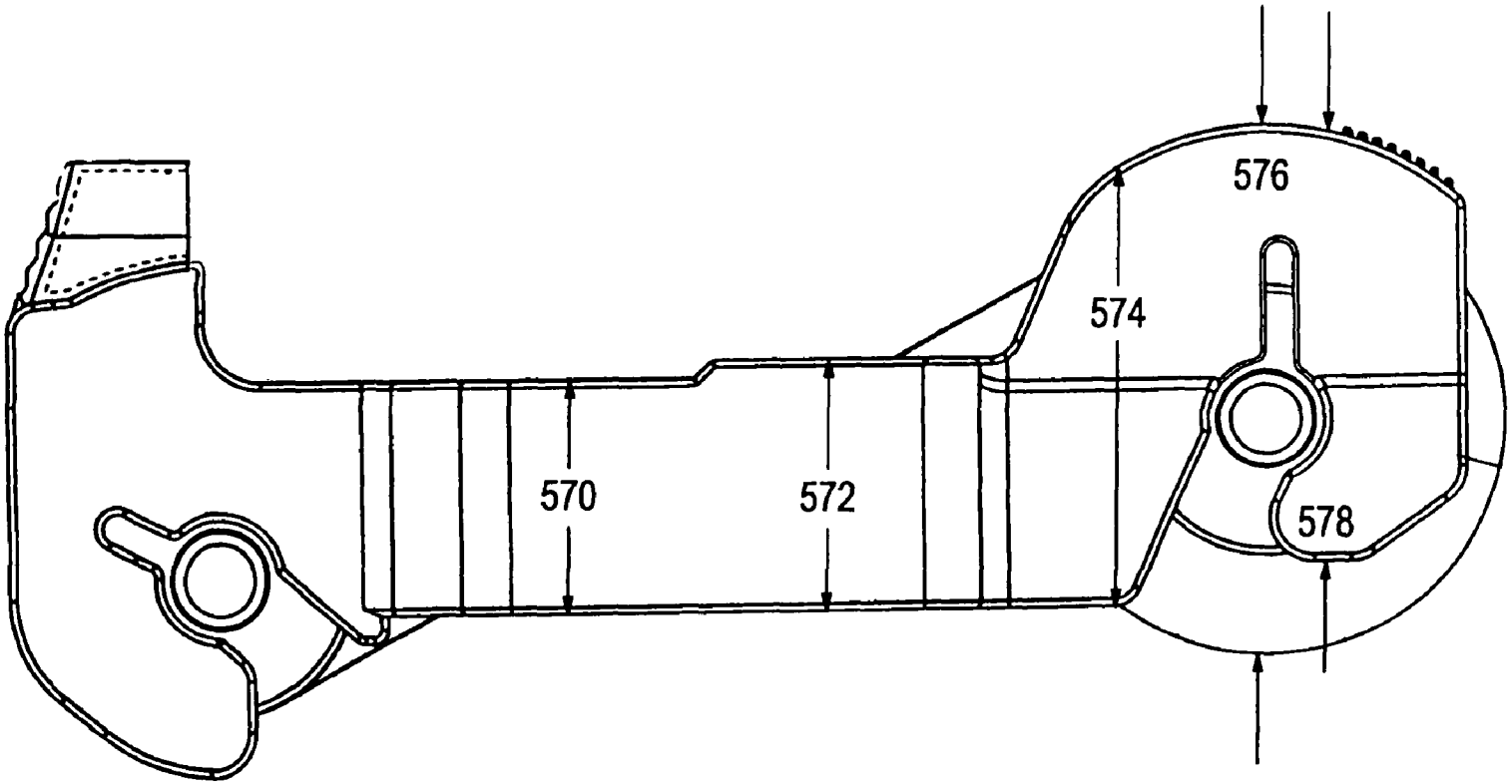
FIG. 33 is a perspective right-side view, including reference bars, of the exemplary ink ribbon cartridge illustrated in FIG. 2.

Similarly, the right bearing member may have different portions having different heights, widths, thicknesses, etc., based on the amount of space provided therefore in the facsimile device and/or the necessary strength of the member. Referring now to FIG. 33, a height 570 of the first portion of the right connector is about 20.5 mm and not greater than about 22.0 mm. A height 572 of a second portion of the right connector is about 17.0 mm. A distance 574 from the bottom surface of the supply end of the right bearing member to the top surface of the back connecting member is about 34.1 mm and not greater than about 38.0 mm. A distance 576 from a bottom surface of an ink ribbon roll to a top surface of the back connecting member is about 38.0 mm. A distance 578 from a bottom surface of the right bearing member below the back connecting member to the top surface of the connecting member is about 30.0 mm, not greater than about 38.0 mm.

Figure 34:
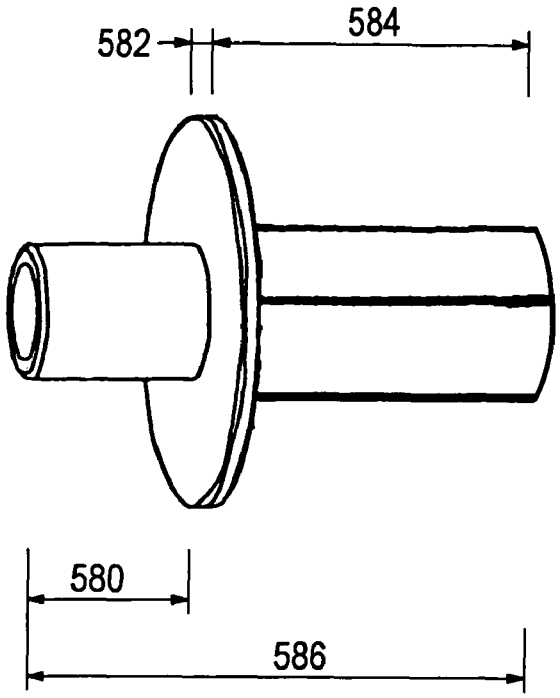
FIG. 34 is a perspective view, including reference bars, of an exemplary spool employing one or more aspects of the invention.
Figure 35:
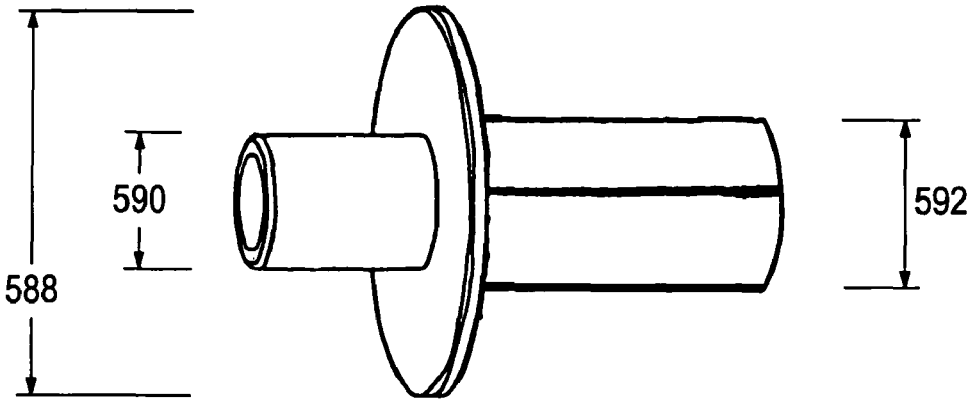
FIG. 35 is s a perspective view, including other reference bars, of the exemplary spool illustrated in FIG. 34, according to one or more aspects of the invention.
Figure 36B:
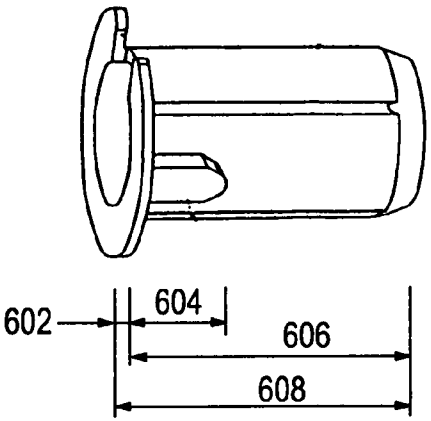
FIGS. 36A and 36B are perspective views, including reference bars, for an exemplary rotation member and an exemplary spool portion employing one or more aspects of the invention.
Figure 37B:
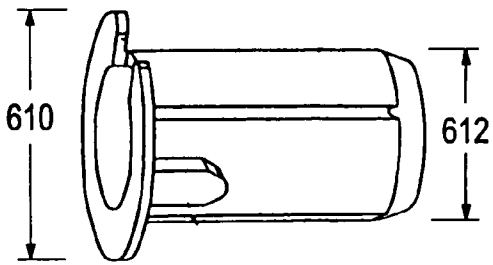
FIGS. 37A and 37B are perspective views, including other reference bars, for an exemplary rotation member and an exemplary spool portion employing one or more aspects of the invention.
Figure 36A:
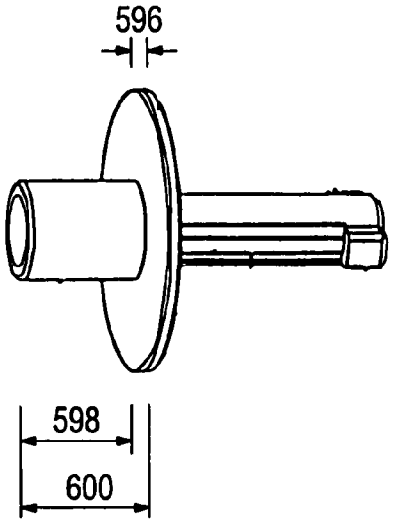
Figure 37A:
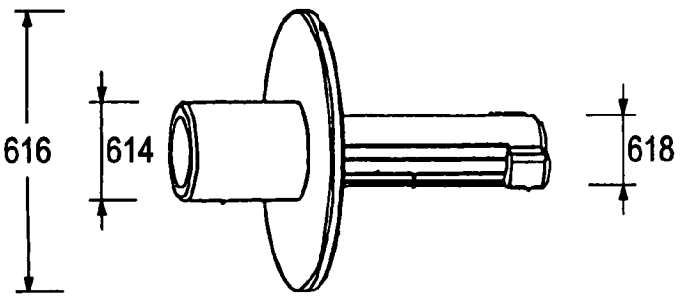

Referring to FIGS. 34 and 35, and with regard to the detachable/attachable support member, a distance 580 of the shaft portion of the rotation member is about 12.2 mm, and not greater than about 14.0 mm. A distance 586 of the detachable/attachable spool is about 35.0 mm. A distance 582 of the disk portion is about 1.0 mm, such that the portion has sufficient strength and does not take up excessive space. A distance 584 of the insert portion of the attachable/detachable support member is about 20.9 mm, so that the member can be relatively easily removed, as necessary during replacement of the ink ribbon sheet, for example. A diameter 590 of the shaft portion is about 6.9 mm and not greater than about 7.1 mm. A diameter 588 of the disk portion is about 18.0 mm. A diameter 592 of the spool portion is about 12.4 mm.

With regard to the hard to detach (i.e., undetachable) supply spool, illustrated in FIGS. 36A-37B, a distance 606 of the spool portion is about 17.6 mm such that the spool is sufficiently engaged in the shaft member in order to support the shaft, while remaining small enough to reduce cost, etc. A distance 596 of the disk portion is about 1.0 mm and such that the disk portion has sufficient strength, prevents the shaft portion from sliding into the supply shaft and does not take up excessive space unnecessarily. A distance 598 of the shaft portion is about 8.5 mm such that the shaft portion has sufficient strength to rotatably support the supply shaft and connect to the bearing member while not taking up excessive space unnecessarily. A total length 600 of the shaft portion and the disk portion is about 9.5 mm. A distance 602 of the collar member is about 1.0 mm such that the collar member has sufficient strength, and does not take up excessive space unnecessarily. A distance 618 of the insert portion of the supply spool including the projecting portion on the outer circumference of the supply spool is about 2.9 mm. The projecting portion may, for example, project from an outer surface of the insert portion of the supply spool to substantially the corresponding inner surface f the spool portion. A distance 604 of the projecting portion is about 5.4 mm and such that the projecting portion is strong enough to withstand the pressure to which it is subjected when engaged with the corresponding slits in the supply shaft, while not unnecessarily large. A distance 608 of the spool portion is about 18.6 mm and such that the supply shaft can be relatively easily removed from the spool portion, as necessary during replacement of the ink ribbon sheet, for example. A diameter 612 of the spool portion is about 12.5 mm and such that the spool portion is secure enough within the supply shaft so as to rotatably support the supply shaft. A diameter 610 of the collar portion is about 16.5 mm such that the disk portion has a diameter larger than the diameter of the spool portion. A diameter 616 of the disk portion is about 20.0 mm and such that the disk portion prevents the shaft portion from entering the opening 31*a* in the bearing member. A diameter 614 of the shaft portion is about 6.9 mm, not greater than about 7.1 mm such that the shaft portion has sufficient strength to rotatably support the supply shaft, while not taking up excessive space and fitting into the corresponding groove/opening of the bearing wall so that the supply shaft can rotate.

Figure 38A:
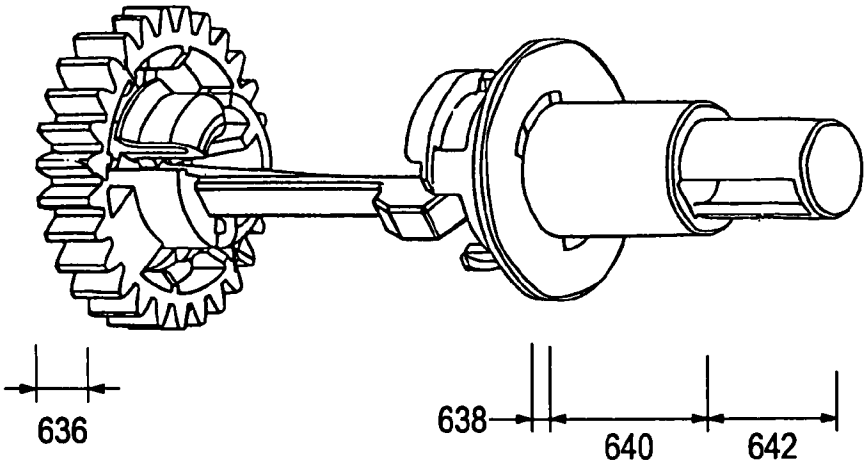
FIGS. 38A and 38B are perspective views, including reference bars, for an exemplary take-up spool including a gear member employing one or more aspects of the invention.
Figure 38B:
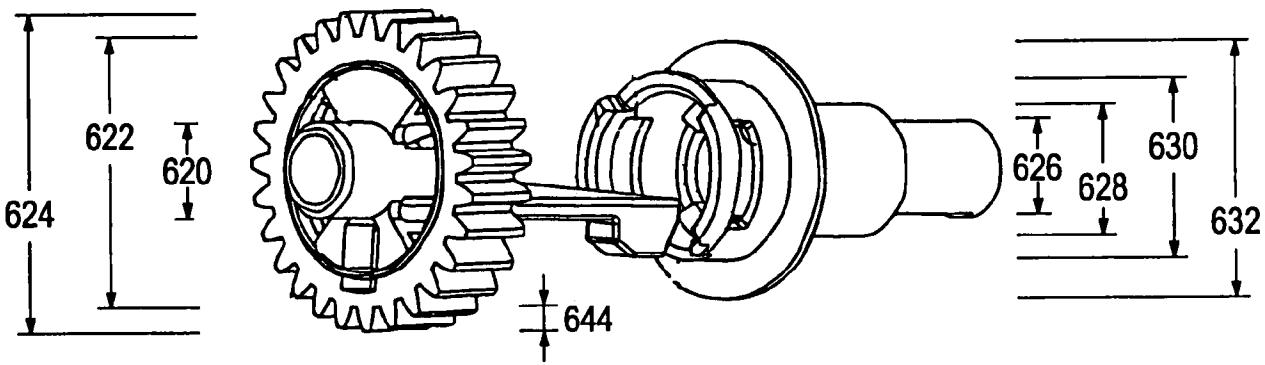

With regard to the take-up spool with a gear member, as illustrated in FIGS. 38A and 38B, a width 636 of the notches of the gear member is about 4.0 mm, not less than about 2.0 mm, and not greater than about 7.0 mm such that the notches can engage with the corresponding notches of the output gear which drives the device. A distance 640 of the first extension portion is about 13.3 mm and a distance 642 of the second extension portion is about 10.9 such that each portion has sufficient strength while providing a narrow spool portion at the end which can engage with a corresponding inner structure of the take-up shaft. The inner portion of the take-up shaft into which the second extension portion is inserted is an opening which has a distance, at least at one cross-section thereof, of about 7.4 mm, for example. The inner portion of the take-up shaft substantially surrounding the first extension portion is about 9.7 mm, for example. In various embodiments, the inner opening into which the second extension portion is inserted may have a shape of a circle or a polygon, for example. A diameter 620 of the shaft portion is about 6.9 mm, not greater than about 7.1 mm and such that the output gear of the facsimile device may properly connect therewith.

Still referring to FIGS. 38A and 38B, a length 622 of the inner circumference of the input gear is about 19.4 mm, a length 624 of the outer circumference of the input gear is about 23.1 mm, and not greater than about 23.2 mm. A distance 644 between outermost facing edges of the notches is about 1.9 mm. A distance including three consecutive notches is about 8.5 mm, not greater than about 8.6 mm and not less than about 8.4 mm such that the input gear properly meshes with the notches of the output gear of the facsimile device. A diameter 630 of the receiving portion is about 12.9 mm such that corresponding portions of the input gear securely connect with each other. A diameter 632 of the flange portion is about 18.5 mm. A distance 638 of the collar is about 1.0 mm, such that the collar has sufficient strength to prevent the take-up spool portion from being sliding further into the take-up spool, while not being unnecessarily large. A diameter 628 of the first extension portion is about 9.6 mm. A diameter 626 of the second extension portion is about 7.3 mm.

In various embodiments of the ink ribbon cartridge according to one or more aspects of the invention, the outer diameter of the take-up shaft and the size of the gear is such that when the input gear of the take-up shaft is driven by the output gear of the exemplary facsimile device 1, as discussed above, the ink ribbon sheet is propelled at a speed of about 0.07367 mm/step and generally is within a range including about 0.06000 mm/step to about 0.30000 mm/step. In the exemplary facsimile device, the paper is driven at a speed of about 0.06428 mm/step, such that the paper is driven at a speed which is less than the speed at which the ink ribbon sheet is driven.

In the exemplary implementation of an ink ribbon cartridge according to one or more aspects of the invention illustrated above, the shape of the cartridge frame is illustrated as being rectangular-like. The structure allows the supply shaft and the take-up shaft to be accommodated between a pair of wall-like bearing members which allow rotation of the supply shaft and the take-up shaft. Accordingly, according to one aspect of the invention, when the ink cartridge is arranged in the facsimile device, the removal of the ink cartridge is made easier by the projecting grips provided on the front connecting member. However, the shape of the cartridge frame may have a different non-rectangular shape in some embodiments of one or more aspects of the invention.

According to another aspect of the invention, the ink cartridge frame allows for easier attachment/detachment of the ink cartridge without increasing, and preferably decreasing a size of the facsimile device which employs the ink cartridge.

According to another aspect of the invention, not all the support members of the supply and take-up shafts detach from the frame during replacement of the ink ribbon, for example. Thus, according to one aspect of the invention, substantially secure support members are provided to reduce the number of parts which need to be connected and dealt with during attachment/detachment of the ink cartridge.

Various implementations of this invention provide a back tension (rotation resistance) on the supply shaft via components provided on the supply spool such that the image forming device employing an ink cartridge in which various features of the invention have been implemented can result in a smaller ink cartridge and/or image forming device.

While this invention has been described in conjunction with exemplary embodiments outlined above, many alternatives, modifications and variations will be apparent to those skilled in the art. Accordingly, the exemplary embodiments as set forth above, are intended to be illustrative and not limiting. Various changes may be made without departing from the spirit and scope of the invention.

What is claimed is:

1. An ink ribbon cartridge, comprising:

a frame;

supply shaft supporting members, the supply shaft supporting members supporting a supply shaft; and take-up shaft supporting members, the take-up shaft supporting members supporting a take-up shaft, wherein:

the frame comprises:

a first bearing member, a second bearing member, a front connecting member connecting front ends of the first and second bearing members together, the front connecting member including:

a groove arranged substantially in a central part, the groove extending in a direction that is parallel to the supply and take-up shafts, and having a right and a left side, a first grip portion arranged on the left side of the groove, and a second grip portion arranged on the right side of the groove, and a back connecting member connecting back ends of the first and second bearing members together, wherein the back connecting member has one of a groove or a hole arranged substantially in a central part, along a length and width direction, of the back connecting member such that the groove or hole is on a top face of the back connecting member when the ink ribbon cartridge is installed in an operating position, wherein the groove, when present, is formed from a center portion of the top face of the back connecting member that extends below adjacent portions of the top face of the back connecting member, each of the first and second grip portions having a top wall and a front wall, the top wall and the front wall defining an open space inside each of the first and second grip portions, a back side of each of the first and second grip portions having an opening which permits fingers of a user to grip around the top and front walls and into the open space of each of the first and second grip portions, wherein the front wall of each of the first and second grip portions is provided with multiple ribs, each of the multiple ribs extending in a direction parallel to the supply and take-up shafts.

2. The ink ribbon cartridge of claim 1, wherein the front connecting member is substantially above the supply shaft.

3. The ink ribbon cartridge of claim 2, wherein the back connecting member is substantially above the take-up shaft.

4. The ink ribbon cartridge of claim 1, wherein the at least one groove or hole is arranged substantially along a center portion, along a length of the back connecting member.

5. The ink ribbon cartridge of claim 1, wherein the first bearing member and the second bearing member are arranged substantially parallel to each other.

6. The ink ribbon cartridge of claim 5, wherein the front connecting member connects an upper edge of a first end of the first bearing member to an upper edge of a first end of the second bearing member.

7. The ink ribbon cartridge of claim 6, wherein the back connecting member connects an upper edge of a second end of the first bearing member to an upper edge of a second end of the second bearing member.

8. The ink ribbon cartridge of claim 7, wherein the first bearing member and the second bearing member are shaped such that a distance between substantially center facing portions thereof is greater than a distance between substantially end facing portions thereof.

9. The ink ribbon cartridge of claim 8, wherein at least one of the first bearing member and the second bearing member includes a substantially u-like portion along a center portion thereof, wherein the substantially u-like portion extends outward beyond at least one end portion of the at least one of the first bearing member and the second bearing member.

10. The ink ribbon cartridge of claim 8, wherein both the first bearing member and the second bearing member include a substantially u-like portion along a center portion thereof, wherein the substantially u-like portion extends outward beyond at least one end portion of the first and second bearing member.

11. The ink ribbon cartridge of claim 10, wherein the first and second grip portions extend substantially upward from an upper surface of the front connecting member.

12. The ink ribbon cartridge of claim 1, wherein:

the ends of the take-up shaft and the supply shaft are rotatably supported by the first and second bearing members; and the first and second grip portions project substantially upward from a level corresponding to at least one of an upper edge of each of the first and second bearing members where the front connecting member is connected thereto such that the groove is adjacent to the first and second grip portions.

13. The ink ribbon cartridge of claim 12, wherein the front connecting member is substantially above the supply shaft.

14. The ink ribbon cartridge of claim 13, wherein the back connecting member is substantially above the take-up shaft.

15. The ink ribbon cartridge of claim 12, wherein the groove accommodates a portion of an image forming device in which the ink ribbon cartridge is arranged.

16. The ink ribbon cartridge of claim 12, wherein the first and second grip portions have an inverted L-like shape such that depending on a width of the first and second grip portions at least one finger may wrap around a back side of the first and second grip portions during handling of the ink ribbon cartridge.

17. The ink ribbon cartridge of claim 16, wherein the first grip portion is arranged at substantially a left end of the front connecting member and the second grip portion is arranged at substantially a right end of the front connecting member.

18. The ink ribbon cartridge of claim 16, wherein a substantially center portion of the front connecting member has a height relative to an axis of rotation of the take-up shaft which is less than a height of an upper surface of the first and second grip portions.

19. The ink ribbon cartridge of claim 16, wherein the first and second grip portions are substantially centered above an axis of rotation the take-up shaft.

20. The ink ribbon cartridge of claim 16, wherein the firs and second grip portions have the plurality of ribs on an outer surface thereof.

21. The ink ribbon cartridge of claim 12, wherein the groove accommodates a transfer roller.

22. The ink ribbon cartridge of claim 1, wherein the first bearing member is substantially parallel to the second bearing member, wherein substantially center portions of the second and first bearing member have a distance therebetween which is larger than a distance between other facing portions of the second and first bearing member.

23. The ink ribbon cartridge of claim 21, wherein each portion of the second and first bearing members corresponding to a portion thereof where a corresponding end of the supply shaft and take-up shaft is rotatably connected has a height, relative to the lowest portion of the ink ribbon cartridge when the ink ribbon cartridge is installed in an operative state, which is greater than a height of the substantially center portions thereof.

* * * * *